US010862210B2

(12) United States Patent
Behdad et al.

(10) Patent No.: US 10,862,210 B2
(45) Date of Patent: Dec. 8, 2020

(54) MULTIPLE BAND POLARIZATION ROTATING PHASED ARRAY ELEMENT

(71) Applicant: Wisconsin Alumni Research Foundation, Madison, WI (US)

(72) Inventors: Nader Behdad, Oregon, WI (US); John H. Booske, McFarland, WI (US); Hung Thanh Luyen, Madison, WI (US); Zongtang Zhang, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 62 days.

(21) Appl. No.: 16/362,947

(22) Filed: Mar. 25, 2019

(65) Prior Publication Data

US 2020/0243968 A1 Jul. 30, 2020

Related U.S. Application Data

(63) Continuation-in-part of application No. 15/977,130, filed on May 11, 2018.

(51) Int. Cl.

| | |
|---|---|
| ***H01Q 3/34*** | (2006.01) |
| ***H01Q 21/26*** | (2006.01) |
| ***H01Q 19/10*** | (2006.01) |
| ***H01Q 15/24*** | (2006.01) |

(52) U.S. Cl.

CPC ..... *H01Q 3/34* (2013.01); *H01Q 15/24* (2013.01); *H01Q 19/104* (2013.01); *H01Q 21/26* (2013.01)

(58) Field of Classification Search

CPC ..... H01Q 3/34; H01Q 3/26; H01Q 3/267; H01Q 3/2676; H01Q 15/24; H01Q 19/104; H01Q 21/26; H01Q 21/0025; H01Q 25/00

USPC ..... 342/368

See application file for complete search history.

(56) References Cited

U.S. PATENT DOCUMENTS

2002/0158052 A1* 10/2002 Ehrmann ..... B23K 26/043 219/121.69

2018/0287268 A1* 10/2018 Kosaka ..... H01Q 21/061

* cited by examiner

*Primary Examiner* — Harry K Liu

(74) *Attorney, Agent, or Firm* — Bell & Manning, LLC

(57) ABSTRACT

A multiple band phase shifter includes a first dielectric layer, a conductive layer, a second dielectric layer, and for each central operating frequency of a plurality of central operating frequencies, a switch, a plurality of vias, and a conducting pattern layer. Each via is formed of a conductive material that extends through the first dielectric layer, through a third dielectric material formed in and through the conductive layer, and through the second dielectric layer and is connected to a first throw arm or a second throw arm of the switch. The conducting pattern layer includes conductors electrically connected to a distinct via. An electric polarization of a reflected electromagnetic wave is rotated by 90 degrees when the switch is positioned in the first conducting position and the electric polarization of the reflected electromagnetic wave is rotated by −90 degrees when the switch is positioned in the second conducting position.

20 Claims, 52 Drawing Sheets

3100

MULTIPLE BAND POLARIZATION ROTATING PHASED ARRAY ELEMENT

CROSS-REFERENCE TO RELATED APPLICATIONS

The present application is a continuation-in-part of U.S. patent application Ser. No. 15/977,130 that was filed May 11, 2018, the entire contents of which are hereby incorporated by reference.

REFERENCE TO GOVERNMENT RIGHTS

This invention was made with government support under N00014-16-1-2308 awarded by the US Navy/ONR. The government has certain rights in the invention.

BACKGROUND

A phased array antenna is an array of antennas in which a relative phase of signals feeding each antenna is varied such that an effective radiation pattern of the array is reinforced in a desired direction and suppressed in undesired directions to provide electronic steering of a beam. To convert a reflector array into a beam steerable antenna, a phase shift distribution provided by spatial phase shifting pixels is dynamically changed depending on the direction of the desired output beam in the far field.

Beams are formed by shifting the phase of the signal emitted from each radiating element to provide either constructive or destructive interference to steer the beam. These antenna systems come in different sizes and scales due to several factors such as frequency and power requirements. High-power phased array antenna technology that yields an affordable system is a major problem in the commercial and military wireless industry. The cost of current phased array antenna technology is a major factor that limits application to the most expensive military systems. Additionally, the solid-state technology that lies at the heart of current phased array antenna technology has inherent limitations when it comes to power and heat handling capability due to the generation of a large amount of heat.

One of the desirable features that reflective array antennas offer is beam collimation using planar structures or structures that can conform to the outer surface of a given platform. A typical reflective array antenna consists of an array of terminated, unidirectional radiating elements operating as scatterers. When illuminated with a feed antenna, each element of the array scatters the wave with a different phase shift (or time delay) and amplitude. Collectively, the amplitude and phase (or time delay) responses of the elements are designed to provide beam collimation over the reflective array antenna's aperture. This way, a reflective array antenna can be thought of as an aperture populated with a number of discrete spatial phase shifters or spatial time delay units.

SUMMARY

In an illustrative embodiment, a multiple band phase shifter is provided. The multiple band phase shifter includes, but is not limited to, a first dielectric layer, a conductive layer, a second dielectric layer, and for each central operating frequency of a plurality of central operating frequencies, a switch, a plurality of vertical interconnect accesses (vias), and a conducting pattern layer. The first dielectric layer includes, but is not limited to, a top, first dielectric surface and a bottom, first dielectric surface. The top, first dielectric surface is on an opposite side of the first dielectric layer relative to the bottom, first dielectric surface. The first dielectric layer is formed of a dielectric material. The conductive layer includes, but is not limited to, a top conductive surface and a bottom conductive surface. The top conductive surface is on an opposite side of the first conductive layer relative to the bottom conductive surface. The bottom conductive surface is mounted to the top, first dielectric surface. The conductive layer is formed of a first conductive material. The second dielectric layer includes, but is not limited to, a top, second dielectric surface and a bottom, second dielectric surface. The top, second dielectric surface is on an opposite side of the second dielectric layer relative to the bottom, second dielectric surface. The bottom, second dielectric surface is mounted to the top conductive surface. The second dielectric layer is formed of a second dielectric material. The switch is mounted to the bottom, first dielectric surface and is configured to be switchable between a first conducting position defined by a first throw arm and a second conducting position defined by a second throw arm. Each vertical interconnect access (via) of the plurality of vias is formed of a second conductive material that extends through the first dielectric layer, through a third dielectric material formed in and through the conductive layer, and through the second dielectric layer. Each via of the plurality of vias is connected to one of the first throw arm or the second throw arm of the switch. The conducting pattern layer includes, but is not limited to, a plurality of conductors. The plurality of conductors is mounted to the top, second dielectric surface. The conducting pattern layer is formed of a third conductive material. Each conductor of the plurality of conductors is electrically connected to a distinct via of the plurality of vias. The first conductive material is configured to reflect an electromagnetic wave incident on the conducting pattern layer and on the second dielectric layer. When the incident electromagnetic wave is reflected, an electric polarization of the reflected electromagnetic wave is rotated by 90 degrees compared to an electric polarization of the incident electromagnetic wave when the switch is positioned in the first conducting position and the electric polarization of the reflected electromagnetic wave is rotated by −90 degrees compared to the electric polarization of the incident electromagnetic wave when the switch is positioned in the second conducting position.

In another illustrative embodiment, a phased array antenna is provided. The phased array antenna includes, but is not limited to, the first dielectric layer, the conductive layer, the second dielectric layer, and a plurality of multiple band phase shift elements distributed linearly in a direction. Each multiple band phase shift element of the plurality of multiple band phase shift elements includes, but is not limited to, for each central operating frequency of the plurality of central operating frequencies, the switch, the plurality of vias, and the conducting pattern layer.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
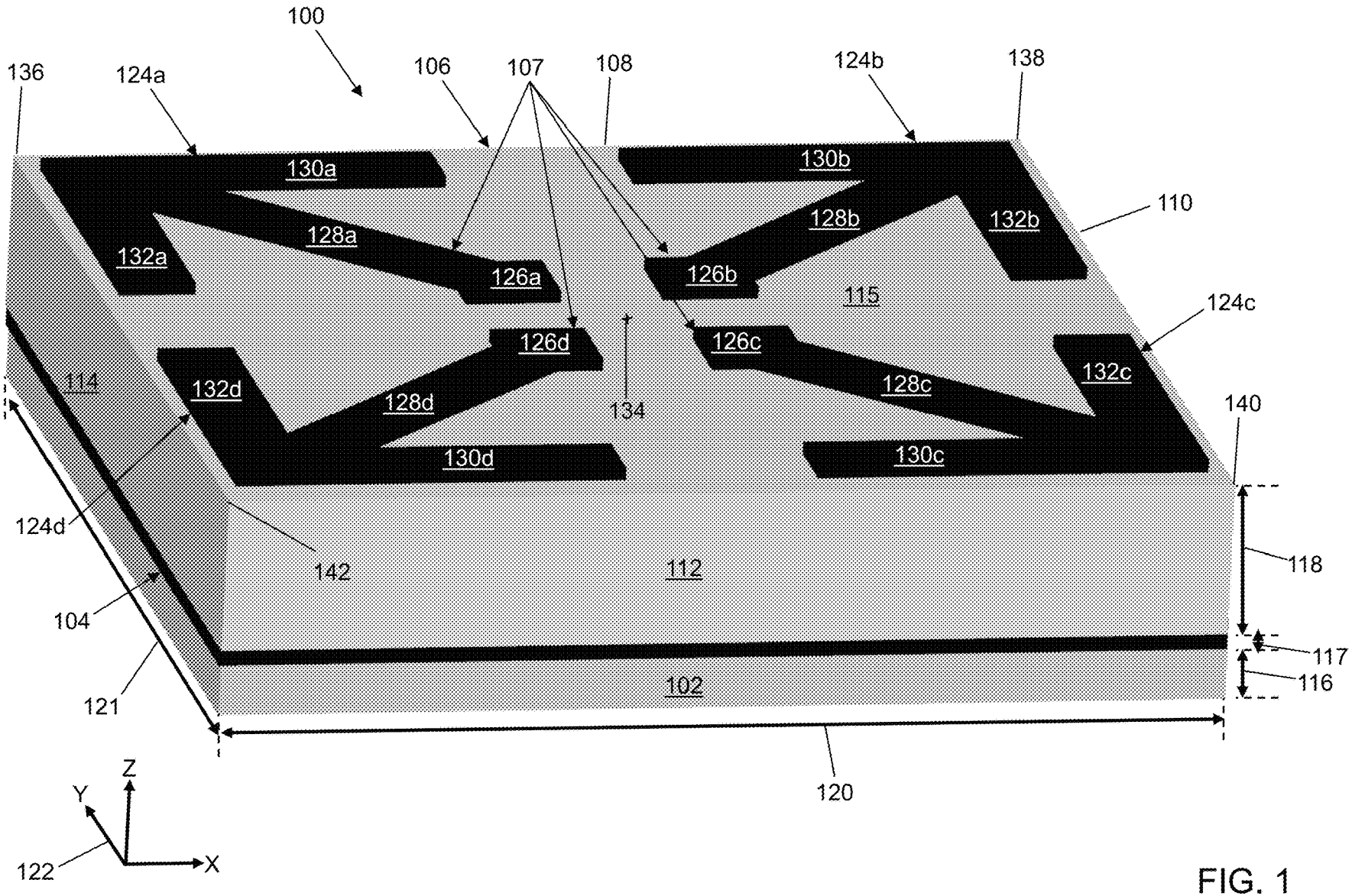
FIG. 1 depicts a perspective side view of a phase shifting element in accordance with an illustrative embodiment.
Figure 2:
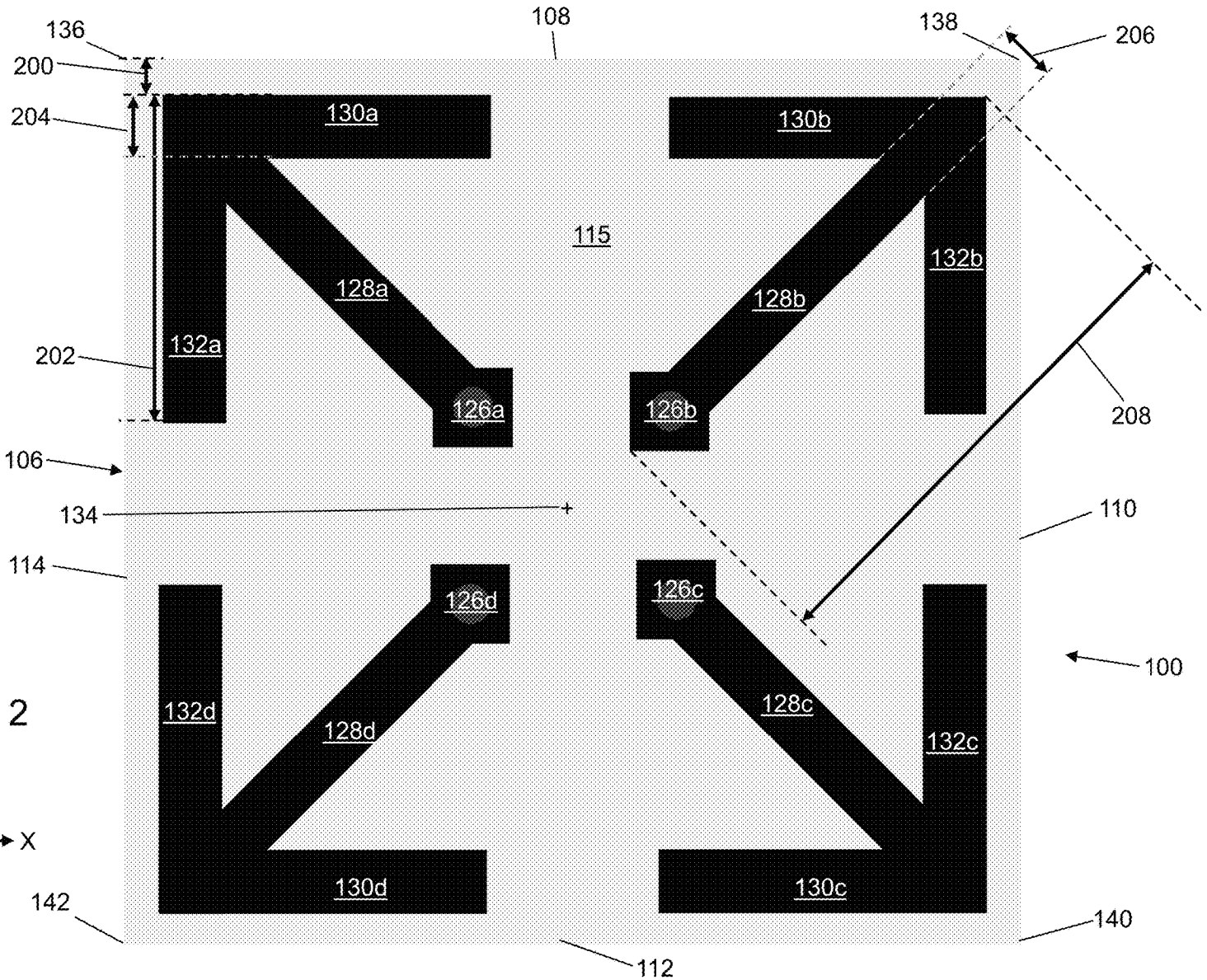
FIG. 2 depicts a top view of the phase shifting element of FIG. 1 in accordance with an illustrative embodiment.
Figure 3:
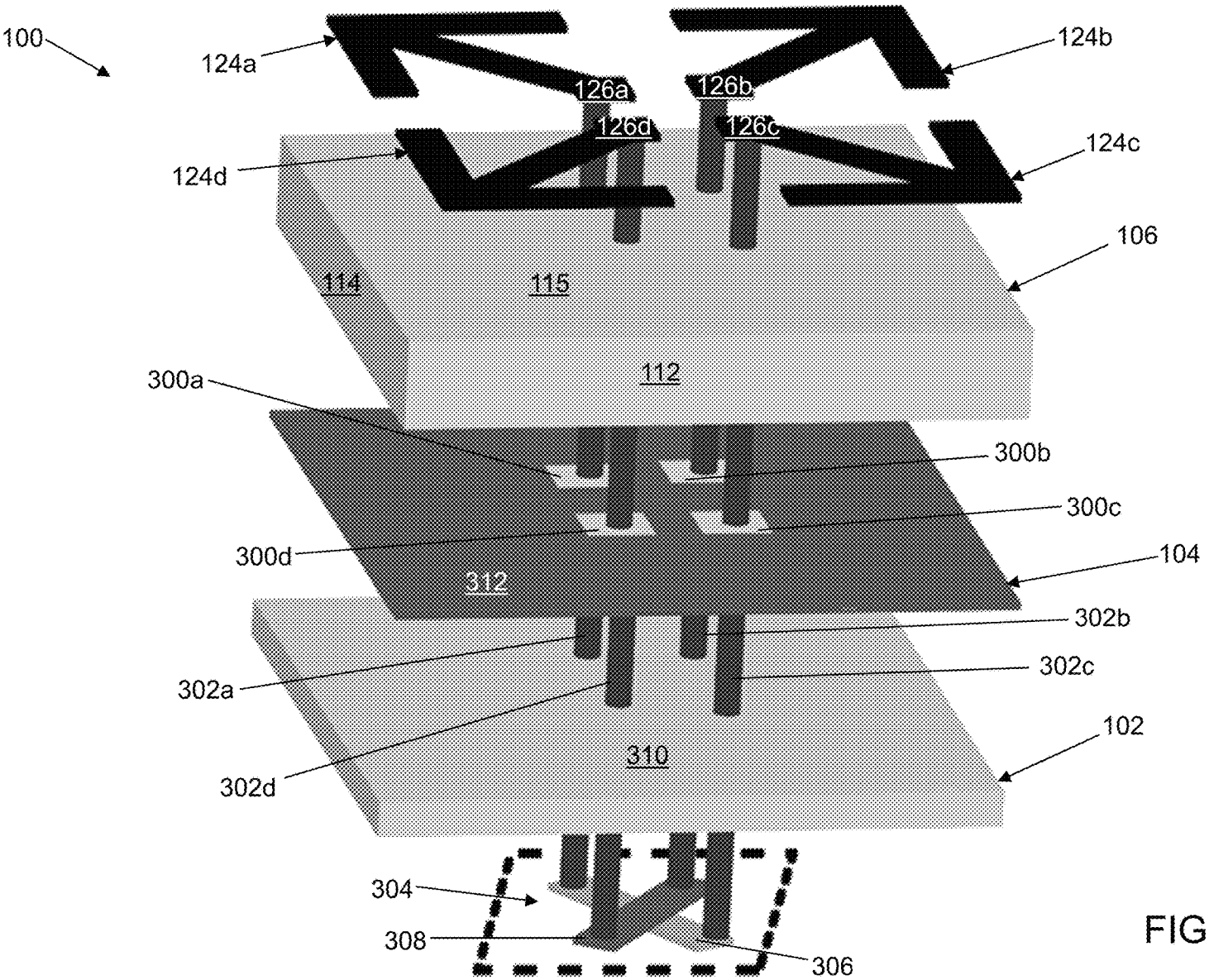
FIG. 3 depicts an exploded, perspective side view of the phase shifting element of FIG. 1 in accordance with an illustrative embodiment.
Figure 4:
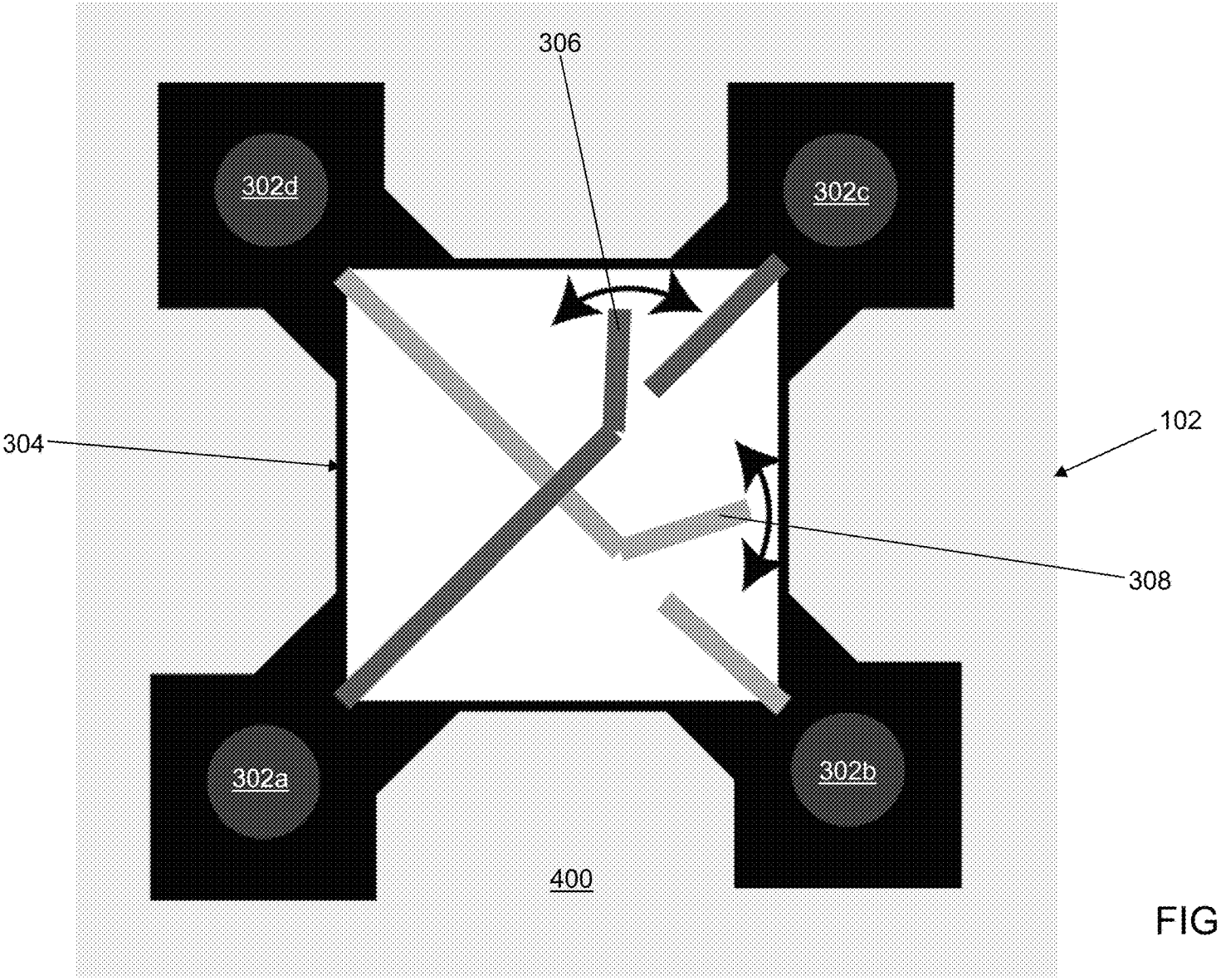
FIG. 4 depicts a bottom view of the phase shifting element of FIG. 1 in accordance with an illustrative embodiment.
Figure 5A:
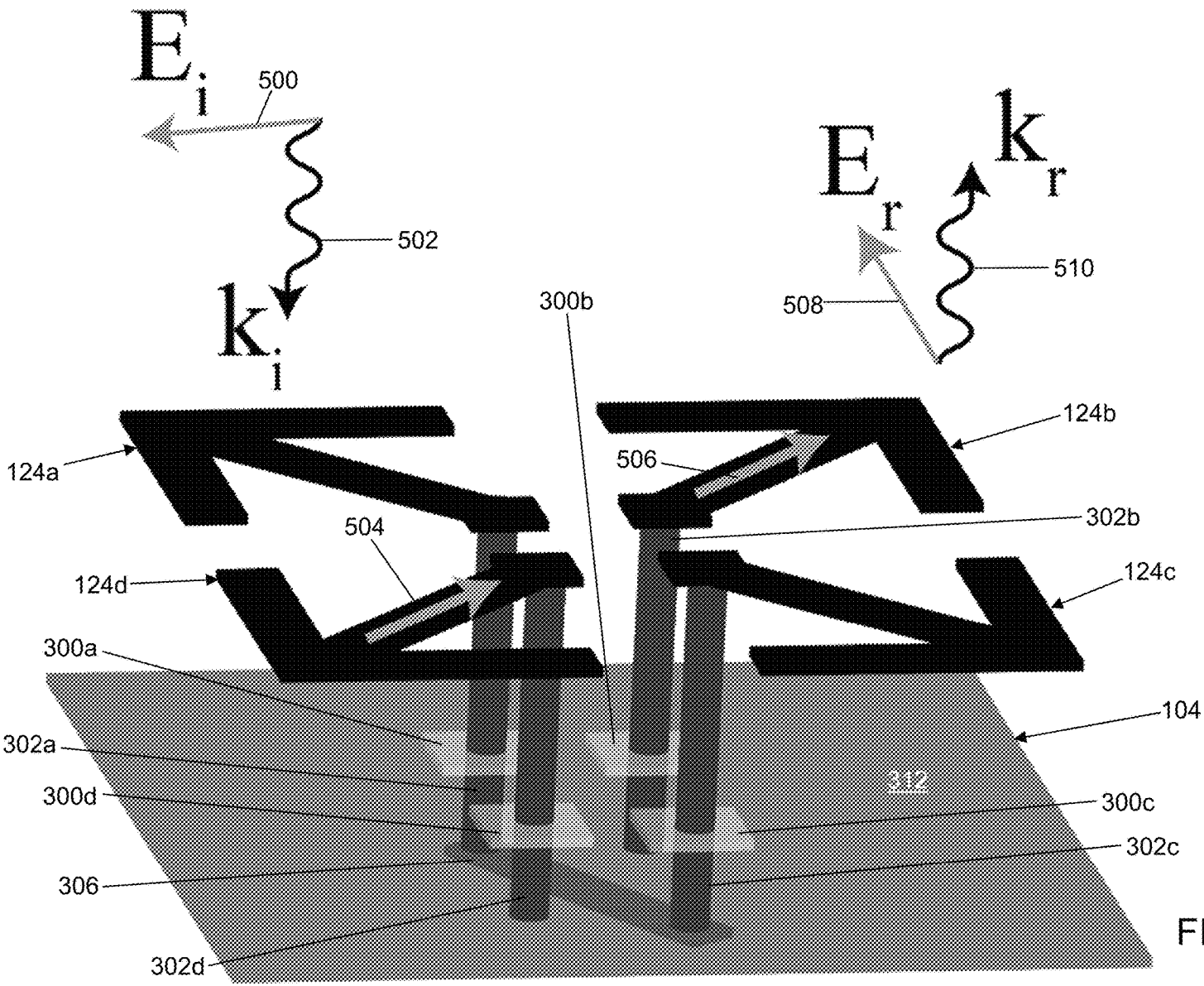
FIG. 5A depicts a transparent perspective side view of the phase shifting element of FIG. 1 with dielectric material removed and with electric field and current flow directions shown based on a first switch position in accordance with an illustrative embodiment.
Figure 5B:
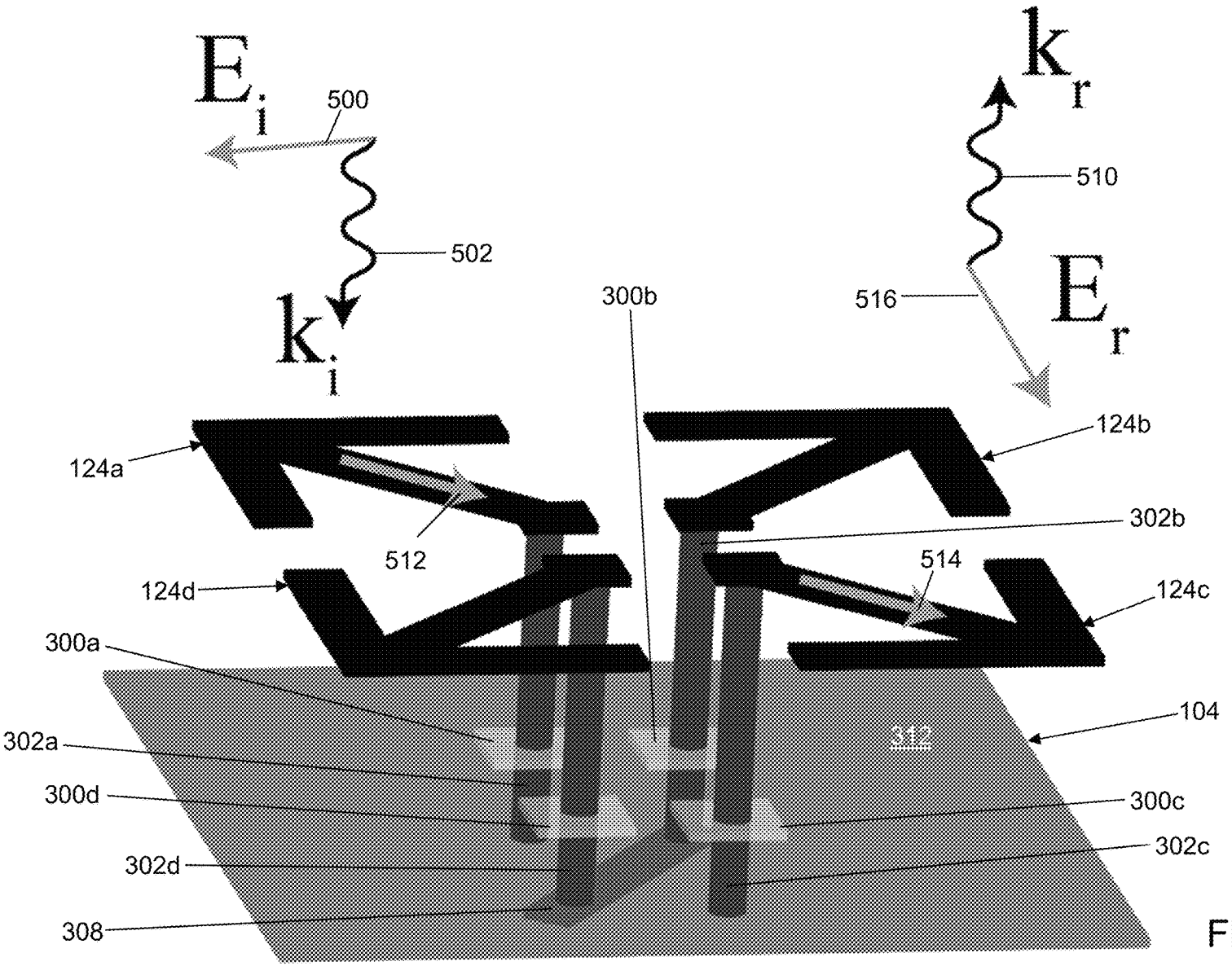
FIG. 5B depicts a second transparent perspective side view of the phase shifting element of FIG. 1 with the dielectric material removed and with the electric field and current flow directions shown based on a second switch position in accordance with an illustrative embodiment.

Referring to FIG. 1, a perspective side view of a phase shifting element 100 is shown in accordance with an illustrative embodiment. Referring to FIG. 2, a top view of phase shifting element 100 is shown in accordance with an illustrative embodiment. Referring to FIG. 3, an exploded, perspective side view of phase shifting element 100 is shown in accordance with an illustrative embodiment. Referring to FIG. 4, a bottom view of phase shifting element 100 is shown in accordance with an illustrative embodiment. Referring to FIG. 5A, a transparent perspective side view of phase shifting element 100 is shown with dielectric material removed and with electric field and current flow directions shown based on a first switch position in accordance with an illustrative embodiment. Referring to FIG. 5B, a second transparent perspective side view of phase shifting element 100 is shown with the dielectric material removed and with the electric field and current flow directions shown based on a second switch position in accordance with an illustrative embodiment.

Phase shifting element 100 may include a first dielectric layer 102, a conducting layer 104, a second dielectric layer 106, and a conducting pattern layer 107. Phase shifting element 100 provides a polarization rotating surface that can be used as a spatial phase shifter of a single-layer, wideband reflective array antenna. Phase shifting element 100 rotates a polarization of a reflected wave by 90° compared to that of an incident wave. Phase shifting element 100 can be switched between a first configuration and a second configuration that is a geometric mirror image of the first configuration. As such, phase shifting element 100 can be used as a one-bit spatial phase shifter that provides either −90° or +90 polarization rotation compared to that of the incident wave. The two reflected fields have a phase difference of 180° degrees between them. Therefore, if one is taken as a reference, the other one has a phase shift of 180° with respect to the first one. Because phase shifting using phase shifting element 100 is achieved through geometric means, phase shifting element 100 can provide either 0° or 180° phase shift over extremely broad bandwidths.

First dielectric layer 102 is formed of one or more dielectric materials that may include foamed polyethylene, solid polyethylene, polyethylene foam, polytetrafluoroethylene, air, air space polyethylene, vacuum, etc. Illustrative dielectric materials include RO4003C laminate and RO3006 laminate sold by Rogers Corporation headquartered in Chandler, Ariz., USA.

Second dielectric layer 106 is also formed of one or more dielectric materials. First dielectric layer 102 and second dielectric layer 106 may be formed of the same or different dielectric materials and the same or a different number of layers of dielectric material.

Conducting layer 104 may be formed of a sheet of conductive material such as copper plated steel, silver plated steel, silver plated copper, silver plated copper clad steel, copper, copper clad aluminum, steel, etc. Conducting pattern layer 107 also may be formed of a conductive material such as copper plated steel, silver plated steel, silver plated copper, silver plated copper clad steel, copper, copper clad aluminum, steel, etc. Conducting layer 104 and conducting pattern layer 107 may be formed of the same or a different conductive material. Conducting layer 104 is a conducting surface with high conductivity that reflects received electromagnetic waves. Conducting layer 104 is connected to a fixed potential that may be, but is not necessarily, a ground potential. Conducting layer 104 may be generally flat or formed of ridges or bumps. For illustration, conducting layer 104 may be formed of a flexible membrane coated with a conductor.

Conducting layer 104 is mounted between first dielectric layer 102 and second dielectric layer 106 such that a top surface 310 of first dielectric layer 102 is mounted to a bottom surface of conducting layer 104, and second dielectric layer 106 is mounted to a top surface 312 of conducting layer 104. Each of first dielectric layer 102, conducting layer 104, and second dielectric layer 106 has a generally square top and bottom surface shape in an x-y plane and a thickness in a vertical direction denoted by a z-axis, where an x-axis is perpendicular to a y-axis, and both the x-axis and the y-axis are perpendicular to the z-axis to form a right-handed coordinate reference frame denoted x-y-z frame 122. First dielectric layer 102, conducting layer 104, and second dielectric layer 106 have a length 120 parallel to the x-axis, and a width 121 parallel to the y-axis. In the illustrative embodiment, length 120 is equal to width 121.

Second dielectric layer 106 has a back wall 108, a right-side wall 110, a front wall 112, a left-side wall 114, a top surface 115, and a bottom surface (not shown). The bottom surface of second dielectric layer 106 is mounted to top surface 312 of conducting layer 104.

The top and bottom surfaces of each of first dielectric layer 102, conducting layer 104, and second dielectric layer 106 are generally flat. First dielectric layer 102 has a first thickness 116 parallel to the z-axis. Conducting layer 104 has a second thickness 117 parallel to the z-axis. Second dielectric layer 106 has a third thickness 118 parallel to the z-axis.

Conducting pattern layer 107 is formed on top surface 115 of second dielectric layer 106 opposite conducting layer 104. Conducting pattern layer 107 includes a first corner conductor 124*a*, a second corner conductor 124*b*, a third corner conductor 124*c*, and a fourth corner conductor 124*d*. In the illustrative embodiment, first corner conductor 124*a*, second corner conductor 124*b*, third corner conductor 124*c*, and fourth corner conductor 124*d* each form an open arrow shape with arrow tip arms separated by 90 degrees and each arrow tip pointed at 135°, 45°, 315°, and 225°, respectively, in the x-y plane and relative to the +x-direction. Thus, a tip of each open arrow shape is pointed in a direction that is rotated 90° relative to each adjacent tip.

First corner conductor 124*a*, second corner conductor 124*b*, third corner conductor 124*c*, and fourth corner conductor 124*d* are symmetrically distributed relative to each corner of top surface 115 of second dielectric layer 106. First corner conductor 124*a* and second corner conductor 124*b* form a mirror image of third corner conductor 124*c* and fourth corner conductor 124*d* relative to an x-z center plane through a center 134 of top surface 115 of second dielectric layer 106. The x-z center plane is parallel to the x-z plane defined by x-y-z frame 122. First corner conductor 124*a* and fourth corner conductor 124*d* form a mirror image of second corner conductor 124*b* and third corner conductor 124*c* relative to a y-z center plane through center 134 of top surface 115 of second dielectric layer 106. The y-z center plane is parallel to the y-z plane defined by x-y-z frame 122.

First corner conductor 124*a* is positioned in an upper left quadrant of top surface 115 of second dielectric layer 106. First corner conductor 124*a* includes a first switch connector 126*a*, a first connecting arm 128*a*, a first x-arm 130*a*, and a first y-arm 132*a*. First x-arm 130*a* and first y-arm 132*a* are perpendicular to each other, and first connecting arm 128*a* bisects the corner in which first x-arm 130*a* and first y-arm 132*a* join each other. As a result, first connecting arm 128*a* is aligned with and extends from the tip formed at the intersection of first x-arm 130*a* and first y-arm 132*a*. First switch connector 126*a*, first connecting arm 128*a*, first x-arm 130*a*, and first y-arm 132*a* are used to describe a shape of first corner conductor 124*a* and typically are not distinct elements but form a single conductive structure.

First switch connector 126*a* connects first corner conductor 124*a* to a first vertical interconnect access (via) 302*a*. First connecting arm 128*a* connects first x-arm 130*a* and first y-arm 132*a* to first switch connector 126*a*. First connecting arm 128*a* extends parallel to a diagonal between center 134 and an upper left corner 136. First x-arm 130*a* extends from upper left corner 136 towards an upper right corner 138 parallel to the x-axis. First y-arm 132*a* extends from upper left corner 136 towards a lower left corner 142 parallel to the y-axis.

First x-arm 130*a* is a first distance 200 from back wall 108. First y-arm 132*a* is first distance 200 from left-side wall 114. First x-arm 130*a* has a corner arm length 202 and a corner arm width 204. First y-arm 132*a* has corner arm length 202 and corner arm width 204. First connecting arm 128*a* has an arm length 208 and an arm width 206. For simplicity of description, first x-arm 130*a*, first y-arm 132*a*, and first connecting arm 128*a* have been described to overlap near an upper left corner 136 though again first switch connector 126*a*, first connecting arm 128*a*, first x-arm 130*a*, and first y-arm 132*a* typically are not distinct elements, but form a single conductive structure. Similarly, for simplicity of description, first switch connector 126*a* overlaps an end of first connecting arm 128*a*. First switch connector 126*a* surrounds a top end of first via 302*a*. First switch connector 126*a* is illustrated as having a square shape though it may have other shapes including circular, oval, triangular, etc.

First via 302*a* forms an electrical connection between a first throw arm 306 of a switch 304 through first dielectric layer 102, conducting layer 104, and second dielectric layer 106 to form an electronic circuit. First via 302*a* is formed of a conductive material. A first dielectric patch 300*a* is formed through conducting layer 104 of a dielectric material. First via 302*a* extends generally parallel to the z-axis through first dielectric patch 300*a*.

Second corner conductor 124*b* is positioned in an upper right quadrant of top surface 115 of second dielectric layer 106. Second corner conductor 124*b* includes a second switch connector 126*b*, a second connecting arm 128*b*, a second x-arm 130*b*, and a second y-arm 132*b*. Second x-arm 130*b* and second y-arm 132*b* are perpendicular to each other, and second connecting arm 128*b* bisects the corner in which second x-arm 130*b* and second y-arm 132*b* join each other. As a result, second connecting arm 128*b* is aligned with and extends from the tip formed at the intersection of second x-arm 130*b* and second y-arm 132*b*. Second switch connector 126*b*, second connecting arm 128*b*, second x-arm 130*b*, and second y-arm 132*b* are used to describe a shape of second corner conductor 124*b* and typically are not distinct elements but form a single conductive structure.

Second switch connector 126*b* connects second corner conductor 124*b* to a second via 302*b*. Second connecting arm 128*b* connects second x-arm 130*b* and second y-arm 132*b* to second switch connector 126*b*. Second connecting arm 128*b* extends parallel to a diagonal between center 134 and upper right corner 138. Second x-arm 130*b* extends from upper right corner 138 towards upper left corner 136 parallel to the x-axis. Second y-arm 132*b* extends from upper right corner 138 towards a lower right corner 140 parallel to the y-axis.

Second x-arm 130*b* is first distance 200 from back wall 108. Second y-arm 132*b* is first distance 200 from right-side wall 110. Second x-arm 130*b* has corner arm length 202 and corner arm width 204. Second y-arm 132*b* has corner arm length 202 and corner arm width 204. Second connecting arm 128*b* has arm length 208 and arm width 206. For simplicity of description, second x-arm 130*b*, second y-arm 132*b*, and second connecting arm 128*b* have been described to overlap near upper right corner 138 though again second switch connector 126*b*, second connecting arm 128*b*, second x-arm 130*b*, and second y-arm 132*b* typically are not distinct elements, but form a single conductive structure. Similarly, for simplicity of description, second switch connector 126*b* overlaps an end of second connecting arm 128*b*. Second switch connector 126*b* surrounds a top end of second via 302*b*. Second switch connector 126*b* is illustrated as having a square shape though it may have other shapes including circular, oval, triangular, etc.

Second via 302*b* forms an electrical connection between a second throw arm 308 of switch 304 through first dielectric layer 102, conducting layer 104, and second dielectric layer 106 to form an electronic circuit. Second via 302*b* is formed of a conductive material. A second dielectric patch 300*b* is formed through conducting layer 104 of a dielectric material. Second via 302*b* extends generally parallel to the z-axis through second dielectric patch 300*b*.

Third corner conductor 124*c* is positioned in a lower right quadrant of top surface 115 of second dielectric layer 106. Third corner conductor 124*c* includes a third switch connector 126*c*, a third connecting arm 128*c*, a third x-arm 130*c*, and a third y-arm 132*c*. Third x-arm 130*c* and third y-arm 132*c* are perpendicular to each other, and third connecting arm 128*c* bisects the corner in which third x-arm 130*c* and third y-arm 132*c* join each other. As a result, third connecting arm 128*c* is aligned with and extends from the tip formed at the intersection of third x-arm 130*c* and third y-arm 132*c*. Third connecting arm 128*c* and first connecting arm 128*a* are parallel to each other. Third switch connector 126*c*, third connecting arm 128*c*, third x-arm 130*c*, and third y-arm 132*c* are used to describe a shape of third corner conductor 124*c* and typically are not distinct elements but form a single conductive structure.

Third switch connector 126*c* connects third corner conductor 124*c* to a third via 302*c*. Third connecting arm 128*c* connects third x-arm 130*c* and third y-arm 132*c* to third switch connector 126*c*. Third connecting arm 128*c* extends parallel to a diagonal between center 134 and lower right corner 140. Third x-arm 130*c* extends from lower right corner 140 towards lower left corner 142 parallel to the x-axis. Third y-arm 132*c* extends from lower right corner 140 towards upper right corner 138 parallel to the y-axis.

Third x-arm 130*c* is first distance 200 from front wall 112. Third y-arm 132*c* is first distance 200 from right-side wall 110. Third x-arm 130*c* has corner arm length 202 and corner arm width 204. Third y-arm 132*c* has corner arm length 202 and corner arm width 204. Third connecting arm 128*c* has arm length 208 and arm width 206. For simplicity of description, third x-arm 130*c*, third y-arm 132*c*, and third connecting arm 128*c* have been described to overlap near lower right corner 140 though again third switch connector 126*c*, third connecting arm 128*c*, third x-arm 130*c*, and third y-arm 132*c* typically are not distinct elements, but form a single conductive structure. Similarly, for simplicity of description, third switch connector 126*c* overlaps an end of third connecting arm 128*c*. Third switch connector 126*c* surrounds a top end of third via 302*c*. Third switch connector 126*c* is illustrated as having a square shape though it may have other shapes including circular, oval, triangular, etc.

Third via 302*c* forms an electrical connection between first throw arm 306 of switch 304 through first dielectric layer 102, conducting layer 104, and second dielectric layer 106 to form an electronic circuit. Third via 302*c* is formed of a conductive material. A third dielectric patch 300*c* is formed through conducting layer 104 of a dielectric material. Third via 302*c* extends generally parallel to the z-axis through third dielectric patch 300*c*.

Fourth corner conductor 124*d* is positioned in a lower left quadrant of top surface 115 of second dielectric layer 106. Fourth corner conductor 124*d* includes a fourth switch connector 126*d*, a fourth connecting arm 128*d*, a fourth x-arm 130*d*, and a fourth y-arm 132*d*. Fourth x-arm 130*d* and fourth y-arm 132*d* are perpendicular to each other, and fourth connecting arm 128*d* bisects the corner in which fourth x-arm 130*d* and fourth y-arm 132*d* join each other. As a result, fourth connecting arm 128*d* is aligned with and extends from the tip formed at the intersection of fourth x-arm 130*d* and fourth y-arm 132*d*. Fourth connecting arm 128*d* and second connecting arm 128*b* are parallel to each other. Fourth switch connector 126*d*, fourth connecting arm 128*d*, fourth x-arm 130*d*, and fourth y-arm 132*d* are used to describe a shape of fourth corner conductor 124*d* and typically are not distinct elements but form a single conductive structure.

Fourth switch connector 126*d* connects fourth corner conductor 124*d* to a fourth via 302*d*. Fourth connecting arm 128*d* connects fourth x-arm 130*d* and fourth y-arm 132*d* to fourth switch connector 126*d*. Fourth connecting arm 128*d* extends parallel to a diagonal between center 134 and lower left corner 142. Fourth x-arm 130*d* extends from lower left corner 142 towards lower right corner 140 parallel to the x-axis. Fourth y-arm 132*c* extends from lower left corner 142 towards upper left corner 136 parallel to the y-axis.

Fourth x-arm 130*d* is first distance 200 from front wall 112. Fourth y-arm 132*d* is first distance 200 from left-side wall 114. Fourth x-arm 130*d* has corner arm length 202 and corner arm width 204. Fourth y-arm 132*d* has corner arm length 202 and corner arm width 204. Fourth connecting arm 128*d* has arm length 208 and arm width 206. For simplicity of description, fourth x-arm 130*d*, fourth y-arm 132*d*, and fourth connecting arm 128*d* have been described to overlap near lower left corner 142 though again fourth switch connector 126*d*, fourth connecting arm 128*d*, fourth x-arm 130*d*, and fourth y-arm 132*d* typically are not distinct elements, but form a single conductive structure. Similarly, for simplicity of description, fourth switch connector 126*d* overlaps an end of fourth connecting arm 128*d*. Fourth switch connector 126*d* surrounds a top end of fourth via 302*d*. Fourth switch connector 126*d* is illustrated as having a square shape though it may have other shapes including circular, oval, triangular, etc.

Fourth via 302*d* forms an electrical connection between second throw arm 308 of switch 304 through first dielectric layer 102, conducting layer 104, and second dielectric layer 106 to form an electronic circuit. Fourth via 302*d* is formed of a conductive material. A fourth dielectric patch 300*d* is formed through conducting layer 104 of a dielectric material. Fourth via 302*d* extends generally parallel to the z-axis through fourth dielectric patch 300*d*.

Inclusion of first x-arms 130*a*, 130*b*, 130*c*, 130*d* perpendicular to first y-arms 132*a*, 132*b*, 132*c*, 132*d*, respectively, allows phase shifting element 100 to support polarizations parallel to the x-axis as well as the y-axis.

Switch 304 is a double pole, double throw (DPDT) switch. In a first position, first throw arm 306 of switch 304 is closed to electrically connect first via 302*a* with third via 302*c*. In a second position, second throw arm 308 of switch 304 is closed to electrically connect second via 302*b* with fourth via 302*d*. Switch 304 is mounted to bottom surface 400 of first dielectric layer 102. When switch 304 is in the first position, phase shifting element 100 may be designated as in a bit zero, "bit 0", configuration. When switch 304 is in the second position, phase shifting element 100 may be designated as in a bit one, "bit 1", configuration. Of course, the configurations can be reversed. Switch 304 may be a mechanical switch, a microelectromechanical system (MEMS) switch, a commercially available DPDT switch, a plurality of PIN diodes, etc.

A combined electrical path length of first connecting arm 128*a* and first via 302*a* is approximately $\lambda_0/4$ (a quarter of the wavelength) and includes arm length 208 that defines a length of first connecting arm 128*a* and third thickness 118, third thickness 117, and third thickness 116 that define a length of first via 302*a*. Similarly, a combined electrical path length of second connecting arm 128*b* and second via 302*b* is approximately $\lambda_0/4$. Similarly, a combined electrical path length of third connecting arm 128*c* and third via 302*c* is approximately $\lambda_0/4$. Similarly, a combined electrical path length of fourth connecting arm 128*d* and fourth via 302*d* is approximately $\lambda_0/4$. $\lambda_0$ is the wavelength in free space at the frequency of operation.

An electrical path length of each of first throw arm 306 and of second throw arm 308 of switch 304 can be set in the range from $\lambda_0/100$ to $\lambda_0/5$ (e.g. based on a range of physical dimensions of several commercial electronic switches and PIN diodes). The electrical path length for the currents of switch 304 is included in a total electrical path length for each connected pair of arms (e.g., first connecting arm 128*a* and first via 302*a* connected to third connecting arm 128*c* and third via 302*c*) when connected by first throw arm 306 or second throw arm 308 of switch 304. The total electrical path length of each connected pair of arms is approximately half a wavelength.

Referring to FIG. 5A, the first position that defines the bit zero configuration is shown in accordance with an illustrative embodiment. In the first position, first throw arm 306 of switch 304 is closed to electrically connect first via 302*a* and third via 302*c* thereby electrically connecting first corner conductor 124*a* with third corner conductor 124*c*. First connecting arm 128*a*, first throw arm 306, and third connecting arm 128*c* are parallel to each other and form an angle of 135° relative to the x-axis. When first connecting arm 128*a* and third connecting arm 128*c* are electrically connected via first throw arm 306 of switch 304, a total electrical length of an extended electrical pathway, which includes first x-arm 130*a*, first y-arm 132*a*, first connecting arm 128*a*, first switch connector 126*a*, first via 302*a*, first throw arm 306, third via 302*c*, third switch connector 126*c*, third connecting arm 128*c*, third x-arm 130*c*, and third y-arm 132*c*, is approximately half a wavelength. This results in very small currents flowing on first connecting arm 128*a* and third connecting arm 128*c* and large currents flowing on first throw arm 306 and first via 302*a* and third via 302*c*, thus deactivating the polarization rotating effect of first connecting arm 128*a* and third connecting arm 128*c*.

On the other hand, second connecting arm 128*b* and fourth connecting arm 128*d* are electrically isolated, and the electrical length of each electrical pathway of second corner conductor 124*b* (second x-arm 130*b*, second y-arm 132*b*, second connecting arm 128*b*, second switch connector 126*b*, second via 302*b*) and of fourth corner conductor 124*d* (fourth x-arm 130*d*, fourth y-arm 132*d*, fourth connecting arm 128*d*, fourth switch connector 126*d*, fourth via 302*d*) is approximately a quarter wavelength, which results in large currents flowing on second connecting arm 128*b* and fourth connecting arm 128*d* as indicated in FIG. 5A. For an incident wave with an incident electric field $E_i$ 500 in the −x direction parallel to the x-axis, a periodic structure consisting of phase shifting elements 100 in the bit zero configuration rotates the polarization of the reflected wave by 90° resulting in a reflected wave with a reflected electric field $E_r$ 508 in the −y direction parallel to the y-axis.

A first incident wave vector $k_i$ 502 points in a direction of incident wave propagation. A first reflected wave vector $k_r$ 510 points in a direction of reflected wave propagation. The magnitude of first incident wave vector $k_i$ 502 and of first reflected wave vector $k_r$ 510 are $2\pi/\lambda_0$.

Referring to FIG. 5B, the second position that defines the bit one configuration is shown in accordance with an illustrative embodiment. In the second position, second throw arm 308 of switch 304 is closed to electrically connect second via 302*b* and fourth via 302*d* thereby electrically connecting second corner conductor 124*b* with fourth corner conductor 124*d*. Second connecting arm 128*b*, second throw arm 308, and fourth connecting arm 128*d* are parallel to each other and form an angle of 45° relative to the x-axis. When second connecting arm 128*b* and fourth connecting arm 128*d* are electrically connected via second throw arm 308 of switch 304, a total electrical length of an extended electrical pathway, which includes second x-arm 130*b*, second y-arm 132*b*, second connecting arm 128*b*, second switch connector 126*b*, second via 302*b*, second throw arm 308, fourth via 302*d*, fourth switch connector 126*d*, fourth connecting arm 128*d*, fourth x-arm 130*d*, and fourth y-arm 132*d*, is approximately half a wavelength. This results in very small currents flowing on second connecting arm 128*b* and fourth connecting arm 128*d* and large currents flowing on second throw arm 308 and second via 302*b* and fourth via 302*d* thus deactivating the polarization rotating effect of second connecting arm 128*b* and fourth connecting arm 128*d*.

On the other hand, first connecting arm 128*a* and third connecting arm 128*c* are electrically isolated, and the electrical length of each electrical pathway of first corner conductor 124*a* (first x-arm 130*a*, first y-arm 132*a*, first connecting arm 128*a*, first switch connector 126*a*, first via 302*a*) and of third corner conductor 124*c* (third x-arm 130*c*, third y-arm 132*c*, third connecting arm 128*c*, third switch connector 126*c*, third via 302*c*) is approximately a quarter wavelength, which results in large currents flowing on first connecting arm 128*a* and third connecting arm 128*c* as indicated in FIG. 5B. For the incident wave with the incident electric field $E_i$ 500 in the −x direction parallel to the x-axis, a periodic structure consisting of phase shifting elements 100 in the bit one configuration rotates the polarization of the reflected wave by −90° resulting in a reflected wave with a reflected electric field $E_r$ 516 in the +y direction parallel to the y-axis.

As a result, depending on whether phase shifting element 100 is in the bit zero configuration or in the bit one configuration based on the position of the throw arms of switch 304, phase shifting element 100 rotates the polarization of the reflected electric field by +90° or by −90° with respect to the polarization of the incident electric field. As a result, the two different modes supported by phase shifting element 100 provides reflected electric field $E_r$ 508 and reflected electric field $E_r$ 516 that are in opposite directions as shown in FIGS. 5A and 5B creating a phase difference of 180° between the reflected waves in these modes.

Dimensions for phase shifting element 100 can be determined based on the following:

$$0 < P \leq \frac{\lambda_0}{2}$$

$$\frac{\lambda_{eff}}{10} \leq l_1 \leq \frac{\lambda_{eff}}{4};\ l_1 < \frac{P}{\sqrt{2}};\ \lambda_{eff} \approx \frac{\lambda_0}{\sqrt{\frac{1+\epsilon_{r,1}}{2}}}$$

$$\frac{\lambda_{eff}}{10} \leq l_2 \leq \frac{\lambda_{eff}}{4};\ l_2 < \frac{P}{2}$$

$$\frac{\lambda_0}{10} \leq h_1 \times \sqrt{\epsilon_{r,1}} + \cdots + h_{n-1} \times \sqrt{\epsilon_{r,n-1}} \leq \frac{\lambda_0}{3}$$

$$0 \leq h_m \times \sqrt{\epsilon_{r,m}} < \lambda_0$$

$$0 < w_1 \leq \frac{\lambda_0}{10}$$

$$0 < w_2 \leq \frac{\lambda_0}{10}$$

$$0 < s \leq \frac{\lambda_0}{10}$$

where $\lambda_0 = c/f_0$, where c is the speed of light and $f_0$ is a carrier frequency, where P is length 120 and width 121, $l_1$ is arm length 208, $w_1$ is arm width 206, $l_2$ is corner arm length 202, $w_2$ is corner arm width 204, s is first distance 200, $\epsilon_{r,1}$ is a relative permittivity of a top layer of second dielectric layer 106, $h_1$ is third thickness 118 of the top layer of second dielectric layer 106, $\epsilon_{r,n-1}$ is a relative permittivity of a next layer of second dielectric layer 106 when second dielectric layer 106 is formed of a plurality of dielectric layers n, $h_{n-1}$ is a thickness of the next layer of second dielectric layer 106 when second dielectric layer 106 is formed of a plurality of dielectric layers n, $\epsilon_{r,m}$ is a relative permittivity of first dielectric layer 102, $h_m$ is first thickness 116 of first dielectric layer 102. When second dielectric layer 106 is formed of the plurality of dielectric layers n, third thickness 118 is a total thickness of second dielectric layer 106. As an example, for $f_0 \epsilon [1,30]$ GHz, $\lambda_0 \epsilon [30,1]$ centimeters (cm).

Figure 6:
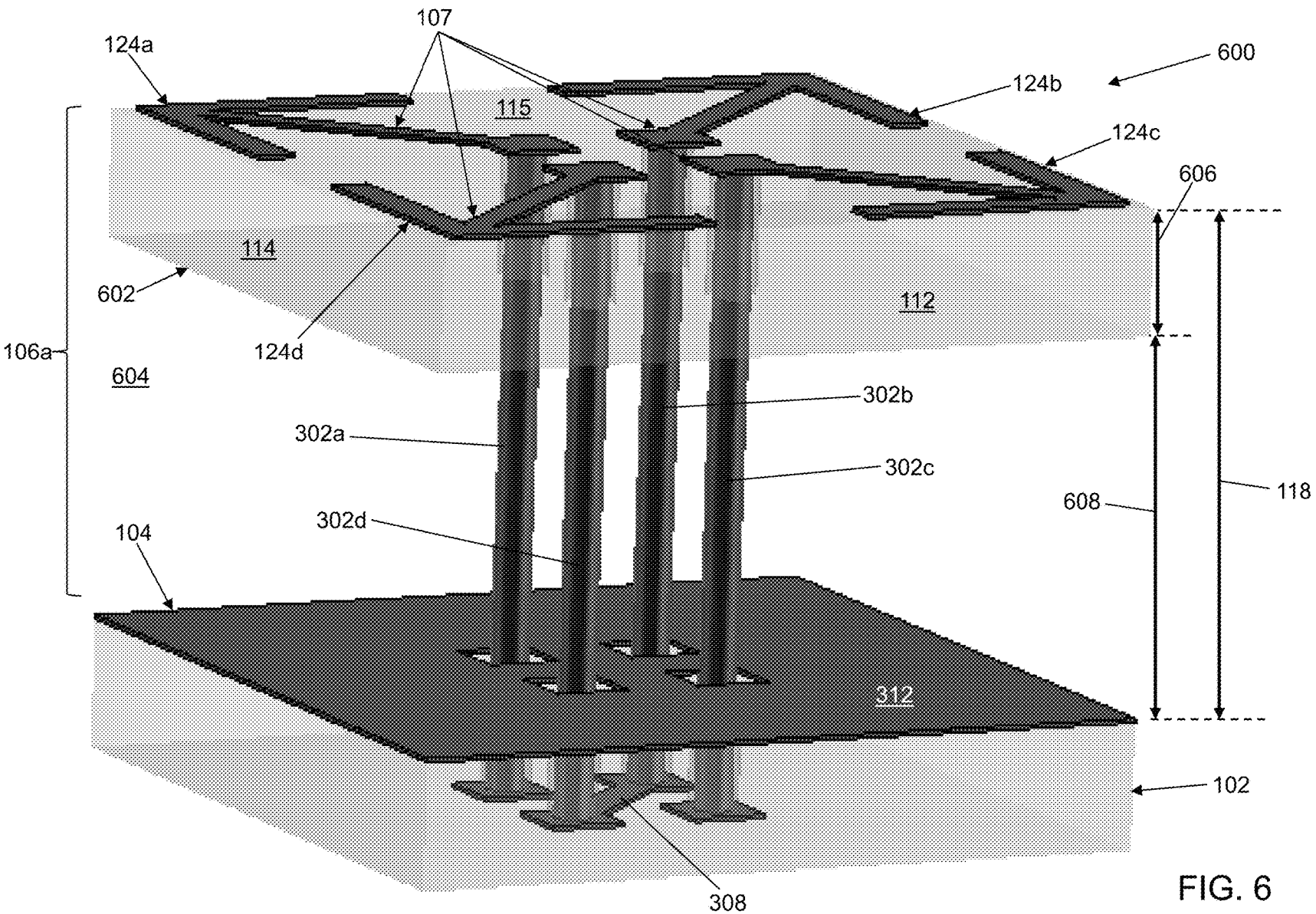
FIG. 6 depicts a transparent perspective side view of a second phase shifting element similar to that shown in FIG. 1 with an additional dielectric material layer and shown with the second switch position in accordance with an illustrative embodiment.

Referring to FIG. 6, a transparent perspective side view of a second phase shifting element 600 is shown in accordance with an illustrative embodiment. Second phase shifting element 600 includes first dielectric layer 102, conducting layer 104, a third dielectric layer 106*a*, and conducting pattern layer 107. Third dielectric layer 106*a* is similar to second dielectric layer 106 except that it is formed of two dielectric layers, a top dielectric layer 602 and a sandwiched dielectric layer 604. Conducting pattern layer 107 is formed on top surface 115 of top dielectric layer 602 and has a fourth thickness 606. Sandwiched dielectric layer 604 is mounted between top dielectric layer 602 and conducting layer 104 and has a fifth thickness 608. In the illustrative embodiment of FIG. 6, sandwiched dielectric layer 604 is formed of air. Top dielectric layer 602 and first dielectric layer 102 are formed of RO4003C material with a dielectric constant of 3.4 and a loss tangent of 0.0027. Third thickness 118 is equal to fourth thickness 606 plus fifth thickness 608.

Generally, a thickness of conducting layer 104 and of conducting pattern layer 107 is at least several times that of a skin depth of the conductive material at the operating frequency to make sure the incident wave cannot penetrate through first dielectric layer 102 and a high reflection coefficient is achieved. For a good conductor such as copper, the skin depth is less than 2 micrometers (μm) if the frequency is higher than 1 GHz. Therefore, the thickness of conducting layer 104 and of conducting pattern layer 107, for example, provided in printed circuit board fabrication technology (>17 μm), is generally many times larger than the skin depth of copper. As long as this condition is satisfied, the value of the thickness of conducting layer 104 and of conducting pattern layer 107 does not have a significant role in the design of phase shifting element 100 or of second phase shifting element 600.

Second phase shifting element 600 was constructed in two embodiments to correspond with the first position and with the second position of switch 304. For simplicity of construction, each embodiment had a fixed position instead of using switch 304. For example, FIG. 6 shows a first embodiment of second phase shifting element 600 in the second position to form the bit one configuration and to electrically connect second via 302*b* and fourth via 302*d*. Though not shown, a second embodiment of second phase shifting element 600 in the first position to form the bit zero configuration and to electrically connect first via 302*a* and third via 302*c* was also constructed.

Illustrative dimensions for second phase shifting element 600 are P=6 millimeters (mm) for length 120 and width 121, $l_1$=2.7 mm for arm length 208, $w_1$=0.25 mm for arm width 206, $l_2$=2.2 mm for corner arm length 202, $w_2$=0.3 mm for corner arm width 204, s=0.15 mm for first distance 200, $\epsilon_{r,1}$ is a relative permittivity of RO4003C material, $h_1$=1 mm for fourth thickness 606, $E_{r,2}$ is a relative permittivity of air, $h_2$=3 mm for fifth thickness 608 such that third thickness 118 is 4 mm, $\epsilon_{r,m}$ is a relative permittivity of RO4003C material, and $h_m$=1 mm for first thickness 116 of first dielectric layer 102. For illustration, second phase shifting element 600 can be fabricated using printed circuit board technology.

Figure 7:
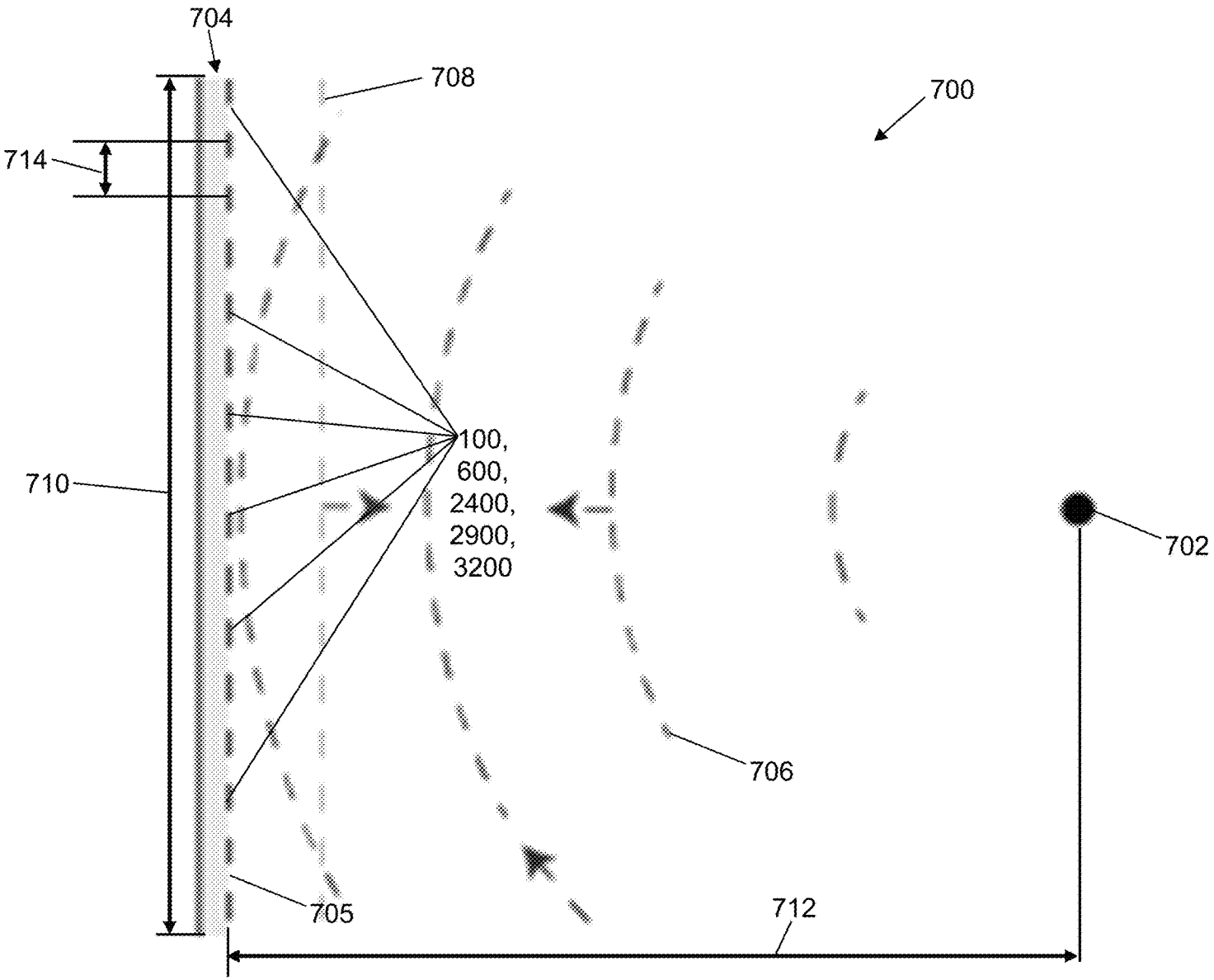
FIG. 7 depicts a side view of a transceiver system that includes any phase shifting element described herein in accordance with illustrative embodiments.
Figure 35:
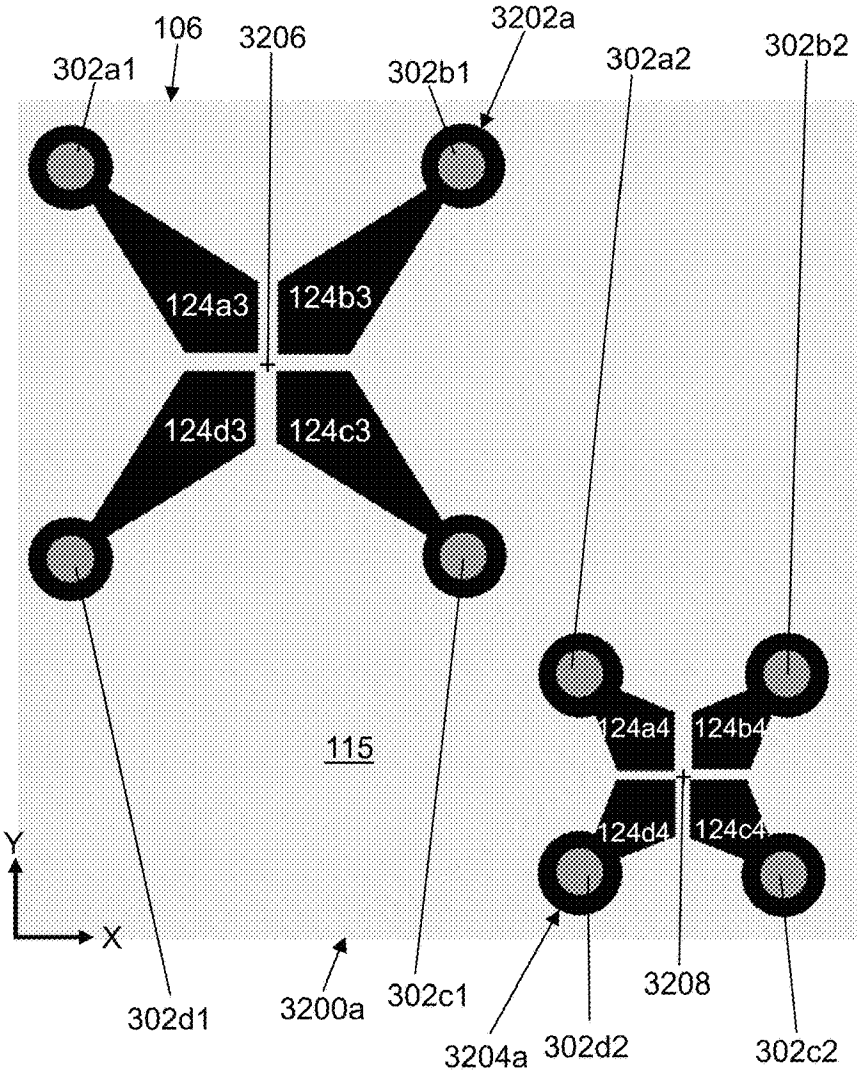
FIG. 35 depicts a top view of a second dual band phase shifting element in accordance with an illustrative embodiment.

Referring to FIG. 7, a one-dimensional (1-D) side view of a transceiver system 700 is shown in accordance with an illustrative embodiment. Transceiver system 700 may include a feed antenna 702 and a plurality of phase shifting elements. Transceiver system 700 may act as a transmitter or a receiver of analog or digital signals. The plurality of phase shifting elements is arranged to form a reflective array antenna 704. Reflective array antenna 704 may be populated with any of phase shifting element 100, second phase shifting element 600, a third phase shifting element 2400 (shown referring to FIG. 24), a fourth phase shifting element 2900 (shown referring to FIG. 29), a dual band phase shifting element 3200 (shown referring to FIG. 32), a second dual band phase shifting element 3200*b* (shown referring to FIG. 35), or a third dual band phase shifting element 3200*b* (shown referring to FIG. 36).

Feed antenna 702 may have a low-gain. Feed antenna 702 may be a dipole antenna, a monopole antenna, a helical antenna, a microstrip antenna, a patch antenna, a fractal antenna, a feed horn, a slot antenna, an end fire antenna, a parabolic antenna, etc. Feed antenna 702 is positioned a focal distance 712, $f_d$, from a front face 705 of the plurality of phase shifting elements. Feed antenna 702 is configured to receive an analog or a digital signal, and in response, to radiate a spherical radio wave 706 toward front face 705 of the plurality of phase shifting elements. For example, front face 705 may include conducting pattern layer 107 of each phase shifting element. Feed antenna 702 also may be configured to receive spherical radio wave 706 from front face 705 of the plurality of phase shifting elements and to generate an analog or a digital signal in response.

The plurality of phase shifting elements may be arranged to form a one-dimensional (1D) or a two-dimensional (2D) array of spatial phase shift elements in any direction. The plurality of phase shifting elements may form variously shaped apertures including circular, rectangular, square, elliptical, etc. The plurality of phase shifting elements can include any number of phase shifting elements.

Figure 8:
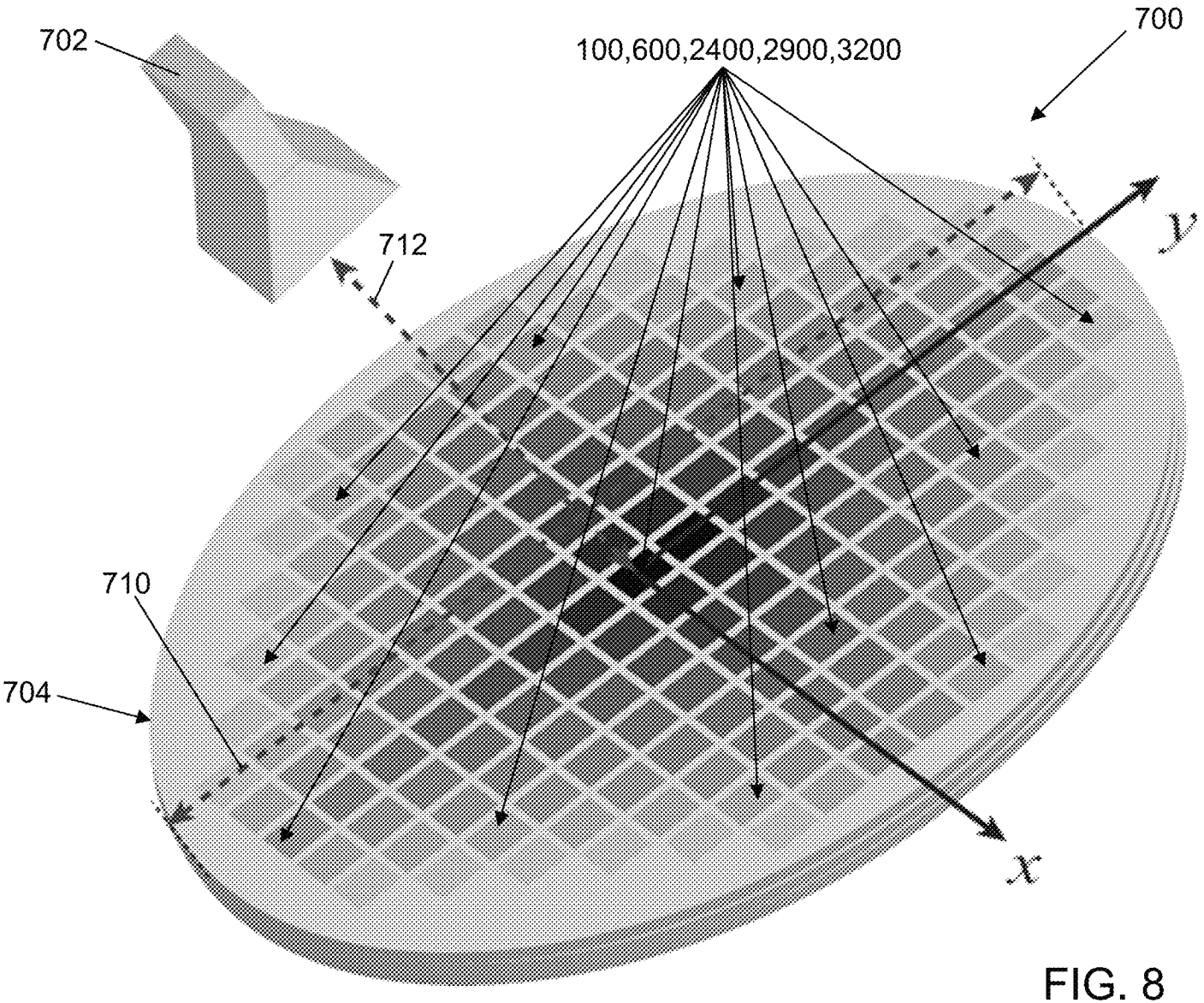
FIG. 8 depicts a perspective view of the transceiver system of FIG. 7 in accordance with an illustrative embodiment.

Referring to FIG. 8, a perspective view of transceiver system 700 is shown with a circular aperture. Feed antenna 702 is illustrated as a feed horn and is positioned at a center of reflective array antenna 704. The plurality of phase shifting elements are arranged to form a circular 2D array of phase shifting elements. The plurality of phase shifting elements has an aperture length 710, D.

Spherical radio wave 706 reaches different portions of front face 705 at different times. The plurality of phase shifting elements can be considered to be a plurality of pixels each of which act as a phase shift unit by providing a selected phase shift within the frequency band of interest. Thus, each phase shifting element of the plurality of phase shifting elements acts as a phase shift circuit selected such that spherical radio wave 706 is re-radiated in the form of a planar wave 708 that is parallel to front face 705, or vice versa. Given aperture length 710 and focal distance 712, the phase shift profile provided for the plurality of phase shifting elements to form planar wave 708 directed to a specific angle can be calculated as understood by a person of skill in the art. Center 134 of each phase shifting element is separated a distance 714 from center 134 of its neighbors in any direction. Distance 714 may be equal to length 120 and width 121.

For example, assuming feed antenna 702 is aligned to emit spherical radio wave 706 at the focal point of the plurality of phase shifting elements, the time it takes for each ray to arrive at front face 705 is determined by a length of each ray trace, i.e., the distance traveled by the electromagnetic wave traveling at the speed of light. A minimum time corresponds to a propagation time of the shortest ray trace, which is the line path from feed antenna 702 to a center of front face 705 for a center positioned feed antenna 702. A maximum time corresponds to a propagation time of the longest ray trace, which is the line path from feed antenna 702 to an edge of front face 705 for the center positioned feed antenna 702. Feed antenna 702 may be positioned at an off-center position with a resulting change in the distribution of ray traces to each phase shifting element.

Figure 9:
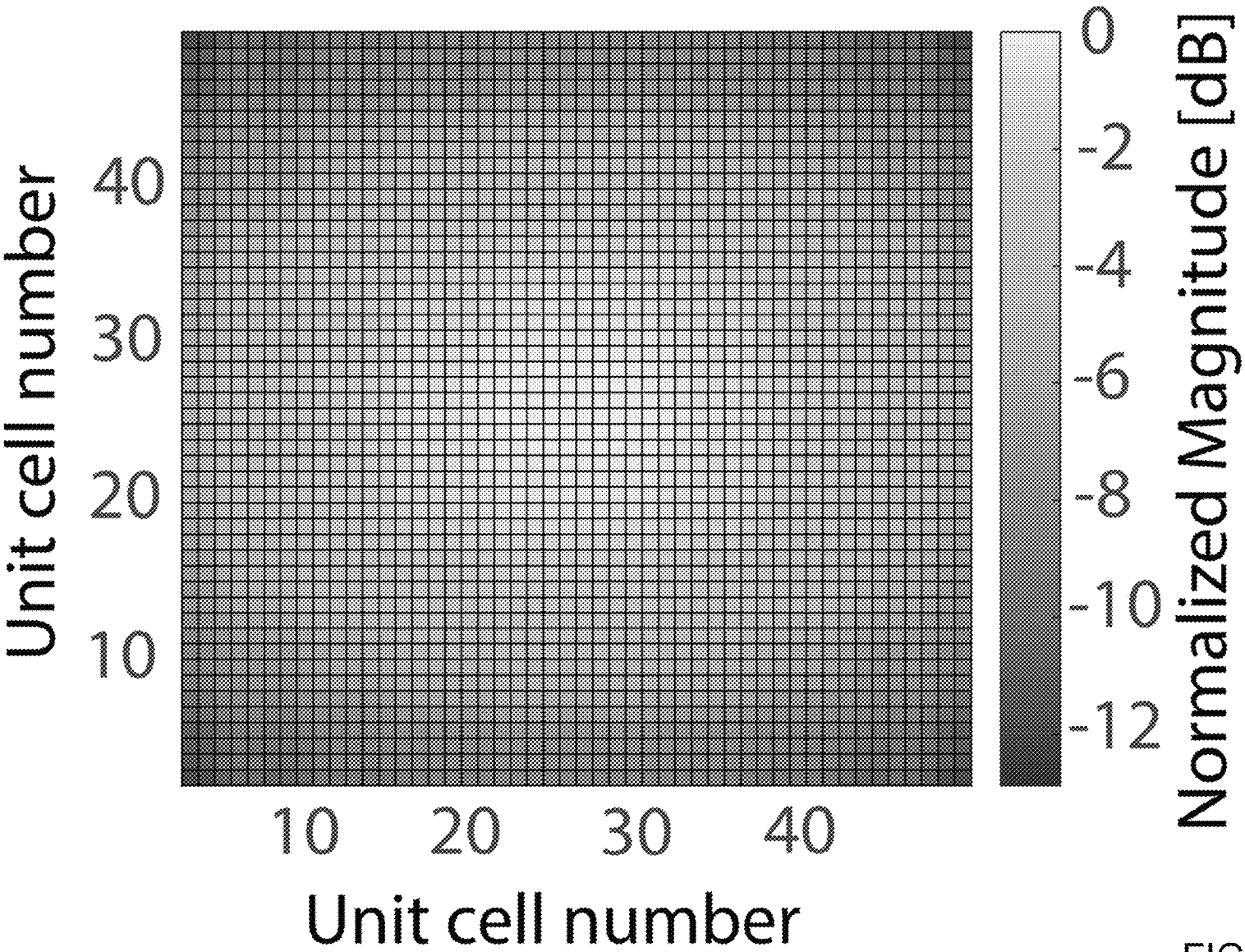
FIG. 9 depicts a projection of a normalized magnitude of the fields generated by a feed antenna of the transceiver system of FIG. 7 on an aperture of a reflective array antenna in accordance with an illustrative embodiment.
Figure 10:
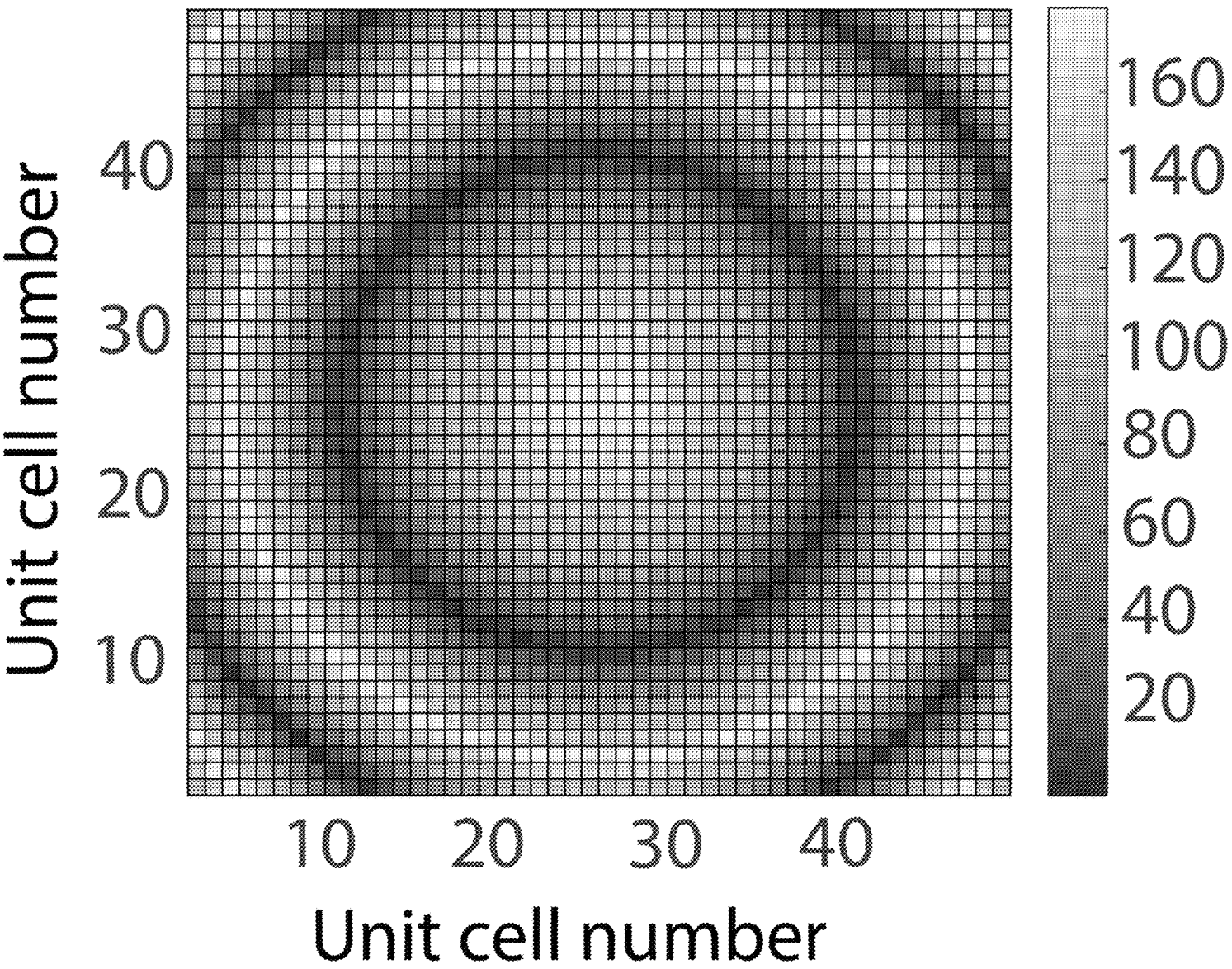
FIG. 10 depicts a projection of an absolute value of a phase of the fields generated by the feed antenna of the transceiver system of FIG. 7 on the aperture of the reflective array antenna in the phase range from −180° to 180° in accordance with an illustrative embodiment.

Of course, because the distance varies between feed antenna 702 and each phase shifting element of reflective array antenna 704, a magnitude of the portion of spherical radio wave 706 received by each phase shifting element also varies. For example, referring to FIG. 9, a normalized magnitude of the fields generated by feed antenna 702 projected on front face 705 of reflective array antenna 704 is shown for a square array composed of 50 phase shifting elements in both the x-axis direction and the y-axis direction. Aperture length 710 and width was approximately 30 cm using second phase shifting element 600. Focal distance 712 was also 30 cm. Referring to FIG. 10, a phase of the fields generated by feed antenna 702 projected on front face 705 of reflective array antenna 704 is shown. To achieve beam collimation and form planar wave 708, each phase shifting element of the plurality of phase shifting elements provides a reverse phase shift profile.

Figure 11:
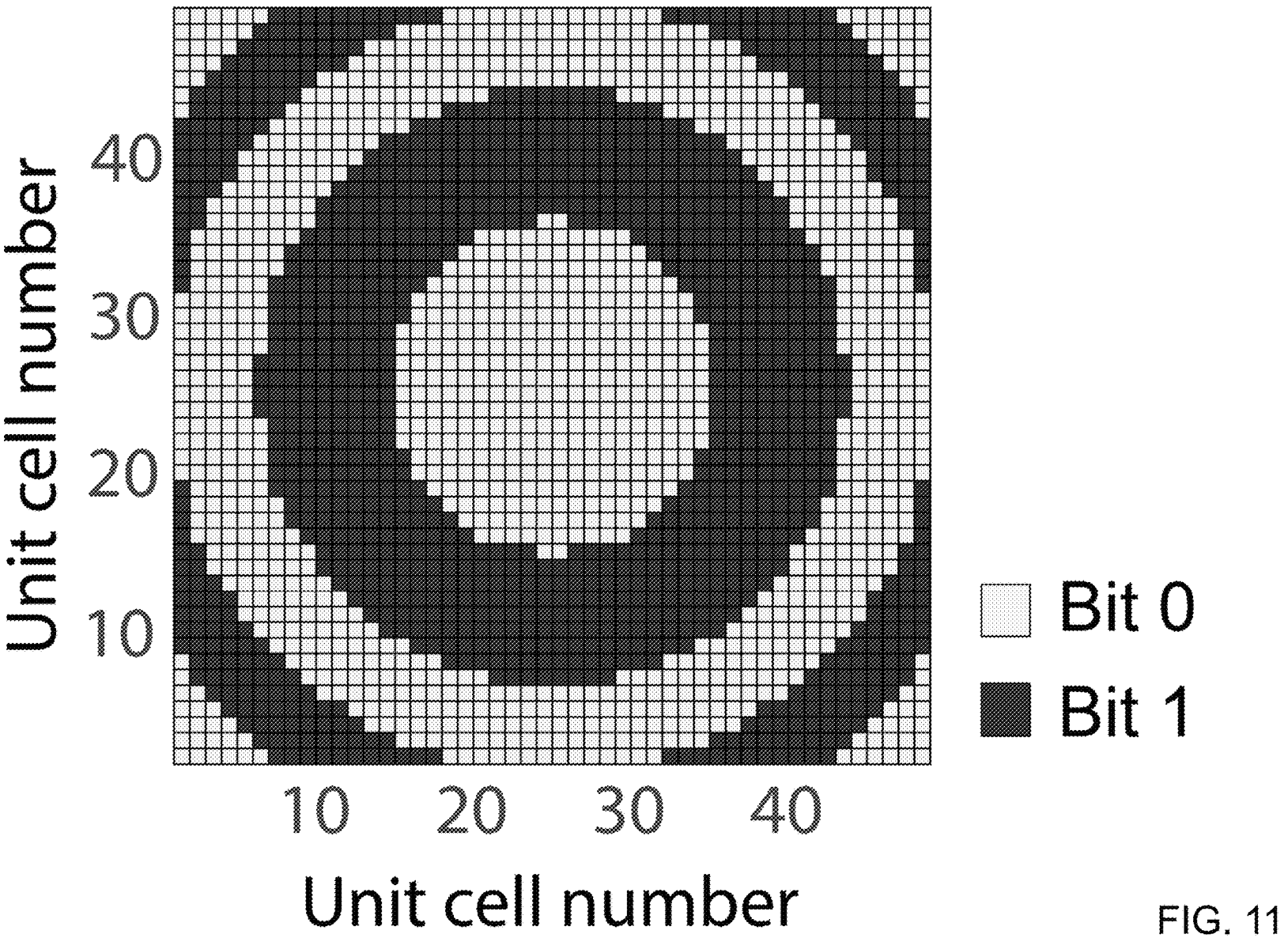
FIG. 11 depicts a pattern of a distribution of the switch position of the phase shifting elements described herein on the aperture of the reflective array antenna in accordance with an illustrative embodiment, where "bit 0" indicates the first switch position, and "bit 1" indicates the second switch position.

Referring to FIG. 11, a pattern of a distribution of the switch position of the phase shifting elements arranged on reflective array antenna 704 is shown in accordance with an illustrative embodiment, where "bit 0" indicates the first switch position that defines the bit zero configuration and "bit 1" indicates the second switch position that defines the bit one configuration. The pattern was determined such that the first switch position was used for each phase shifting element at a location having a phase angle of the incident electric field between −90° and 90°, and the second switch position was used for each phase shifting element at a location having a phase angle of the incident electric field between 90° and 180° or between −180° and −90°.

Figure 12:
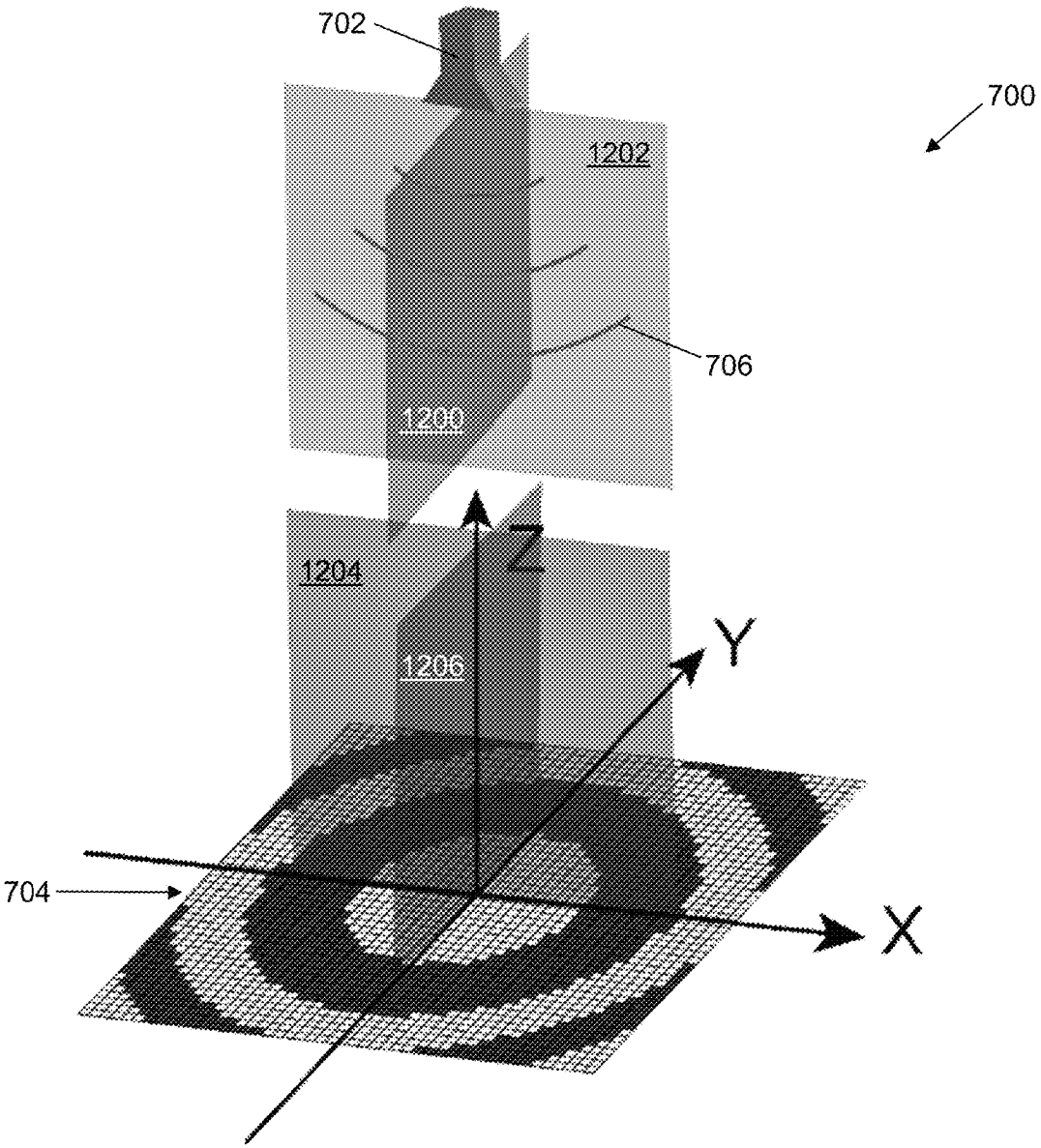
FIG. 12 depicts incident and reflective electric and magnetic field planes generated by the feed antenna and the reflective array antenna of the transceiver system of FIG. 7 in accordance with an illustrative embodiment.

Referring to FIG. 12, an incident electric field plane 1200 and an incident magnetic field plane 1202 generated by feed antenna 702 and a reflected electric field plane 1204 and a reflected magnetic field plane 1206 generated by reflective array antenna 704 are shown in accordance with an illustrative embodiment. The relative change in angle between the incident and the reflective planes is 90°.

Figure 13:
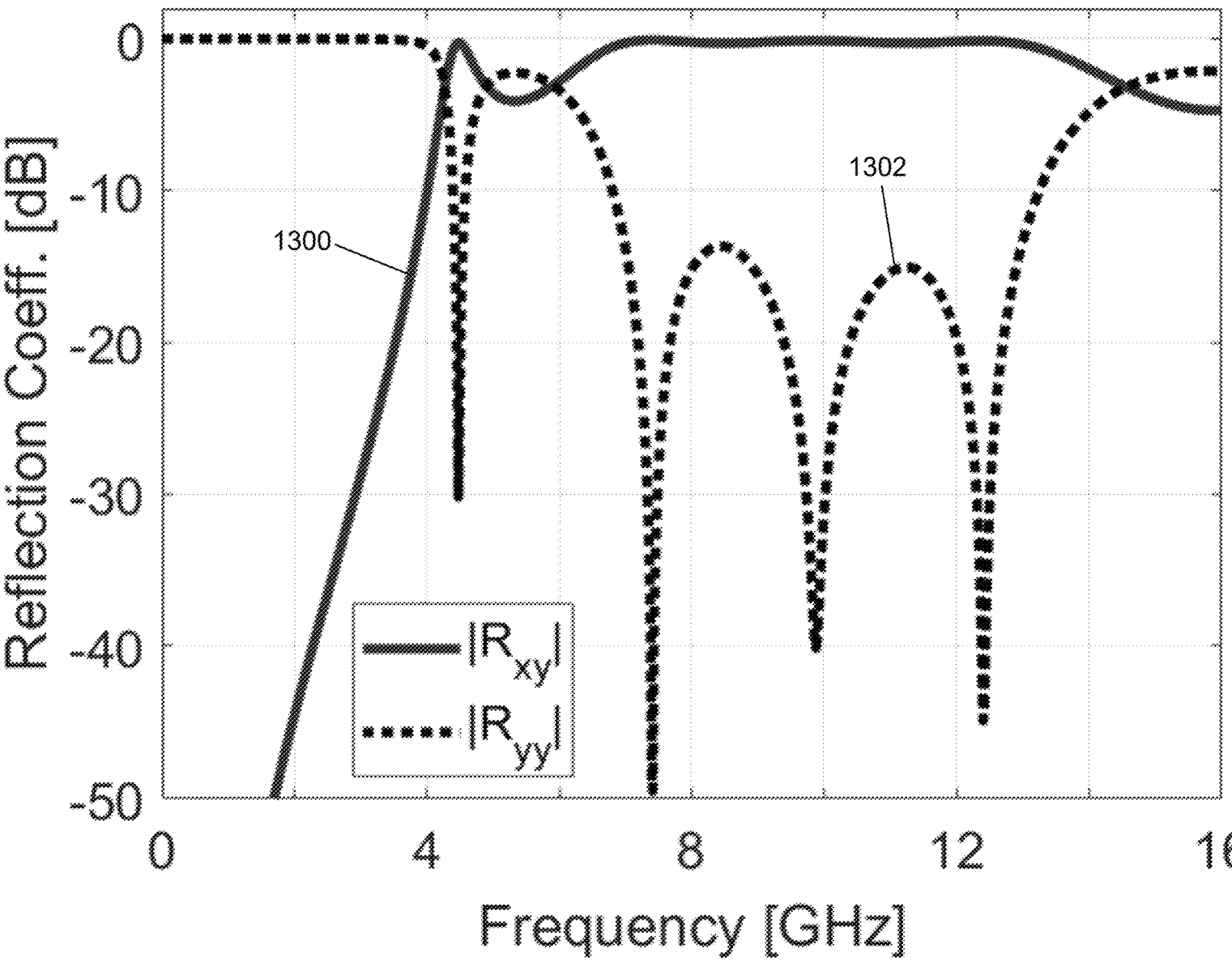
FIG. 13 depicts a X-Y reflection coefficient and a Y-Y reflection coefficient as a function of frequency of the second phase shifting element of FIG. 6 in accordance with an illustrative embodiment.

Referring to FIG. 13, an X-Y reflection coefficient curve 1300 and a Y-Y reflection coefficient curve 1302 show an X-Y reflection coefficient and a Y-Y reflection coefficient, respectively, as a function of frequency that result for second phase shifting element 600 designed using the illustrative dimensions above. Incident electric field plane 1200 was polarized parallel to the y-axis.

Figure 14:
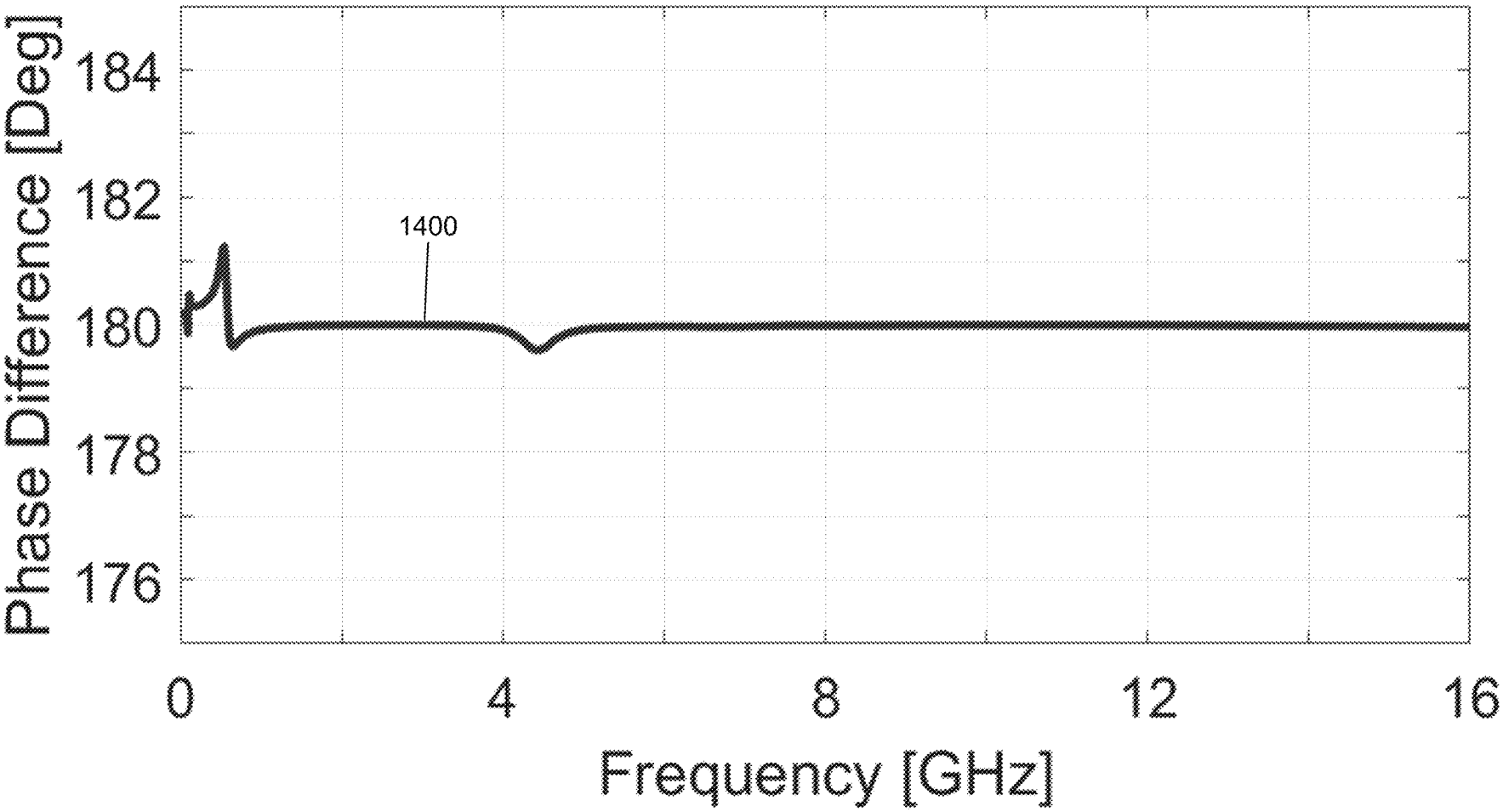
FIG. 14 depicts a phase difference as a function of frequency between the second phase shifting element of FIG. 6 in the first switch position and in the second switch position in accordance with an illustrative embodiment.

Referring to FIG. 14, a phase difference curve 1400 shows a phase difference as a function of frequency between the two embodiments of second phase shifting element 600 in the first switch position and in the second switch position in accordance with an illustrative embodiment. The phase difference is 180° within the intended operating frequency range or band (7-13 GHz) of second phase shifting element 600. The blip in phase difference curve 1400 that occurs at ~4.2 GHz is likely due to a transition between $R_{yy}$-dominant reflection to $R_{xy}$-dominant reflection around this frequency as shown in FIG. 13. This frequency is outside of the intended operating frequency range of second phase shifting element 600 (e.g. 7-13 GHz) so it is not a concern.

Figure 15:
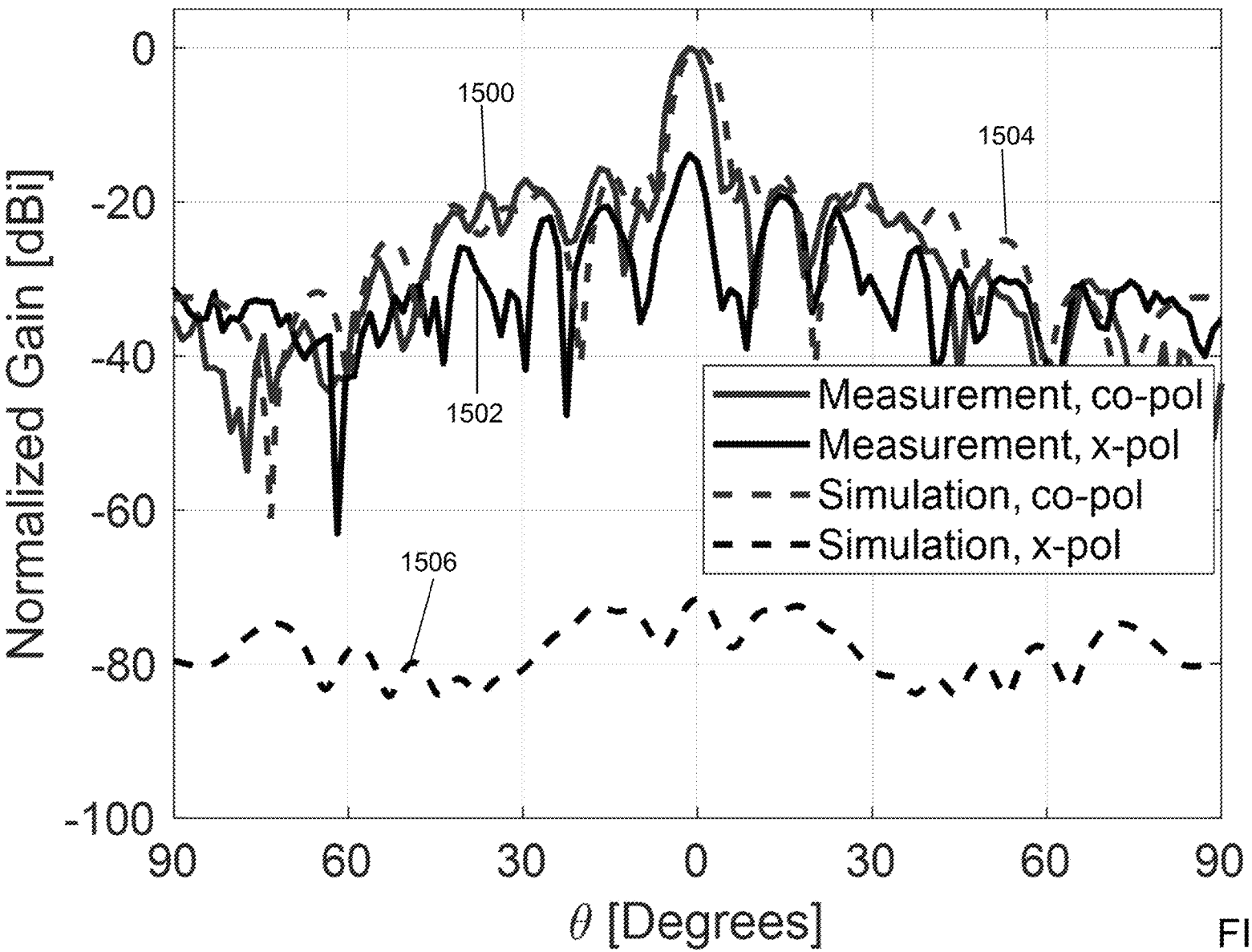
FIG. 15 depicts a measured and a simulated co-polarization and cross-polarization gain as a function of angle generated by the reflective array antenna of the transceiver system of FIG. 7 with the second phase shifting element of FIG. 6 populating the reflective array with the switch positions as shown in FIG. 11 in accordance with an illustrative embodiment.

Referring to FIG. 15, a radiation pattern is shown in accordance with an illustrative embodiment for reflective array antenna 704. Second phase shifting element 600 populated each of the 50 by 50 array of pixel positions on reflective array antenna 704. A first gain curve 1500 shows measured co-polarization levels normalized to their maximum value as a function of angle. A second gain curve 1502 shows measured cross-polarization levels normalized to their maximum value as a function of angle. A third gain curve 1504 shows simulated co-polarization levels normalized to their maximum value as a function of angle. A fourth gain curve 1506 shows simulated cross-polarization as a function of angle. The simulated data was generated using full-wave electromagnetic simulation.

Figure 16:
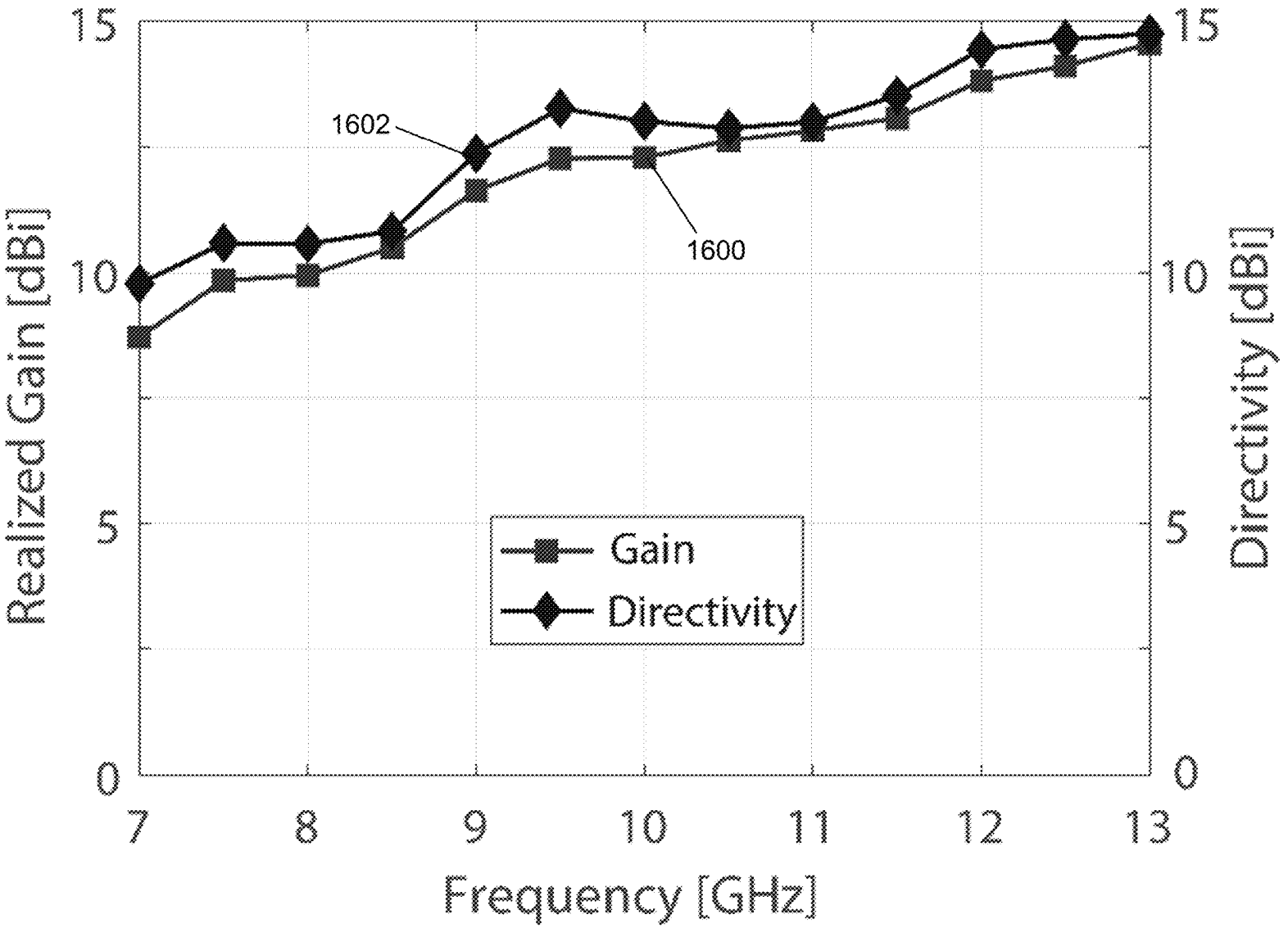
FIG. 16 depicts a measured realized gain and directivity as a function of frequency generated by the feed antenna of the transceiver system of FIG. 7 in accordance with an illustrative embodiment.

Referring to FIG. 16, a measured realized gain curve 1600 and a measured directivity curve 1602 show a gain and a directivity, respectively, as a function of frequency generated by feed antenna 704 in accordance with an illustrative embodiment.

Figure 17:
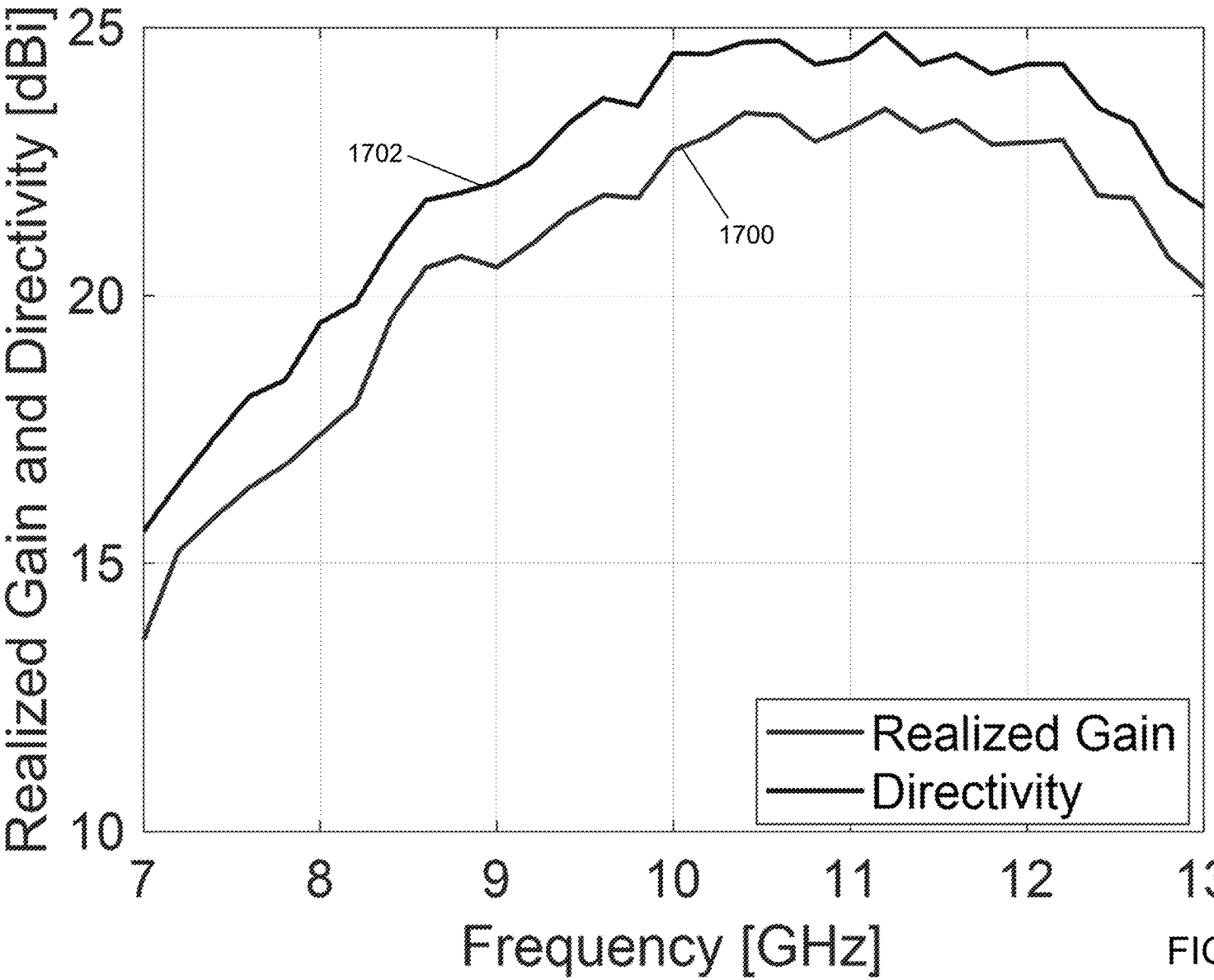
FIG. 17 depicts a measured realized gain and directivity as a function of frequency generated by the reflective array antenna of the transceiver system of FIG. 7 with the second phase shifting element of FIG. 6 populating the reflective array antenna with the switch positions as shown in FIG. 11 in accordance with an illustrative embodiment.

Referring to FIG. 17, a measured realized gain curve 1700 and a measured directivity curve 1702 show a gain and a directivity, respectively, as a function of frequency generated by reflective array antenna 704 with second phase shifting element 600 populating each pixel position. A 3 decibel (dB) bandwidth existed between approximately 9 and 12.9 GHz.

Figure 18:
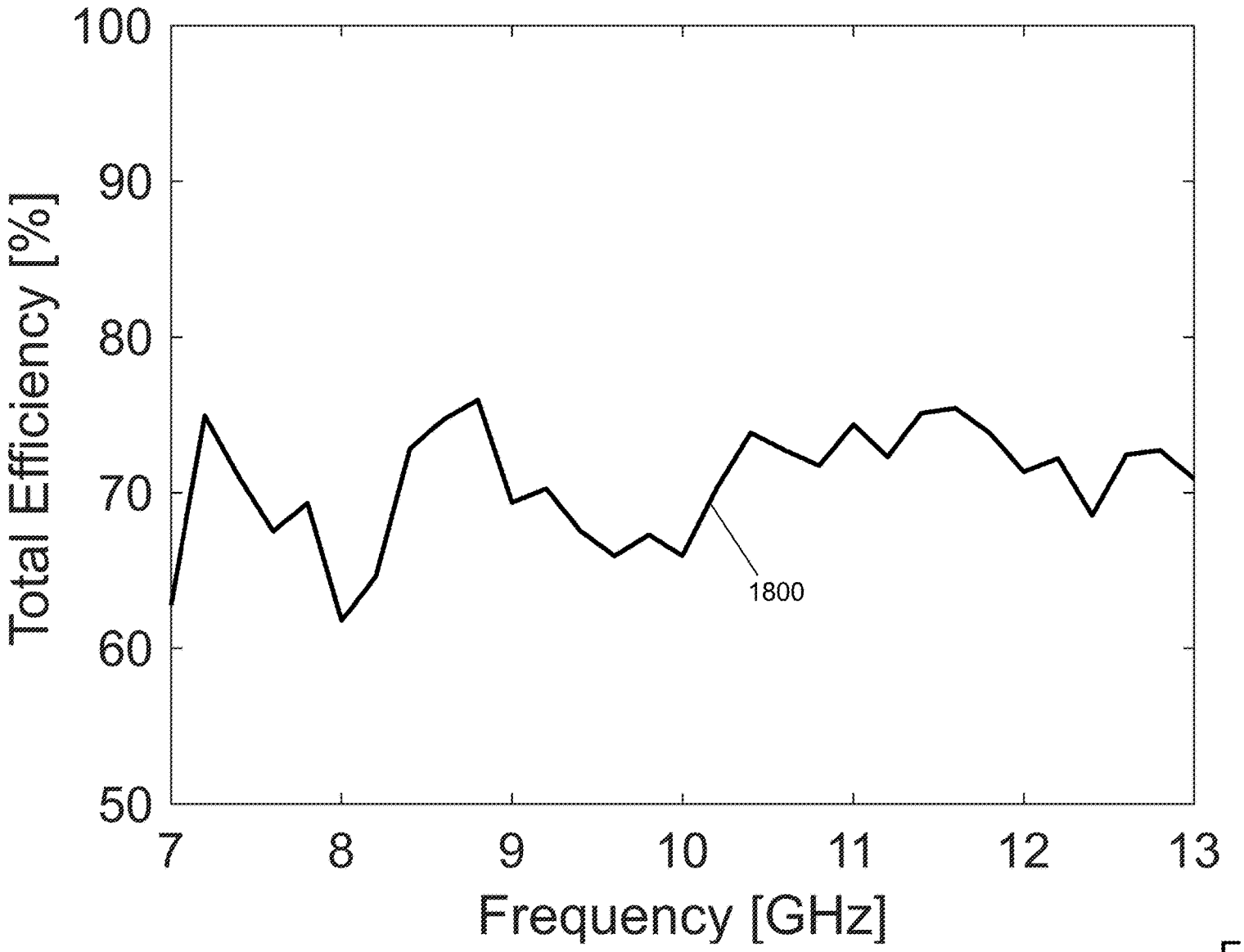
FIG. 18 depicts a measured total efficiency as a function of frequency generated by the reflective array antenna of the transceiver system of FIG. 7 with the second phase shifting element of FIG. 6 populating the reflective array antenna with the switch positions as shown in FIG. 11 in accordance with an illustrative embodiment.

Referring to FIG. 18, a measured total efficiency curve 1800 shows a total efficiency of reflective array antenna 704 with second phase shifting element 600 populating each pixel position as a function of frequency.

Figure 19A:
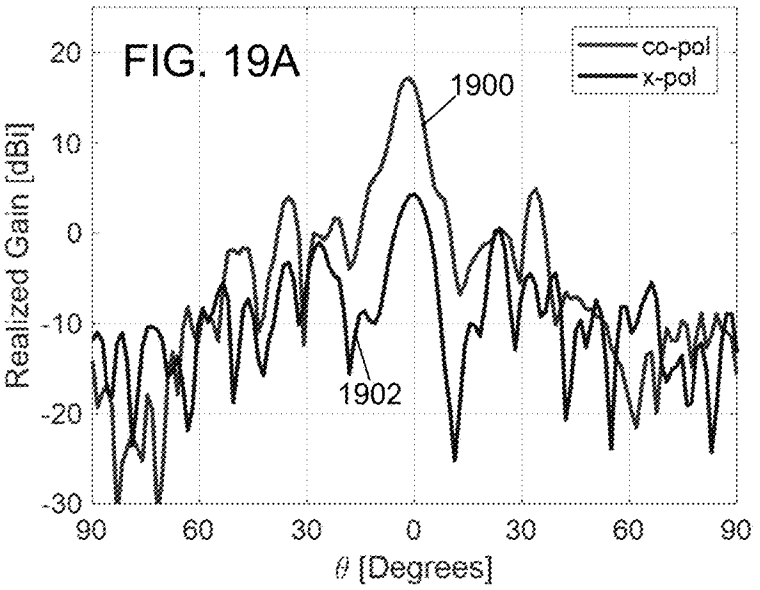
FIG. 19A depicts a measured co-polarization and cross-polarization gain of the reflective array antenna of the transceiver system of FIG. 7 in the E-plane at 8 Gigahertz (GHz) as a function of angle with the second phase shifting element of FIG. 6 populating the reflective array antenna with the switch positions as shown in FIG. 11 in accordance with an illustrative embodiment.
Figure 19B:
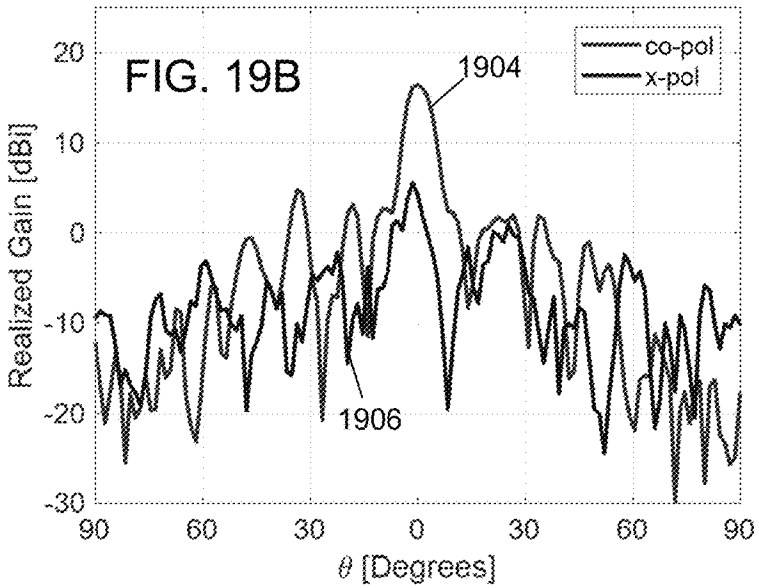
FIG. 19B depicts a measured co-polarization and cross-polarization gain of the reflective array antenna of the transceiver system of FIG. 7 in the H-plane at 8 GHz as a function of angle with the second phase shifting element of FIG. 6 populating the reflective array antenna with the switch positions as shown in FIG. 11 in accordance with an illustrative embodiment.

Referring to FIG. 19A, a measured co-polarization gain curve 1900 and a measured cross-polarization gain curve 1902 are shown as a function of angle in the E-plane at $f_0$=8 GHz using reflective array antenna 704 with second phase shifting element 600 populating each pixel position. Referring to FIG. 19B, a measured co-polarization gain curve 1904 and a measured cross-polarization gain curve 1906 are shown as a function of angle in the H-plane at $f_0$=8 GHz using reflective array antenna 704 with second phase shifting element 600 populating each pixel position.

Figure 20A:
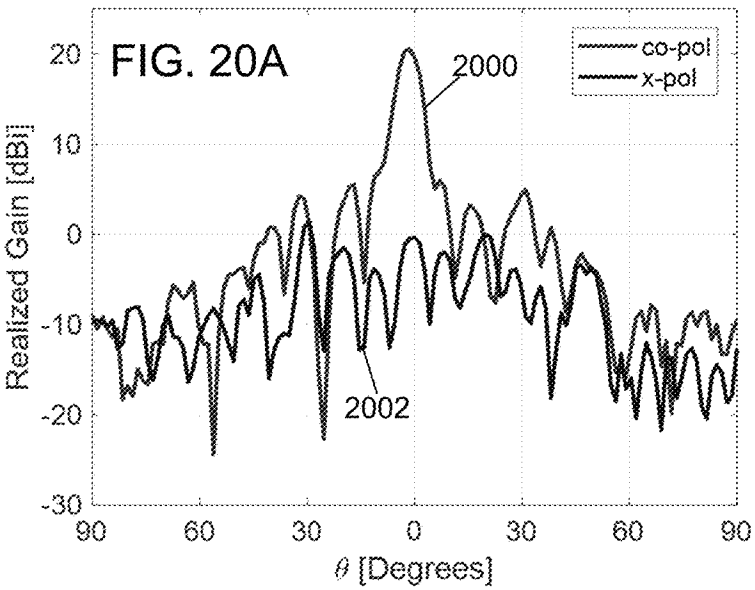
FIG. 20A depicts a measured co-polarization and cross-polarization gain of the reflective array antenna of the transceiver system of FIG. 7 in the E-plane at 9 GHz as a function of angle with the second phase shifting element of FIG. 6 populating the reflective array antenna with the switch positions as shown in FIG. 11 in accordance with an illustrative embodiment.
Figure 20B:
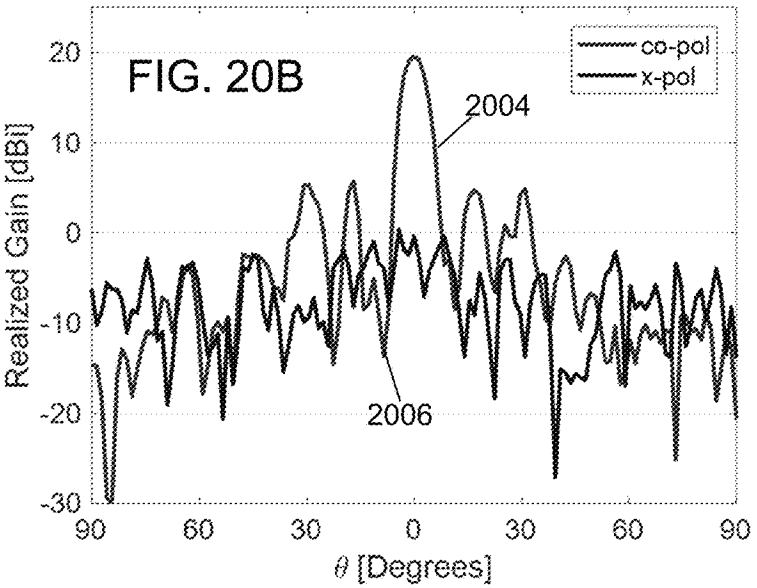
FIG. 20B depicts a measured co-polarization and cross-polarization gain of the reflective array antenna of the transceiver system of FIG. 7 in the H-plane at 9 GHz as a function of angle with the second phase shifting element of FIG. 6 populating the reflective array antenna with the switch positions as shown in FIG. 11 in accordance with an illustrative embodiment.

Referring to FIG. 20A, a measured co-polarization gain curve 2000 and a measured cross-polarization gain curve 2002 are shown as a function of angle in the E-plane at $f_0$=9 GHz using reflective array antenna 704 with second phase shifting element 600 populating each pixel position. Referring to FIG. 20B, a measured co-polarization gain curve 2004 and a measured cross-polarization gain curve 2006 are shown as a function of angle in the H-plane at $f_0$=9 GHz using reflective array antenna 704 with second phase shifting element 600 populating each pixel position.

Figure 21A:
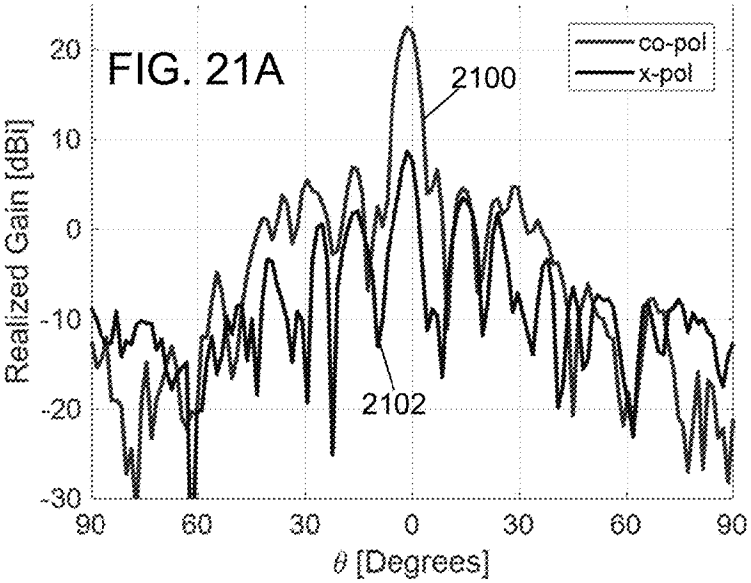
FIG. 21A depicts a measured co-polarization and cross-polarization gain of the reflective array antenna of the transceiver system of FIG. 7 in the E-plane at 10 GHz as a function of angle with the second phase shifting element of FIG. 6 populating the reflective array antenna with the switch positions as shown in FIG. 11 in accordance with an illustrative embodiment.
Figure 21B:
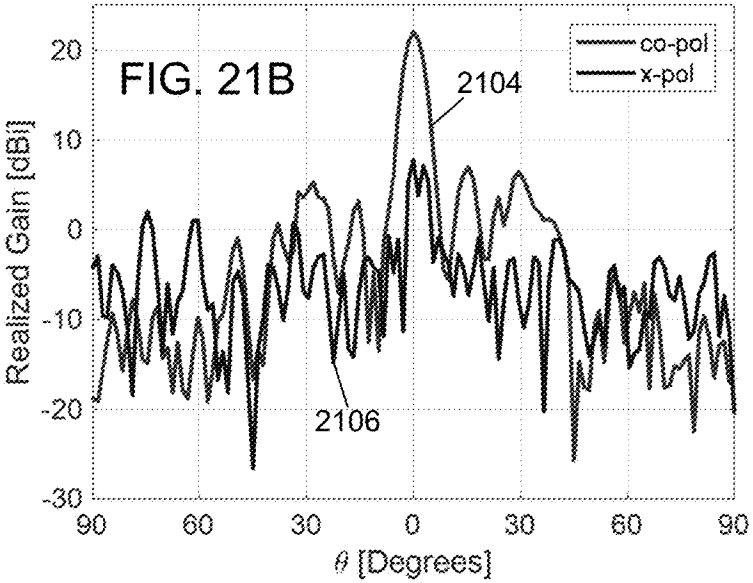
FIG. 21B depicts a measured co-polarization and cross-polarization gain of the reflective array antenna of the transceiver system of FIG. 7 in the H-plane at 10 GHz as a function of angle with the second phase shifting element of FIG. 6 populating the reflective array antenna with the switch positions as shown in FIG. 11 in accordance with an illustrative embodiment.

Referring to FIG. 21A, a measured co-polarization gain curve 2100 and a measured cross-polarization gain curve 2102 are shown as a function of angle in the E-plane at $f_0$=10 GHz using reflective array antenna 704 with second phase shifting element 600 populating each pixel position. Referring to FIG. 21B, a measured co-polarization gain curve 2104 and a measured cross-polarization gain curve 2106 are shown as a function of angle in the H-plane at $f_0$=10 GHz using reflective array antenna 704 with second phase shifting element 600 populating each pixel position.

Figure 22A:
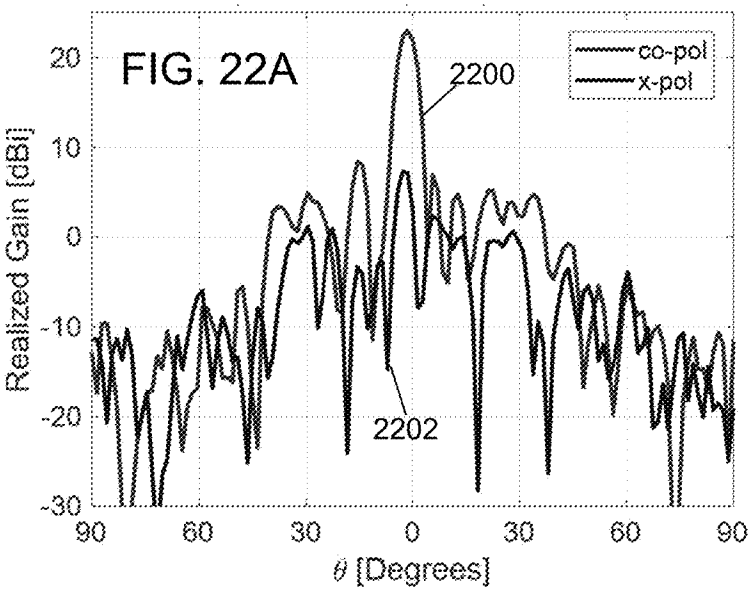
FIG. 22A depicts a measured co-polarization and cross-polarization gain of the reflective array antenna of the transceiver system of FIG. 7 in the E-plane at 11 GHz as a function of angle with the second phase shifting element of FIG. 6 populating the reflective array antenna with the switch positions as shown in FIG. 11 in accordance with an illustrative embodiment.
Figure 22B:
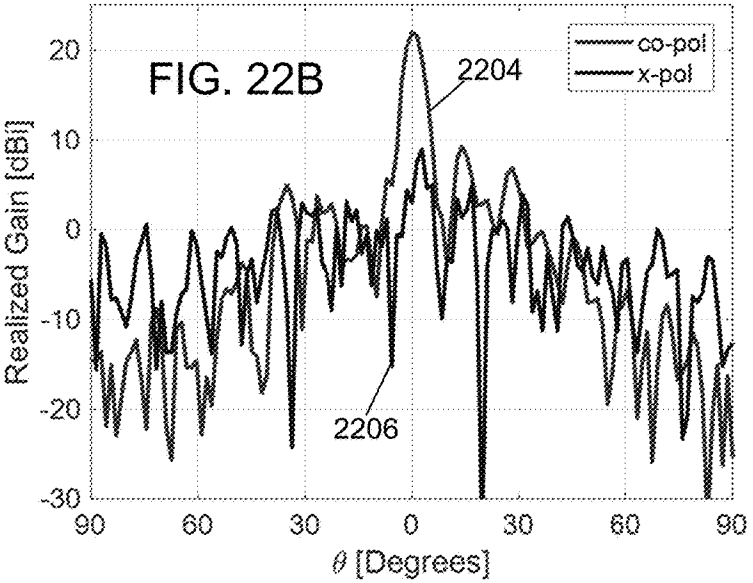
FIG. 22B depicts a measured co-polarization and cross-polarization gain of the reflective array antenna of the transceiver system of FIG. 7 in the H-plane at 11 GHz as a function of angle with the second phase shifting element of FIG. 6 populating the reflective array antenna with the switch positions as shown in FIG. 11 in accordance with an illustrative embodiment.

Referring to FIG. 22A, a measured co-polarization gain curve 2200 and a measured cross-polarization gain curve 2202 are shown as a function of angle in the E-plane at $f_0$=11 GHz using reflective array antenna 704 with second phase shifting element 600 populating each pixel position. Referring to FIG. 22B, a measured co-polarization gain curve 2204 and a measured cross-polarization gain curve 2206 are shown as a function of angle in the H-plane at $f_0$=11 GHz using reflective array antenna 704 with second phase shifting element 600 populating each pixel position.

Figure 23A:
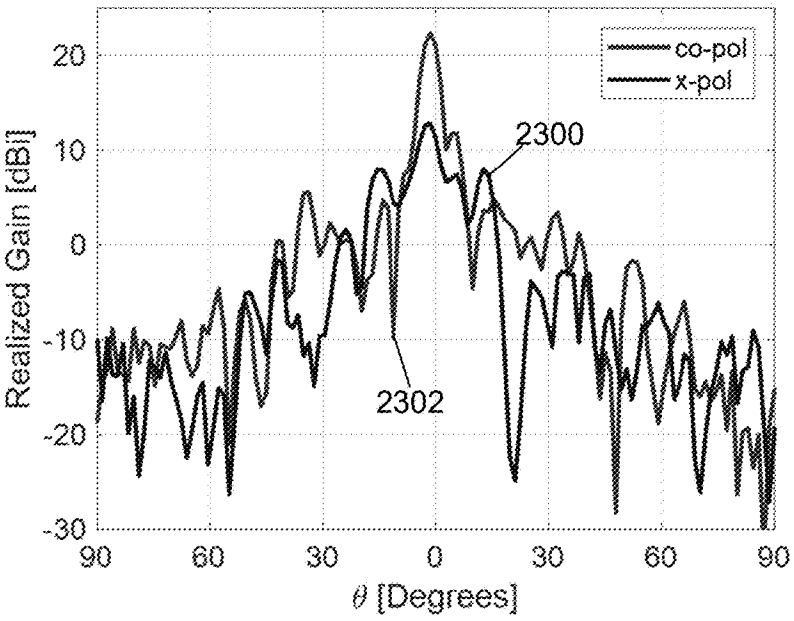
FIG. 23A depicts a measured co-polarization and cross-polarization gain of the reflective array antenna of the transceiver system of FIG. 7 in the E-plane at 12 GHz as a function of angle with the second phase shifting element of FIG. 6 populating the reflective array antenna with the switch positions as shown in FIG. 11 in accordance with an illustrative embodiment.
Figure 23B:
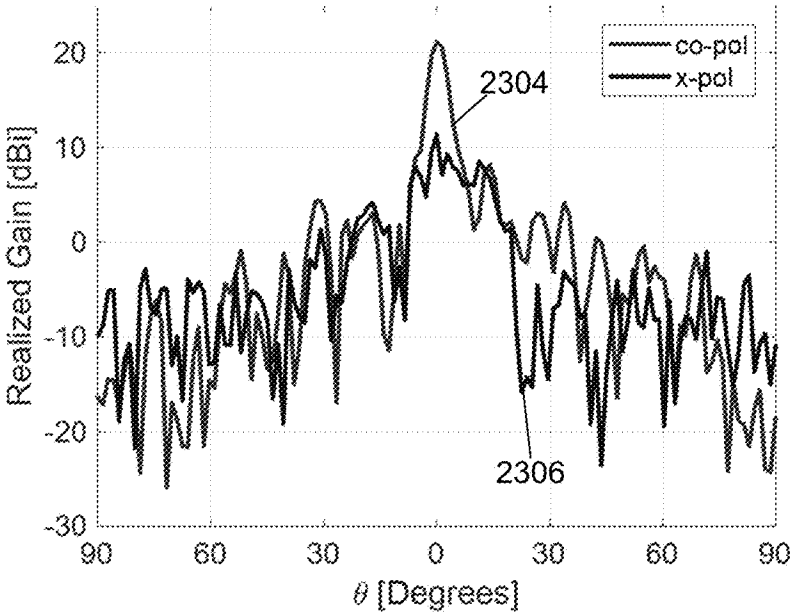
FIG. 23B depicts a measured co-polarization and cross-polarization gain of the reflective array antenna of the transceiver system of FIG. 7 in the H-plane at 12 GHz as a function of angle with the second phase shifting element of FIG. 6 populating the reflective array antenna with the switch positions as shown in FIG. 11 in accordance with an illustrative embodiment.

Referring to FIG. 23A, a measured co-polarization gain curve 2300 and a measured cross-polarization gain curve 2302 are shown as a function of angle in the E-plane at $f_0$=12 GHz using reflective array antenna 704 with second phase shifting element 600 populating each pixel position. Referring to FIG. 23B, a measured co-polarization gain curve 2304 and a measured cross-polarization gain curve 2306 are shown as a function of angle in the H-plane at $f_0$=12 GHz using reflective array antenna 704 with second phase shifting element 600 populating each pixel position.

The measured realized gains vary within 0.8 dB over the frequency range of 10-12 GHz with a maximum value of 23.5 dBi (dB relative to an isotropic radiator) at 11.2 GHz. Reflective array antenna 704 provides low side lobe levels and high polarization purity in this frequency range. Specifically, the measured side lobe levels are 15 dB, 13 dB, and 11.5 dB lower than the main lobe levels at 10 GHz, 11 GHz, and 12 GHz, respectively. The measured cross-polarization levels are 14 dB, 13 dB, and 11 dB below the co-polarization levels at 10, 11, and 12 GHz, respectively. The lowest side lobe level and highest polarization purity within this frequency range were achieved at 10 GHz, at which the pattern of the 1-bit phase shifters is optimized.

Figure 24:
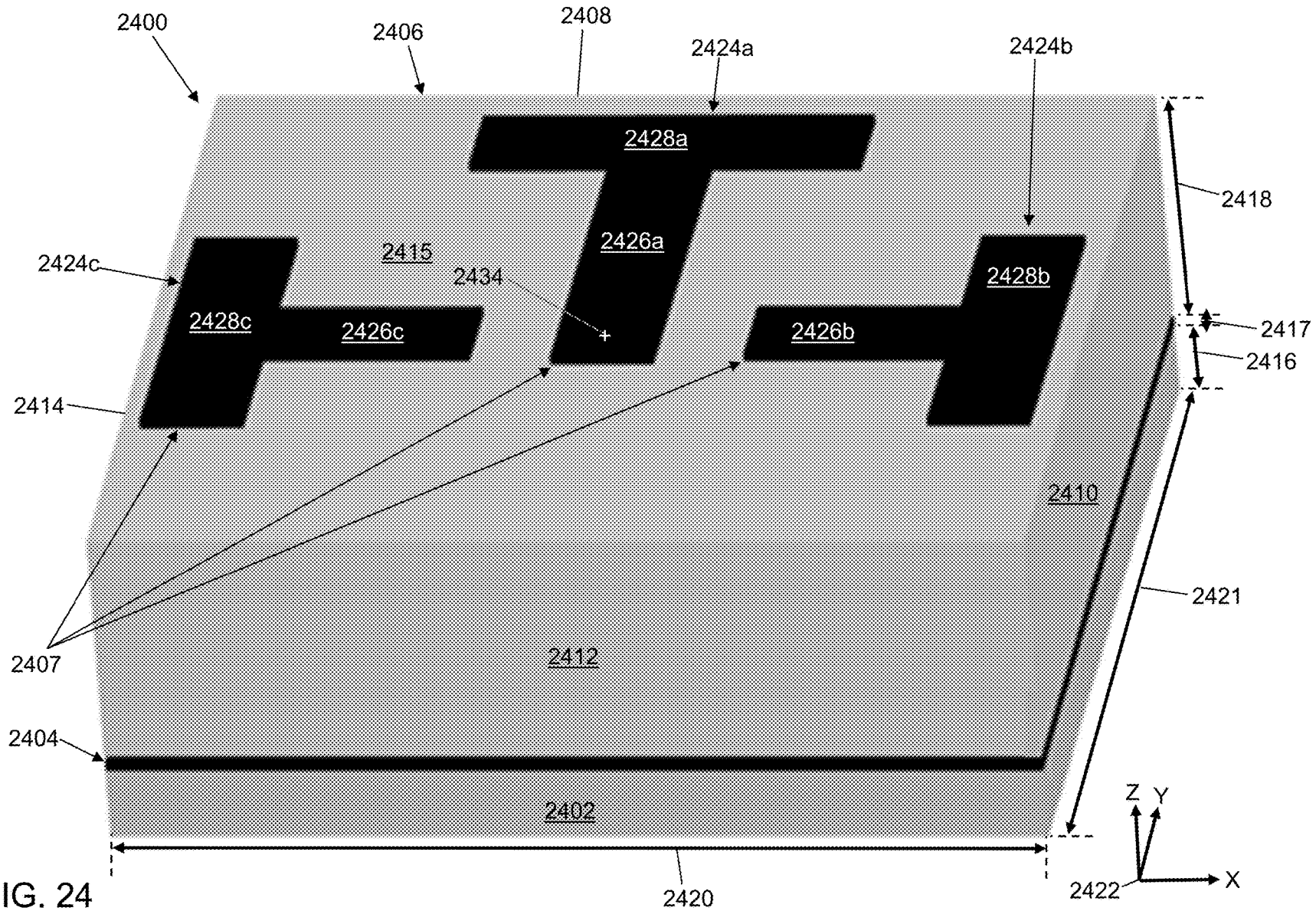
FIG. 24 depicts a perspective side view of a third phase shifting element in accordance with an illustrative embodiment.
Figure 25:
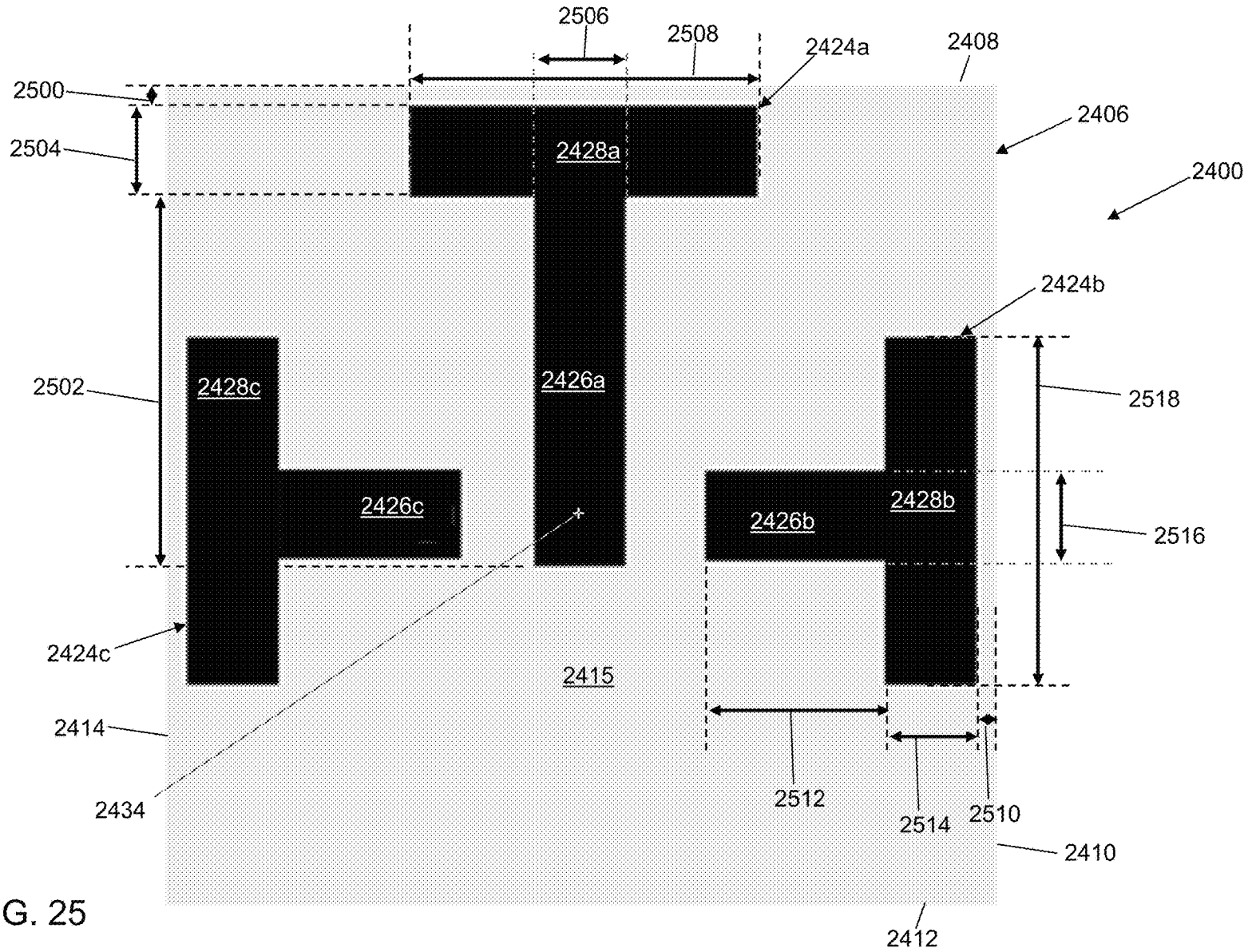
FIG. 25 depicts a top view of the third phase shifting element of FIG. 24 in accordance with an illustrative embodiment.
Figure 26:
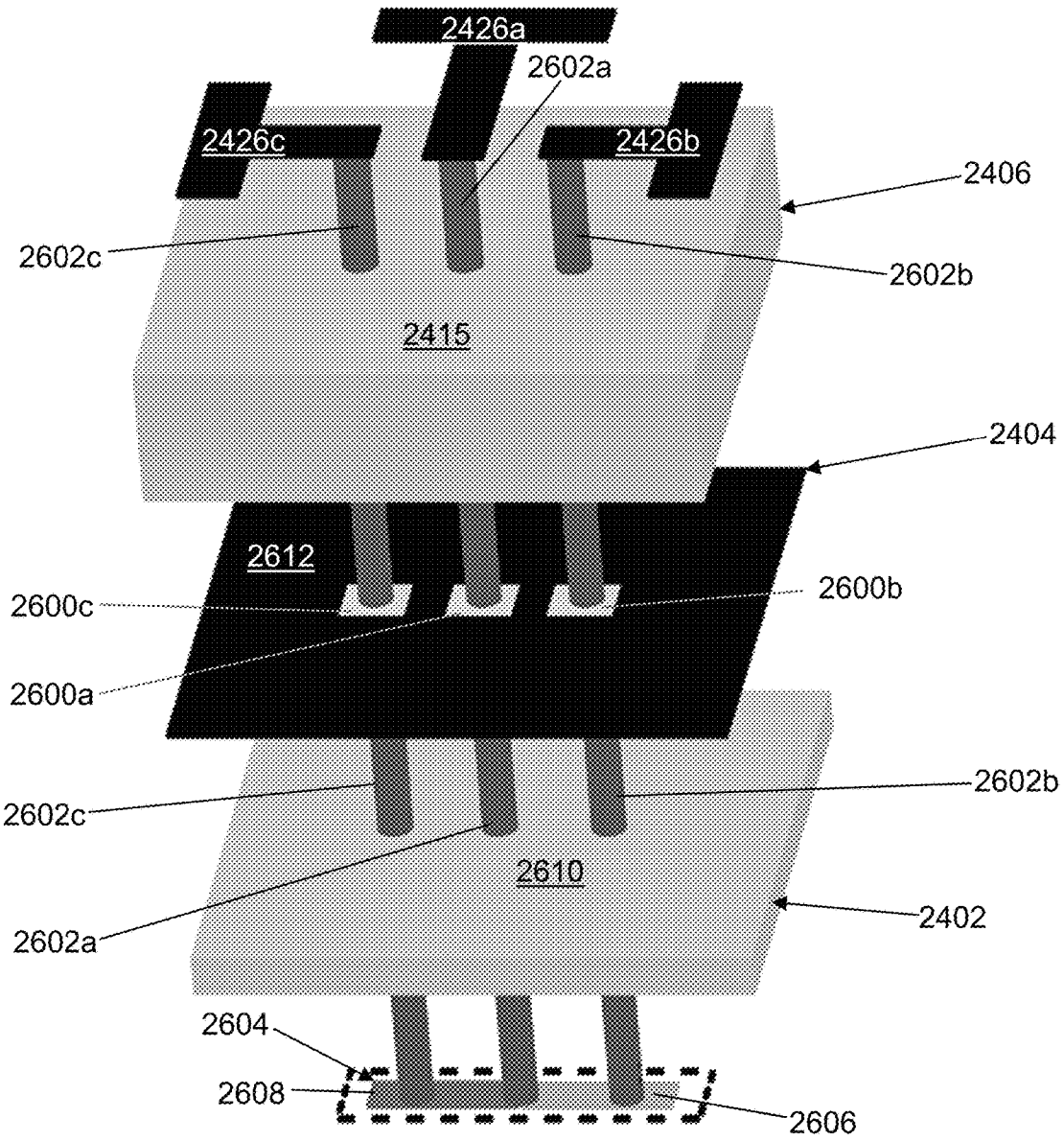
FIG. 26 depicts an exploded, perspective side view of the third phase shifting element of FIG. 24 in accordance with an illustrative embodiment.
Figure 27:
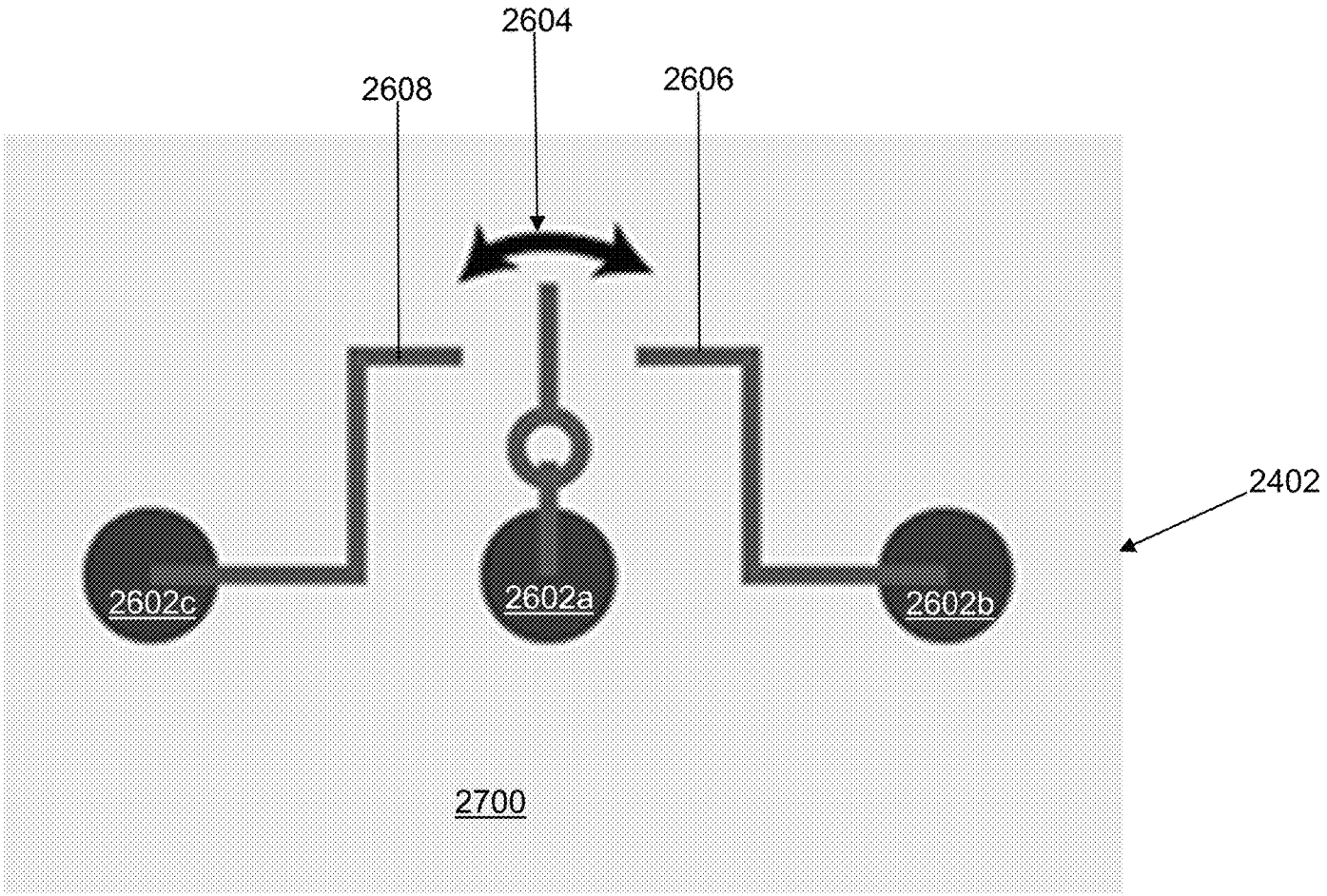
FIG. 27 depicts a bottom view of the third phase shifting element of FIG. 24 in accordance with an illustrative embodiment.
Figure 28A:
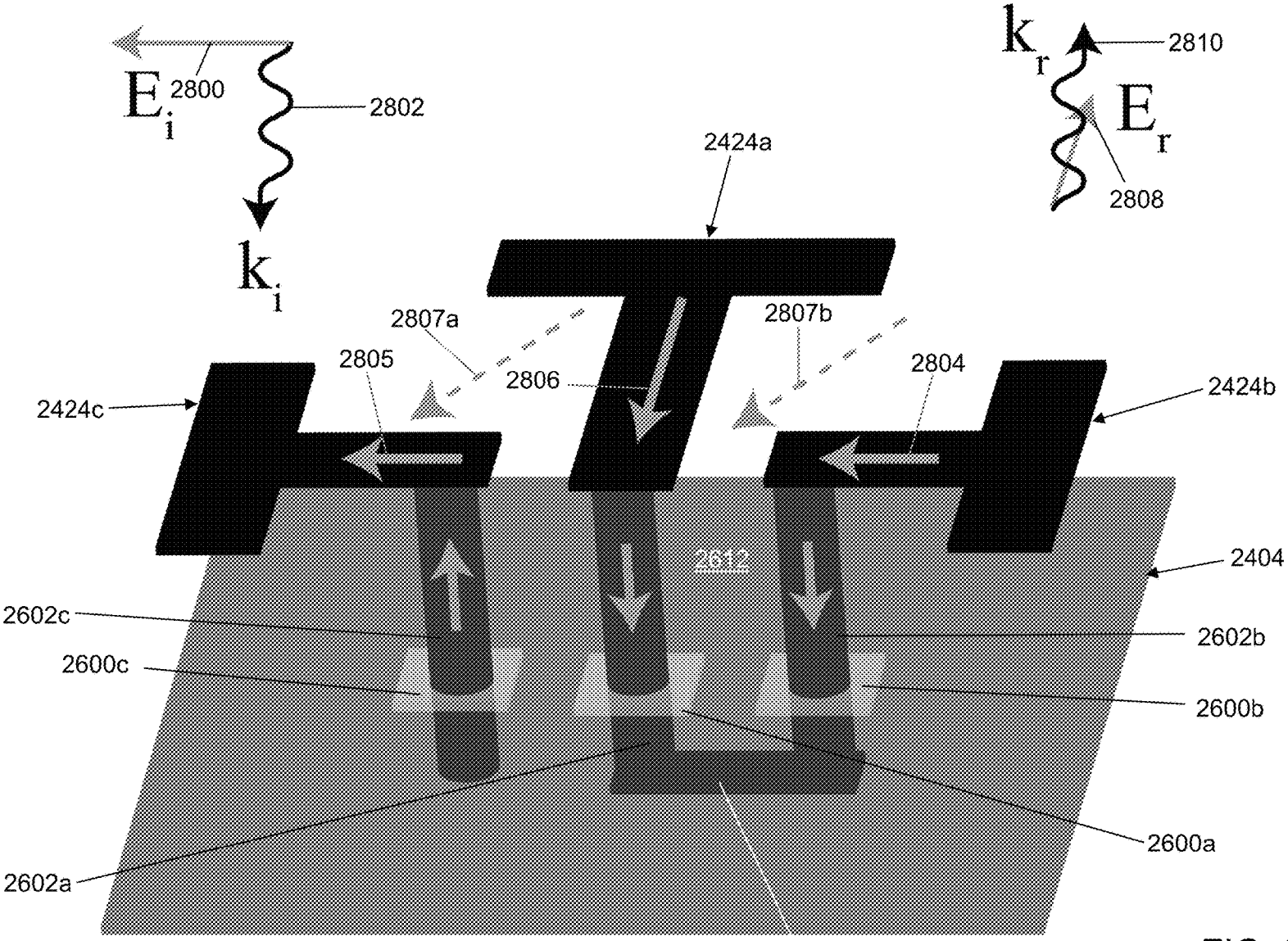
FIG. 28A depicts a transparent perspective side view of the third phase shifting element of FIG. 24 with dielectric material removed and with electric field and current flow directions shown based on a first switch position in accordance with an illustrative embodiment.
Figure 28B:
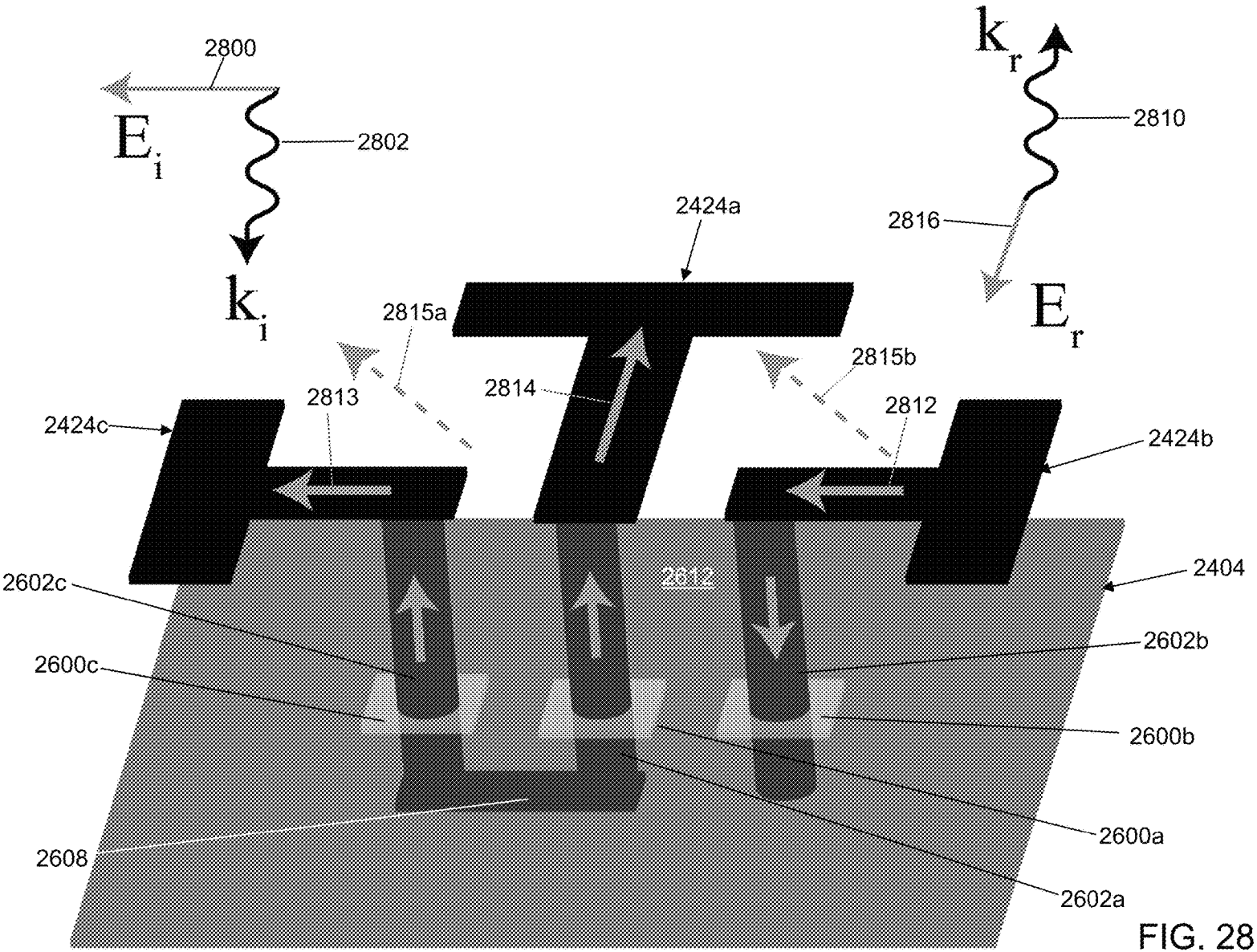
FIG. 28B depicts a second transparent perspective side view of the third phase shifting element of FIG. 24 with the dielectric material removed and with the electric field and current flow directions shown based on a second switch position in accordance with an illustrative embodiment.

Referring to FIG. 24, a perspective side view of third phase shifting element 2400 is shown in accordance with an illustrative embodiment. Referring to FIG. 25, a top view of third phase shifting element 2400 is shown in accordance with an illustrative embodiment. Referring to FIG. 26, an exploded, perspective side view of third phase shifting element 2400 is shown in accordance with an illustrative embodiment. Referring to FIG. 27, a bottom view of third phase shifting element 2400 is shown in accordance with an illustrative embodiment. Referring to FIG. 28A, a transparent perspective side view of third phase shifting element 2400 is shown with dielectric material removed and with electric field and current flow directions shown based on a first switch position in accordance with an illustrative embodiment. Referring to FIG. 28B, a second transparent perspective side view of third phase shifting element 2400 is shown with the dielectric material removed and with the electric field and current flow directions shown based on a second switch position in accordance with an illustrative embodiment.

Third phase shifting element 2400 may include a first dielectric layer 2402, a conducting layer 2404, a second dielectric layer 2406, and a conducting pattern layer 2407. Third phase shifting element 2400 provides a polarization rotating surface that can be used as a spatial phase shifter of a single-layer, wideband reflective array antenna. Third phase shifting element 2400 rotates a polarization of a reflected wave by 90° compared to that of an incident wave. Third phase shifting element 2400 can be switched between a first configuration and a second configuration that is a geometric mirror image of the first configuration. The two configurations provide reflected fields having a phase difference of 180° between them. Because phase shifting using third phase shifting element 2400 is achieved through geometric means, third phase shifting element 2400 can provide either 0° or 180° phase shift, acting as one-bit phase shifters, over extremely broad bandwidths.

First dielectric layer 2402 of third phase shifting element 2400 is similar to first dielectric layer 102 of phase shifting element 100. Second dielectric layer 2406 of third phase shifting element 2400 is similar to second dielectric layer 106 of phase shifting element 100. Conducting layer 2404 of third phase shifting element 2400 is similar to conducting layer 104 of phase shifting element 100.

Conducting layer 2404 is mounted between first dielectric layer 2402 and second dielectric layer 2406 such that a top surface 2610 of first dielectric layer 2402 is mounted to a bottom surface of conducting layer 2404, and second dielectric layer 2406 is mounted to a top surface 2612 of conducting layer 2404. Each of first dielectric layer 2402, conducting layer 2404, and second dielectric layer 2406 has a generally square top and bottom surface shape in an x-y plane and a thickness in a vertical direction denoted by a z-axis, where an x-axis is perpendicular to a y-axis, and both the x-axis and the y-axis are perpendicular to the z-axis to form a right-handed coordinate reference frame denoted x-y-z frame 2422. First dielectric layer 2402, conducting layer 2404, and second dielectric layer 2406 have a length 2420 parallel to the x-axis, and a width 2421 parallel to the y-axis. In the illustrative embodiment, length 2420 is equal to width 2421.

Second dielectric layer 2406 has a back wall 2408, a right-side wall 2410, a front wall 2412, a left-side wall 2414, a top surface 2415, and a bottom surface (not shown). The bottom surface of second dielectric layer 2406 is mounted to top surface 2612 of conducting layer 2404.

The top and bottom surfaces of each of first dielectric layer 2402, conducting layer 2404, and second dielectric layer 2406 are generally flat. First dielectric layer 2402 has a first thickness 2416 parallel to the z-axis. Conducting layer 2404 has a second thickness 2417 parallel to the z-axis. Second dielectric layer 2406 has a third thickness 2418 parallel to the z-axis.

Conducting pattern layer 2407 is formed on top surface 2415 of second dielectric layer 2406 opposite conducting layer 2404. Conducting pattern layer 2407 includes a first T-shaped conductor 2424*a*, a second T-shaped conductor 2424*b*, and a third T-shaped conductor 2424*c*. First T-shaped conductor 2424*a*, second T-shaped conductor 2424*b*, and third T-shaped conductor 2424*c* form a mirror image relative to a y-z center plane through a center 2434 of top surface 2415 of second dielectric layer 2406. The y-z center plane is parallel to the y-z plane defined by x-y-z frame 2422.

First T-shaped conductor 2424*a* is positioned in an upper center of top surface 2415 of second dielectric layer 2406. First T-shaped conductor 2424*a* includes a first switch connector arm 2426*a* and a top T-arm 2428*a*. First switch connector arm 2426*a* and top T-arm 2428*a* are perpendicular to each other. First switch connector arm 2426*a* and top T-arm 2428*a* are used to describe a shape of first T-shaped conductor 2424*a* and typically are not distinct elements, but form a single conductive structure. First switch connector arm 2426*a* connects first T-shaped conductor 2424*a* to a first via 2602*a*. Top T-arm 2428*a* is centered between right-side wall 2410 and left-side wall 2414 and extends parallel to the x-axis. Top T-arm 2428*a* is a first distance 2500 from top wall 2408. First switch connector arm 2426*a* has an arm length 2502 and an arm width 2506. Top T-arm 2428*a* has an arm length 2508 and an arm width 2504.

First via 2602*a* forms an electrical connection between a first throw arm 2606 of switch 2604 through first dielectric layer 2402, conducting layer 2404, and second dielectric layer 2406 to form an electronic circuit. First via 2602*a* optionally may also form an electrical connection between second throw arm 2608 of switch 2604 through first dielectric layer 2402, conducting layer 2404, and second dielectric layer 2406 to form a second electronic circuit. First via 2602*a* is formed of a conductive material. A first dielectric patch 2600*a* is formed through conducting layer 2404 of a dielectric material. First via 2602*a* extends generally parallel to the z-axis through first dielectric patch 2600*a*.

Second T-shaped conductor 2424*b* is positioned in a right center of top surface 2415 of second dielectric layer 2406. Second T-shaped conductor 2424*b* includes a second switch connector arm 2426*b* and a right T-arm 2428*b*. Second switch connector arm 2426*b* and right T-arm 2428*b* are perpendicular to each other. Second switch connector arm 2426*b* and right T-arm 2428*b* are used to describe a shape of second T-shaped conductor 2424*b* and typically are not distinct elements, but form a single conductive structure. Second switch connector arm 2426*b* connects second T-shaped conductor 2424*b* to a second via 2602*b*. Right T-arm 2428*b* is centered between top wall 2408 and bottom wall 2412 and extends parallel to the y-axis. Right T-arm 2428*b* is a first distance 2510 from right-side wall 2410. Second switch connector arm 2426*b* has an arm length 2512 and an arm width 2516. Right T-arm 2428*b* has an arm length 2518 and an arm width 2514.

Second via 2602*b* forms an electrical connection between first throw arm 2606 of switch 2604 through first dielectric layer 2402, conducting layer 2404, and second dielectric layer 2406 to form an electronic circuit. Second via 2602*b* is formed of a conductive material. A second dielectric patch 2600*b* is formed through conducting layer 2404 of a dielectric material. Second via 2602*b* extends generally parallel to the z-axis through second dielectric patch 2600*b*.

Third T-shaped conductor 2424*c* is positioned in a left center of top surface 2415 of second dielectric layer 2406. Third T-shaped conductor 2424*c* includes a third switch connector arm 2426*c* and a left T-arm 2428*c*. Third switch connector arm 2426*c* and left T-arm 2428*c* are perpendicular to each other. Third switch connector arm 2426*c* and left T-arm 2428*c* are used to describe a shape of third T-shaped conductor 2424*c* and typically are not distinct elements, but form a single conductive structure. Third switch connector arm 2426*c* connects third T-shaped conductor 2424*cb* to a third via 2602*c*. Left T-arm 2428*c* is centered between top wall 2408 and bottom wall 2412 and extends parallel to the y-axis. Left T-arm 2428*c* is first distance 2510 from left-side wall 2414. Third switch connector arm 2426*c* has arm length 2512 and arm width 2516. Left T-arm 2428*c* has arm length 2518 and arm width 2514.

Third via 2602*c* forms an electrical connection between second throw arm 2608 of switch 2604 through first dielectric layer 2402, conducting layer 2404, and second dielectric layer 2406 to form an electronic circuit. Third via 2602*c* is formed of a conductive material. A third dielectric patch 2600*c* is formed through conducting layer 2404 of a dielectric material. Third via 2602*c* extends generally parallel to the z-axis through third dielectric patch 2600*c*.

Switch 2604 is a single pole, double throw (SPDT) switch. In a first position, first throw arm 2606 of switch 2604 is closed to electrically connect first via 2602*a* and second via 2602*b*. In a second position, second throw arm 2608 of switch 2604 is closed to electrically connect first via 2602*a* and third via 2602*c*. Switch 2604 is mounted to bottom surface 2700 of first dielectric layer 2402. When switch 2604 is in the first position, third phase shifting element 2400 may be designated as in a bit zero configuration. When switch 2604 is in the second position, third phase shifting element 2400 may be designated as in a bit one configuration. Switch 2604 may be a mechanical switch, a MEMS switch, a commercially available SPDT switch, a plurality of PIN diodes, etc.

In the first position, first throw arm 2606 of switch 2604 is closed to electrically connect first via 2602*a* and second via 2602*b* thereby electrically connecting first T-shaped conductor 2424*a* to second T-shaped conductor 2424*b*. Referring to FIG. 28A, for an incident wave with an incident electric field $E_i$ 2800 in the −x direction parallel to the x-axis, a periodic structure consisting of third phase shifting elements 2400 in the bit zero configuration rotates the polarization of the reflected wave by 90° resulting in a reflected wave with a reflected electric field $E_r$ 2808 in the +y direction parallel to the y-axis.

In the second position, second throw arm 2608 of switch 2604 is closed to electrically connect first via 2602*a* and third via 2602*c* thereby electrically connecting first T-shaped conductor 2424*a* to third T-shaped conductor 2424*c*. Referring to FIG. 28B, for the incident wave with incident electric field $E_i$ 2800 in the −x direction parallel to the x-axis, a periodic structure consisting of third phase shifting elements 2400 in the bit one configuration rotates the polarization of the reflected wave by −90° resulting in a reflected wave with a reflected electric field $E_r$ 2816 in the −y direction parallel to the y-axis. As a result, depending on whether third phase shifting elements 2400 is in the bit zero configuration or in the bit one configuration based on the position of switch

2604, third phase shifting elements 2400 rotates the polarization of the reflected electric field by +90° or by −90° compared to that of the incident electric field.

Referring to FIG. 28A, when illuminated with the incident waves polarized along the −x direction, a first electric current 2804 and a second electric current 2805 are induced on second switch connector arm 2426*b* and on third switch connector arm 2426*c*. First T-shaped conductor 2424*a*, first via 2602*a*, first throw arm 2606 of switch 2604, second via 2602*b*, and second T-shaped conductor 2424*b*, form an extended electrical pathway that has an electrical length of approximately a wavelength. This results in a current minimum around the switch as well as the currents flowing in the same direction on first via 2602*a* and on second via 2602*b*. This dictates the direction of a third electric current 2806 on first switch connector arm 2426*a*. As a result, third phase shifting element 2400 produces a first effective current 2807*a* and a second effective current 2807*b* that make an angle of 225° relative to the x-axis. Third phase shifting element 2400 acts as a perfect electric conductor for reflecting a first component of incident electric field $E_i$ 2800 parallel to the direction of first effective current 2807*a* and of second effective current 2807*b*, and as a perfect magnetic conductor for reflecting a second component of incident electric field $E_i$ 2800 orthogonal to the direction of first effective current 2807*a* and of second effective current 2807*b*. This leads to reflected electric field $E_r$ 2808 polarized in the +y direction parallel to the y-axis.

Referring to FIG. 28B, when illuminated with the incident waves polarized along the −x direction, a first electric current 2812 and a second electric current 2813 are induced on second switch connector arm 2426*b* and on third switch connector arm 2426*c*. First T-shaped conductor 2424*a*, first via 2602*a*, first throw arm 2606 of switch 2604, second via 2602*b*, and second T-shaped conductor 2424*b*, form an extended electrical pathway that has an electrical length of approximately a wavelength. This results in a current minimum around the switch as well as the currents flowing in the same direction on first via 2602*a* and on third via 2602*c*. This dictates the direction of a third electric current 2814 on first switch connector arm 2426*a*. As a result, third phase shifting element 2400 produces a first effective current 2815*a* and a second effective current 2815*b* that make an angle of 135° relative to the x-axis. Third phase shifting element 2400 acts as a perfect electrical conductor for reflecting the first component of incident electric field $E_i$ 2800 parallel to the direction of first effective current 2815*a* and of second effective current 2815*b*, and as a perfect magnetic conductor for reflecting the second component of incident electric field $E_i$ 2800 orthogonal to the direction of first effective current 2815*a* and of second effective current 2815*b*. This leads to reflected electric field $E_r$ 2816 polarized in the −y direction parallel to the y-axis.

Dimensions for third phase shifting element 2400 can be determined based on the following:

$$0 < P \le \frac{\lambda_0}{2}$$

$$\frac{\lambda_{eff}}{10} \le l_1 \le \frac{\lambda_{eff}}{4};\ l_1 < \frac{P}{2};\ \lambda_{eff} \approx \frac{\lambda_0}{\sqrt{\frac{1+\epsilon_{r,1}}{2}}}$$

$$\frac{\lambda_{eff}}{10} \le l_2 \le \frac{\lambda_{eff}}{4}$$

-continued $$\frac{\lambda_{eff}}{10} \le l_3 \le \frac{\lambda_{eff}}{4}$$

$$\frac{\lambda_{eff}}{10} \le l_4 \le \frac{\lambda_{eff}}{4}$$

$$\frac{\lambda_0}{10} \le h_1 \times \sqrt{\epsilon_{r,1}} + \cdots + h_{n-1} \times \sqrt{\epsilon_{r,n-1}} \le \frac{\lambda_0}{3}$$

$$0 \le h_m \times \sqrt{\epsilon_{r,m}} < \lambda_0$$

$$0 < w_1 \le \frac{\lambda_0}{10},\ 0 < w_2 \le \frac{\lambda_0}{10}$$

$$0 < w_3 \le \frac{\lambda_0}{10},\ 0 < w_4 \le \frac{\lambda_0}{10}$$

$$0 < s \le \frac{\lambda_0}{10}$$

where $\lambda_0$ is a wavelength of operation and is defined as $\lambda_0 = c/f_0$, where c is the speed of light and $f_0$ is a carrier frequency, where P is length 2420 and width 2421, $l_1$ is arm length 2502, $w_1$ is arm width 2506, $l_2$ is arm length 2508, $w_2$ is arm width 2504, s is first distance 2500 and first distance 2510, $l_3$ is arm length 2512, $w_3$ is arm width 2516, $l_4$ is arm length 2518, $w_4$ is arm width 2514, $\epsilon_{r,1}$ is a relative permittivity of a top layer of second dielectric layer 2406, $h_1$ is third thickness 2418 of the top layer of second dielectric layer 2406, $\epsilon_{r,n-1}$ is a relative permittivity of a next layer of second dielectric layer 2406 when second dielectric layer 2406 is formed of a plurality of dielectric layers n, $h_{n-1}$ is a thickness of the next layer of second dielectric layer 2406 when second dielectric layer 2406 is formed of a plurality of dielectric layers n, $\epsilon_{r,m}$ is a relative permittivity of first dielectric layer 2402, $h_m$ is first thickness 2416 of first dielectric layer 2402. When second dielectric layer 2406 is formed of the plurality of dielectric layers n, third thickness 2418 is a total thickness of second dielectric layer 2406.

Figure 29:
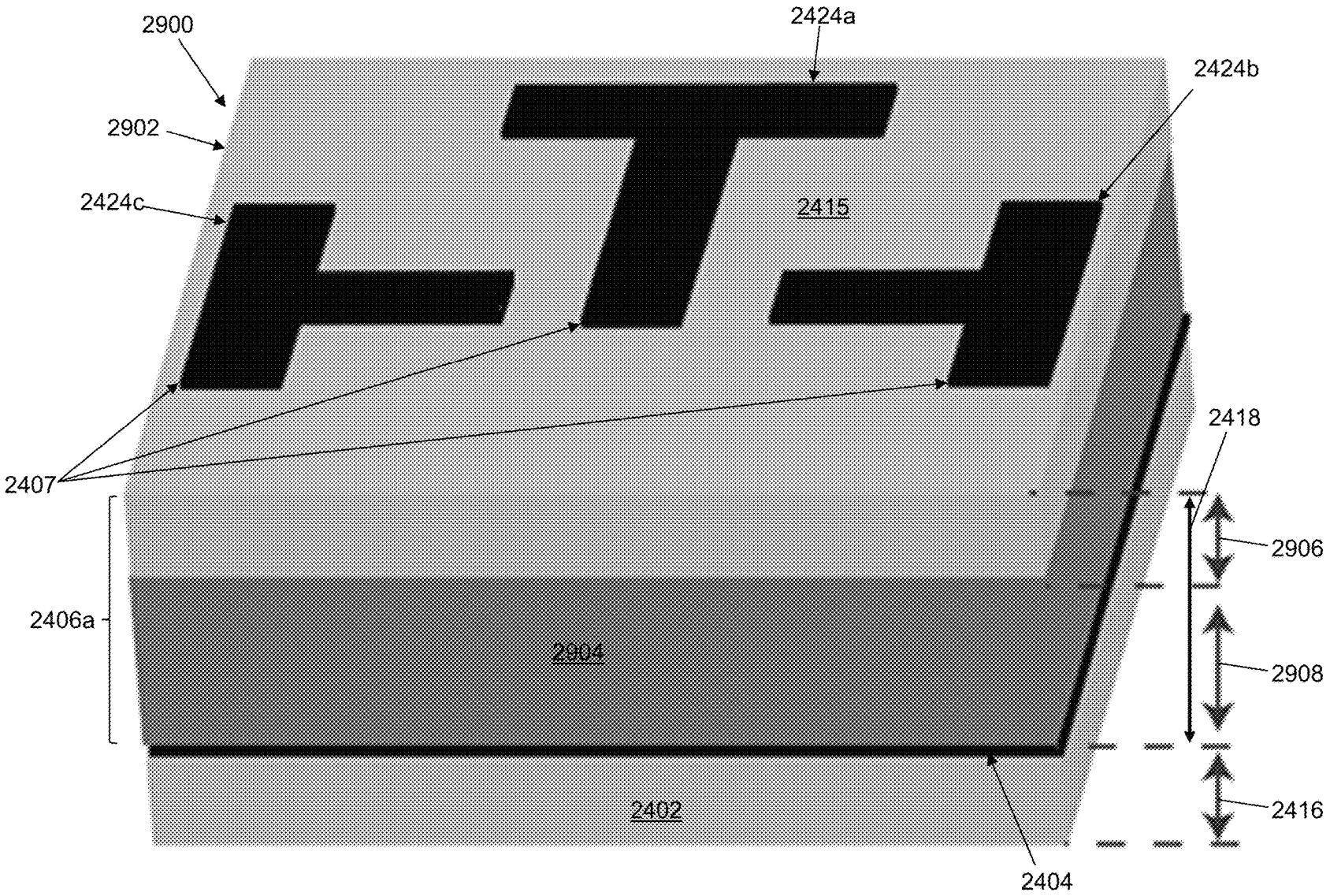
FIG. 29 depicts a perspective side view of a fourth phase shifting element similar to that shown in FIG. 24 with an additional dielectric material layer in accordance with an illustrative embodiment.

Referring to FIG. 29, a perspective side view of a fourth phase shifting element 2900 is shown in accordance with an illustrative embodiment. Fourth phase shifting element 2900 includes first dielectric layer 2402, conducting layer 2404, a fourth dielectric layer 2406*a*, and conducting pattern layer 2407. Fourth dielectric layer 2406*a* is similar to second dielectric layer 2406 except that it is formed of two dielectric layers, a top dielectric layer 2902 and a sandwiched dielectric layer 2904. Conducting pattern layer 2407 is formed on top surface 2415 of top dielectric layer 2902. Top dielectric layer 2902 has a fourth thickness 2906. Sandwiched dielectric layer 2904 is between top dielectric layer 2902 and conducting layer 2404 and has a fifth thickness 2908. In the illustrative embodiment of FIG. 29, sandwiched dielectric layer 2904 is formed of RO3006 material. Top dielectric layer 2902 and first dielectric layer 2902 are formed of RO4003C material with a dielectric constant of 3.4 and a loss tangent of 0.0027.

Fourth phase shifting element 2900 was constructed in two embodiments to correspond with either the first position or the second position of switch 2604. Illustrative dimensions for second phase shifting element 600 are P=8 mm for length 2420 and width 2421, $l_1$=3.6 mm for arm length 2502, $w_1$=0.3 mm for arm width 2506, $l_2$=2 mm for arm length 2508, $w_2$=0.3 mm for arm width 2504, s=0.2 mm for first distance 2500 and first distance 2510, $l_3$=1.9 mm for arm length 2512, $w_3$=0.3 mm for arm width 2516, $l_4$=2 mm for arm length 2518, $w_4$=0.3 mm for arm width 2514, $\epsilon_{r,1}$ is a relative permittivity of RO4003C material, $h_1$=0.4 mm for fourth thickness 2906, $\epsilon_{r,2}$ is a relative permittivity of RO3006 material, $h_2$=2.6 mm for fifth thickness 2908 such that third thickness 2418 is 3 mm, $\epsilon_{r,m}$, is a relative permittivity of RO4003C material, and $h_m$=0.4 mm for first thickness 2416 of first dielectric layer 2402.

Figure 30:
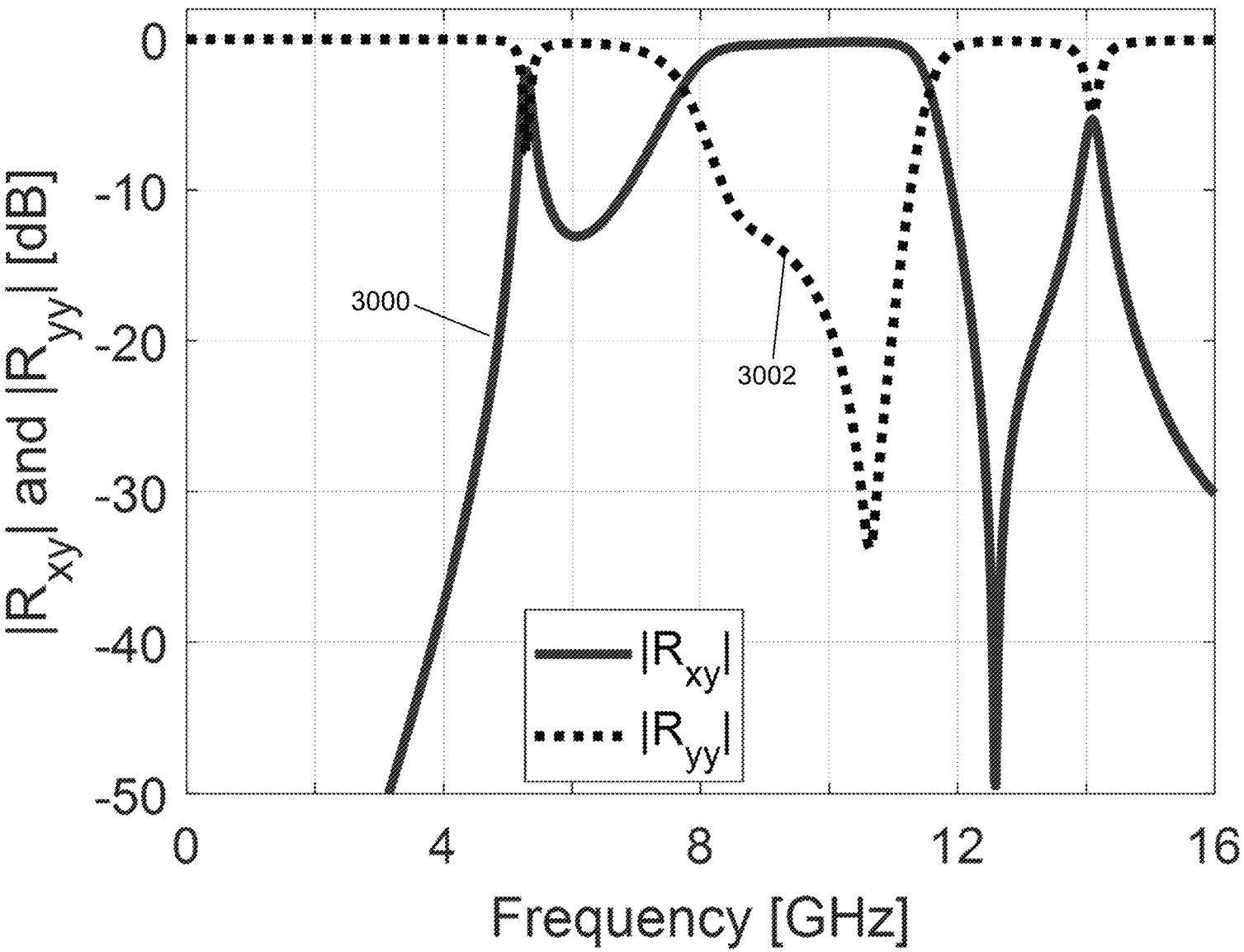
FIG. 30 depicts an X-Y reflection coefficient and a Y-Y reflection coefficient as a function of frequency of the fourth phase shifting element of FIG. 29 in accordance with an illustrative embodiment.

Referring to FIG. 30, an X-Y reflection coefficient curve 3000 and a Y-Y reflection coefficient curve 3002 show an X-Y reflection coefficient and a Y-Y reflection coefficient, respectively, as a function of frequency that result when using fourth phase shifting element 2900 designed using the illustrative dimensions above. Incident electric field plane 1200 was polarized parallel to the y-axis.

Figure 31:
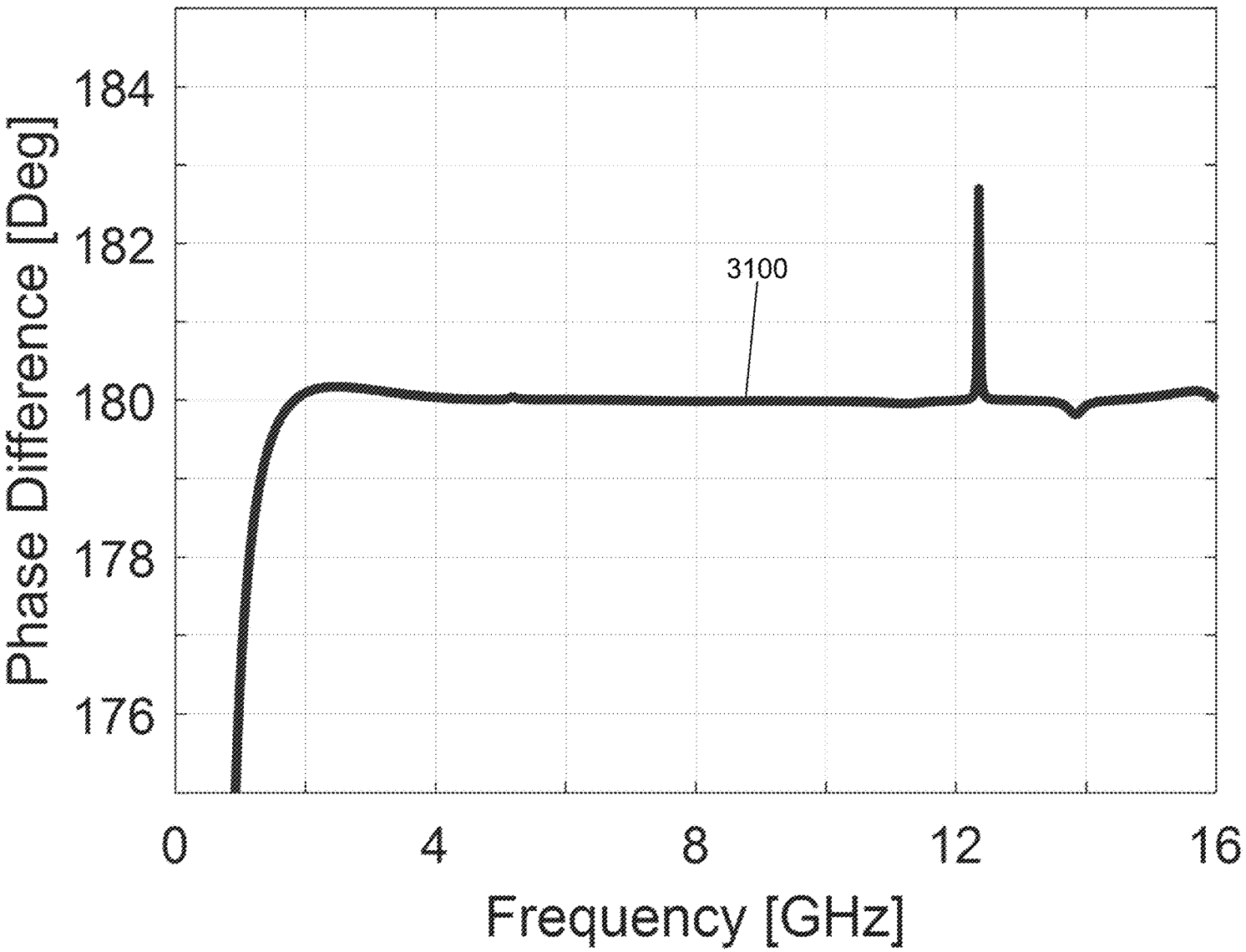
FIG. 31 depicts a phase difference as a function of frequency between the fourth phase shifting element of FIG. 29 in the first switch position and in the second switch position in accordance with an illustrative embodiment.

Referring to FIG. 31, a phase difference curve 3100 shows a phase difference as a function of frequency between the two embodiments of fourth phase shifting element 2900 in the first switch position and in the second switch position in accordance with an illustrative embodiment. The phase difference is 180° within the intended operating frequency range (e.g. 8.3-11.2 GHz) of fourth phase shifting element 2900. The blip in phase difference curve 3100 that occurred at ~12.3 GHz is likely due to a transition between $R_{yy}$-dominant reflection to $R_{xy}$-dominant reflection around this frequency as shown in FIG. 30. This frequency is outside of the intended operating frequency range of second phase shifting element 600 (e.g. 8.3-11.2 GHz) so it is not a concern.

The combination of feed antenna 702 and the plurality of phase shifting elements form a high-gain antenna. A direction of maximum radiation of the high-gain antenna is determined by the phase shift gradient of the electric field distribution over the aperture of the plurality of phase shifting elements. Because the phase shift gradient is dynamically changeable by changing the position of switch 304 or of switch 2604 for each phase shifting element across the aperture, a direction of maximum radiation of the antenna also changes. Such a dynamically reconfigurable system constitutes a beam steerable phased array. Multiple steerable beams can be formed by multiple feed antennas.

The described phase shifting elements are easy to implement and make tunable (i.e., change the electric field rotation from −90° to 90° causing either a 0° or 180° relative phase shift between the reflected waves) using simple electrical switches. As a result, a phased-array implemented using the described phase shifting elements has significantly lower complexity and cost compared to alternative techniques. Moreover, the physics of beam steering and the nature of the described phase shifting elements allows for these phased arrays to handle relatively high levels of radiated power. The described phase shifting elements also provide a simple structure that achieves wideband operation. The described phase shifting elements do not use any nonlinear elements or any solid-state phase shifters or transmit/receive modules. As a result, apertures designed using the described phase shifting elements can handle significantly higher power levels in comparison with the existing technology. This feature is significant especially for millimeter-wave (MMW) communication systems. At MMW frequencies, the propagation losses are significantly higher compared to microwave frequencies. As a result, transmitters used at these frequencies must be able to radiate higher power levels to ensure that a communication link at the desired distance can be established.

The described phase shifting elements also do not require complex thermal management solutions to cool down the aperture of the antenna due to the fact that all the heat generating components are removed from the aperture. This significantly reduces the cost and complexity of thermal management of the array. This also reduces the weight of the phased-array.

Figure 32:
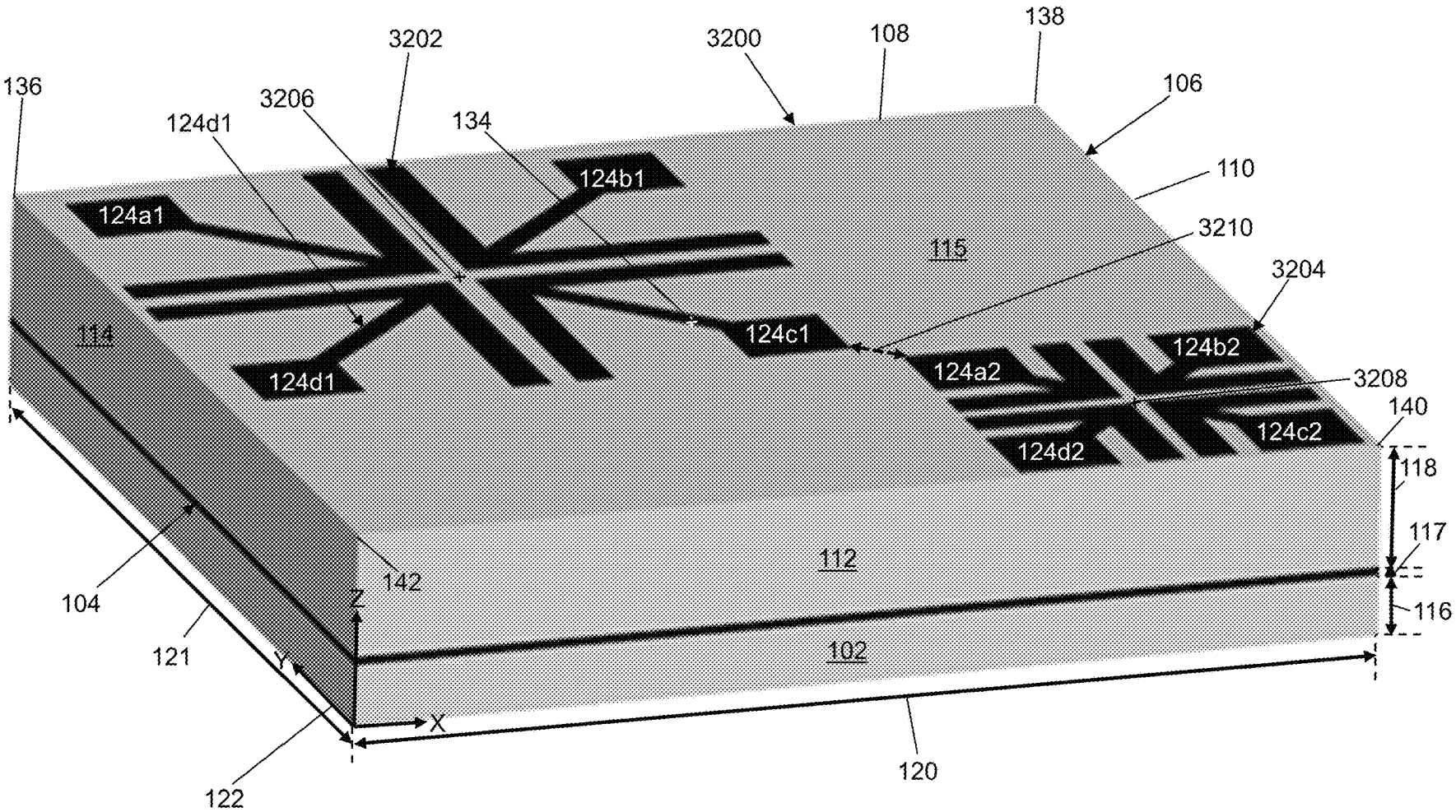
FIG. 32 depicts a perspective side view of a dual band phase shifting element in accordance with an illustrative embodiment.
Figure 33:
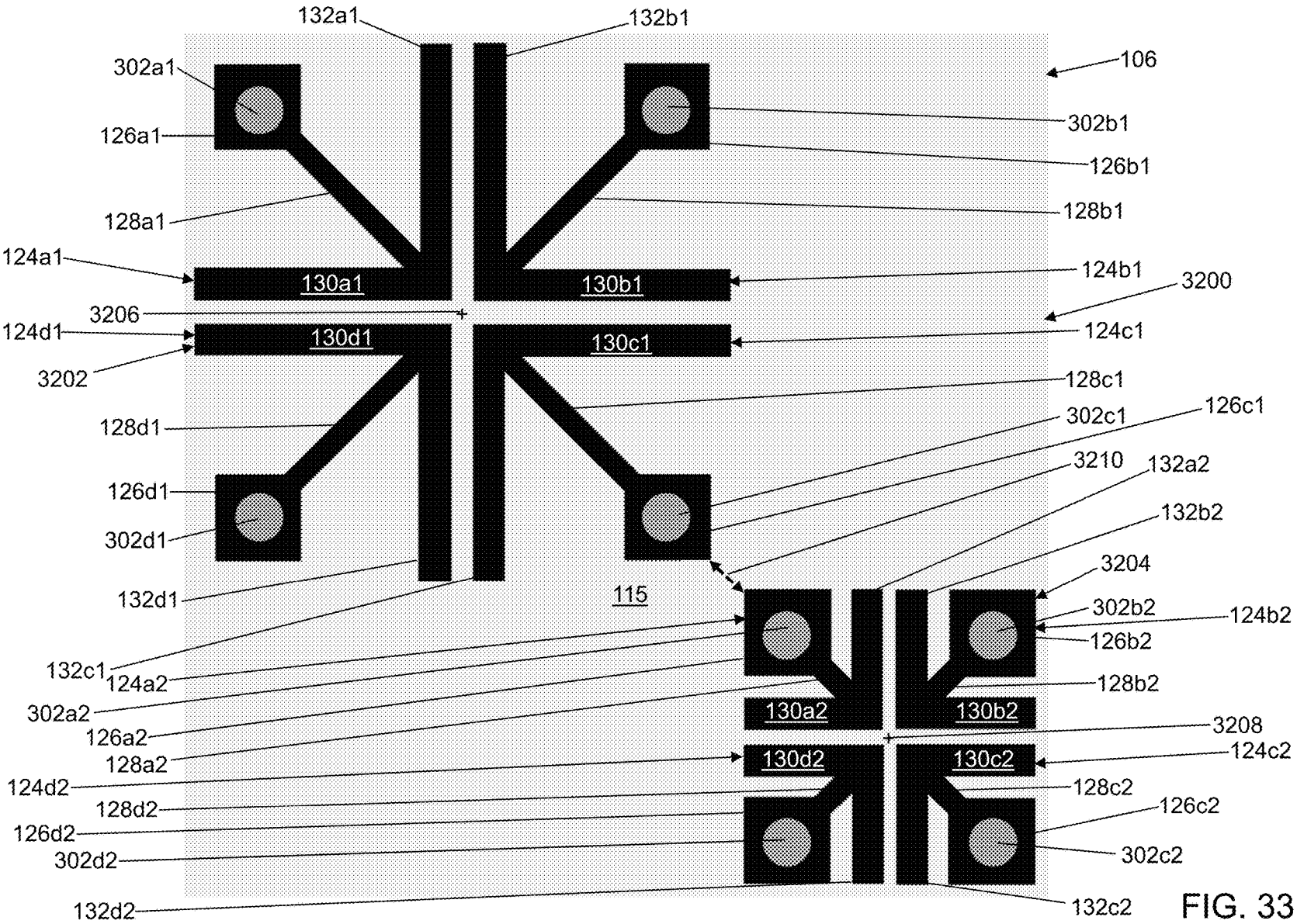
FIG. 33 depicts a top view of the dual band phase shifting element of FIG. 32 in accordance with an illustrative embodiment.

Referring to FIG. 32, a perspective side view of dual band phase shifting element 3200 is shown in accordance with an illustrative embodiment. Referring to FIG. 33, a top view of dual band phase shifting element 3200 is shown in accordance with an illustrative embodiment. Dual band phase shifting element 3200 may include first dielectric layer 102, conducting layer 104, second dielectric layer 106, a first conducting pattern layer 3202, and a second conducting pattern layer 3204. First conducting pattern layer 3202 and second conducting pattern layer 3204 have a similar shape with one pattern layer smaller than the other and are each a further illustration of conducting pattern layer 107. Dual band phase shifting element 3200 provides a polarization rotating surface that can be used as a spatial phase shifter of a single-layer, wideband reflective array antenna that operates at a first frequency and at a second frequency and thus provides two frequency bands of operation. The dimensions of first conducting pattern layer 3202 are selected to radiate most strongly at the first frequency. The dimensions of second conducting pattern layer 3204 are selected to radiate most strongly at the second frequency. In the illustrative embodiment, the dimensions of first conducting pattern layer 3202 are larger than those of second conducting pattern layer 3204 indicating that the first frequency is lower than the second frequency.

Though shown in the illustrative embodiment as including two similar, but differently sized conducting pattern layers, a greater number of similar, but differently sized conducting pattern layers may be included in alternative embodiments. For example, a third conducting pattern layer could be added to the right of first conducting pattern layer 3202 and above second conducting pattern layer 3204, and/or a fourth conducting pattern layer could be added below first conducting pattern layer 3202 and to the left of second conducting pattern layer 3204, and so on to support additional successively higher frequency bands resulting in successively smaller conducting pattern layers. Additionally, in an alternative embodiment, dual band phase shifting element 3200 could be populated with different sized versions of third phase shifting element 2400 to support multiple frequency band operation.

Like first corner conductor 124*a*, second corner conductor 124*b*, third corner conductor 124*c*, and fourth corner conductor 124*d* of conducting pattern layer 107 of phase shifting element 100, first conducting pattern layer 3202 and second conducting pattern layer 3204 each rotate a polarization of a reflected wave by 90° compared to that of an incident wave. First conducting pattern layer 3202 and second conducting pattern layer 3204 of dual band phase shifting element 3200 can each be independently switched between a first configuration and a second configuration that is a geometric mirror image of the first configuration. As such, each of first conducting pattern layer 3202 and second conducting pattern layer 3204 of dual band phase shifting element 3200 can be used as one-bit spatial phase shifters that provides either −90° or +90 polarization rotation compared to that of the incident wave. The two reflected fields have a phase difference of 180° degrees between them. Therefore, if one is taken as a reference, the other one has a phase shift of 180° with respect to the first one. Because phase shifting using first conducting pattern layer 3202 and second conducting pattern layer 3204 of dual band phase shifting element 3200 is achieved through geometric means, dual band phase shifting element 3200 can provide either 0° or 180° phase shift at two different frequencies over extremely broad bandwidths.

First conducting pattern layer 3202 and second conducting pattern layer 3204 are formed on top surface 115 of second dielectric layer 106 opposite conducting layer 104. First conducting pattern layer 3202 includes a first corner conductor 124*a*1, a second corner conductor 124*b*1, a third corner conductor 124*c*1, and a fourth corner conductor 124*d*1. In the illustrative embodiment, first corner conductor 124*a*1, second corner conductor 124*b*1, third corner conductor 124*c*1, and fourth corner conductor 124*d*1 each form an open arrow shape with arrow tip arms separated by 90 degrees and with each arrow tip pointed toward a center 3206 of first conducting pattern layer 3202 at 135°, 45°, 315°, and 225°, respectively, in the x-y plane and relative to the +x-direction. Thus, a tip of each open arrow shape is pointed in a direction that is rotated 90° relative to each adjacent tip.

First corner conductor 124*a*1, second corner conductor 124*b*1, third corner conductor 124*c*1, and fourth corner conductor 124*d*1 are symmetrically distributed relative to center 3206 of first conducting pattern layer 3202. First corner conductor 124*a*1 and second corner conductor 124*b*1 form a mirror image of third corner conductor 124*c*1 and fourth corner conductor 124*d*1 relative to an x-z center plane through center 3206 of first conducting pattern layer 3202. The x-z center plane is parallel to the x-z plane defined by x-y-z frame 122. First corner conductor 124*a*1 and fourth corner conductor 124*d*1 form a mirror image of second corner conductor 124*b*1 and third corner conductor 124*c*1 relative to a y-z center plane through center 3206 of first conducting pattern layer 3202. The y-z center plane is parallel to the y-z plane defined by x-y-z frame 122.

First corner conductor 124*a*1 of first conducting pattern layer 3202 includes a first switch connector 126*a*1, a first connecting arm 128*a*1, a first x-arm 130*a*1, and a first y-arm 132*a*1. First x-arm 130*a*1 and first y-arm 132*a*1 are perpendicular to each other, and first connecting arm 128*a*1 bisects the corner in which first x-arm 130*a*1 and first y-arm 132*a*1 join each other. As a result, first connecting arm 128*a*1 is aligned with and extends from the tip formed at the intersection of first x-arm 130*a*1 and first y-arm 132*a*1. First switch connector 126*a*1, first connecting arm 128*a*1, first x-arm 130*a*1, and first y-arm 132*a*1 are used to describe a shape of first corner conductor 124*a* and typically are not distinct elements but form a single conductive structure.

First switch connector 126*a*1 connects first corner conductor 124*a*1 to a first via 302*a*1. First connecting arm 128*a*1 connects first x-arm 130*a*1 and first y-arm 132*a*1 to first switch connector 126*a*1. First connecting arm 128*a*1 extends parallel to a diagonal between center 3206 of first conducting pattern layer 3202 and upper left corner 136. First x-arm 130*a*1 extends parallel to the x-axis. First y-arm 132*a*1 extends parallel to the y-axis.

Second corner conductor 124*b*1 of first conducting pattern layer 3202 includes a second switch connector 126*b*1, a second connecting arm 128*b*1, a second x-arm 130*b*1, and a second y-arm 132*b*1. Second x-arm 130*b*1 and second y-arm 132*b*1 are perpendicular to each other, and second connecting arm 128*b*1 bisects the corner in which second x-arm 130*b*1 and second y-arm 132*b*1 join each other. As a result, second connecting arm 128*b*1 is aligned with and extends from the tip formed at the intersection of second x-arm 130*b*1 and second y-arm 132*b*1. Second switch connector 126*b*1, second connecting arm 128*b*1, second x-arm 130*b*1, and second y-arm 132*b*1 are used to describe a shape of second corner conductor 124*b*1 and typically are not distinct elements but form a single conductive structure. Second switch connector 126*b*1 connects second corner conductor 124*b*1 to a second via 302*b*1. Second connecting arm 128*b*1 connects second x-arm 130*b*1 and second y-arm 132*b*1 to second switch connector 126*b*1. Second connecting arm 128*b*1 extends perpendicular to the diagonal between center 3206 of first conducting pattern layer 3202 and upper left corner 136. Second x-arm 130*b*1 extends parallel to the x-axis. Second y-arm 132*b*1 extends parallel to the y-axis.

Third corner conductor 124*c*1 of first conducting pattern layer 3202 includes a third switch connector 126*c*1, a third connecting arm 128*c*1, a third x-arm 130*c*1, and a third y-arm 132*c*1. Third x-arm 130*c*1 and third y-arm 132*c*1 are perpendicular to each other, and third connecting arm 128*c*1 bisects the corner in which third x-arm 130*c*1 and third y-arm 132*c*1 join each other. As a result, third connecting arm 128*c*1 is aligned with and extends from the tip formed at the intersection of third x-arm 130*c*1 and third y-arm 132*c*1. Third switch connector 126*c*1, third connecting arm 128*c*1, third x-arm 130*c*1, and third y-arm 132*c*1 are used to describe a shape of third corner conductor 124*c*1 and typically are not distinct elements but form a single conductive structure. Third switch connector 126*c*1 connects third corner conductor 124*c*1 to a third via 302*c*1. Third connecting arm 128*c*1 connects third x-arm 130*c*1 and third y-arm 132*c*1 to third switch connector 126*c*1. Third connecting arm 128*c*1 extends parallel to the diagonal between center 3206 of first conducting pattern layer 3202 and upper left corner 136. Third x-arm 130*c*1 extends parallel to the x-axis. Third y-arm 132*c*1 extends parallel to the y-axis.

Fourth corner conductor 124*d*1 of first conducting pattern layer 3202 includes a fourth switch connector 126*d*1, a fourth connecting arm 128*d*1, a fourth x-arm 130*d*1, and a fourth y-arm 132*d*1. Fourth x-arm 130*d*1 and fourth y-arm 132*d*1 are perpendicular to each other, and fourth connecting arm 128*d*1 bisects the corner in which fourth x-arm 130*d*1 and fourth y-arm 132*d*1 join each other. As a result, fourth connecting arm 128*d*1 is aligned with and extends from the tip formed at the intersection of fourth x-arm 130*d*1 and fourth y-arm 132*d*1. Fourth switch connector 126*d*1, fourth connecting arm 128*d*1, fourth x-arm 130*d*1, and fourth y-arm 132*d*1 are used to describe a shape of fourth corner conductor 124*d*1 and typically are not distinct elements but form a single conductive structure. Fourth switch connector 126*d*1 connects fourth corner conductor 124*d*1 to a fourth via 302*d*1. Fourth connecting arm 128*d*1 connects fourth x-arm 130*d*1 and fourth y-arm 132*d*1 to fourth switch connector 126*d*1. Fourth connecting arm 128*d*1 extends perpendicular to the diagonal between center 3206 of first conducting pattern layer 3202 and upper left corner 136. Fourth x-arm 130*d*1 extends parallel to the x-axis. Fourth y-arm 132*d*1 extends parallel to the y-axis.

Second conducting pattern layer 3202 includes a first corner conductor 124*a*2, a second corner conductor 124*b*2, a third corner conductor 124*c*2, and a fourth corner conductor 124*d*2. In the illustrative embodiment, first corner conductor 124*a*2, second corner conductor 124*b*2, third corner conductor 124*c*2, and fourth corner conductor 124*d*2 each form an open arrow shape with arrow tip arms separated by 90 degrees and with each arrow tip pointed toward a center 3208 of second conducting pattern layer 3204 at 135°, 45°, 315°, and 225°, respectively, in the x-y plane and relative to the +x-direction. Thus, a tip of each open arrow shape is pointed in a direction that is rotated 90° relative to each adjacent tip.

First corner conductor 124*a*2, second corner conductor 124*b*2, third corner conductor 124*c*2, and fourth corner conductor 124*d*2 are symmetrically distributed relative to center 3208 of second conducting pattern layer 3204. First corner conductor 124*a*2 and second corner conductor 124*b*2 form a mirror image of third corner conductor 124*c*2 and fourth corner conductor 124*d*2 relative to an x-z center plane through center 3208 of second conducting pattern layer 3204. The x-z center plane is parallel to the x-z plane defined by x-y-z frame 122. First corner conductor 124*a*2 and fourth corner conductor 124*d*2 form a mirror image of second corner conductor 124*b*2 and third corner conductor 124*c*2 relative to a y-z center plane through center 3208 of second conducting pattern layer 3204. The y-z center plane is parallel to the y-z plane defined by x-y-z frame 122.

First corner conductor 124*a*2 of second conducting pattern layer 3204 includes a first switch connector 126*a*2, a first connecting arm 128*a*2, a first x-arm 130*a*2, and a first y-arm 132*a*2. First x-arm 130*a*2 and first y-arm 132*a*2 are perpendicular to each other, and first connecting arm 128*a*2 bisects the corner in which first x-arm 130*a*2 and first y-arm 132*a*2 join each other. As a result, first connecting arm 128*a*2 is aligned with and extends from the tip formed at the intersection of first x-arm 130*a*2 and first y-arm 132*a*2. First switch connector 126*a*2, first connecting arm 128*a*2, first x-arm 130*a*2, and first y-arm 132*a*2 are used to describe a shape of first corner conductor 124*a*2 and typically are not distinct elements but form a single conductive structure. First switch connector 126*a*2 connects first corner conductor 124*a*2 to a first via 302*a*2. First connecting arm 128*a*2 connects first x-arm 130*a*2 and first y-arm 132*a*2 to first switch connector 126*a*2. First connecting arm 128*a*2 extends parallel to the diagonal between center 3208 of second conducting pattern layer 3204 and lower right corner 140. First x-arm 130*a*2 extends parallel to the x-axis. First y-arm 132*a*2 extends parallel to the y-axis.

Second corner conductor 124*b*2 of second conducting pattern layer 3204 includes a second switch connector 126*b*2, a second connecting arm 128*b*2, a second x-arm 130*b*2, and a second y-arm 132*b*2. Second x-arm 130*b*2 and second y-arm 132*b*2 are perpendicular to each other, and second connecting arm 128*b*2 bisects the corner in which second x-arm 130*b*2 and second y-arm 132*b*2 join each other. As a result, second connecting arm 128*b*2 is aligned with and extends from the tip formed at the intersection of second x-arm 130*b*2 and second y-arm 132*b*2. Second switch connector 126*b*2, second connecting arm 128*b*2, second x-arm 130*b*2, and second y-arm 132*b*2 are used to describe a shape of second corner conductor 124*b*2 and typically are not distinct elements but form a single conductive structure. Second switch connector 126*b*2 connects second corner conductor 124*b*2 to a second via 302*b*2. Second connecting arm 128*b*2 connects second x-arm 130*b*2 and second y-arm 132*b*2 to second switch connector 126*b*2. Second connecting arm 128*b*2 extends perpendicular to the diagonal between center 3208 of second conducting pattern layer 3204 and lower right corner 140. Second x-arm 130*b*2 extends parallel to the x-axis. Second y-arm 132*b*2 extends parallel to the y-axis.

Third corner conductor 124*c*2 of second conducting pattern layer 3204 includes a third switch connector 126*c*2, a third connecting arm 128*c*2, a third x-arm 130*c*2, and a third y-arm 132*c*2. Third x-arm 130*c*2 and third y-arm 132*c*2 are perpendicular to each other, and third connecting arm 128*c*2 bisects the corner in which third x-arm 130*c*2 and third y-arm 132*c*2 join each other. As a result, third connecting arm 128*c*2 is aligned with and extends from the tip formed at the intersection of third x-arm 130*c*2 and third y-arm 132*c*2. Third switch connector 126*c*2, third connecting arm 128*c*2, third x-arm 130*c*2, and third y-arm 132*c*2 are used to describe a shape of third corner conductor 124*c*2 and typically are not distinct elements but form a single conductive structure. Third switch connector 126*c*2 connects third corner conductor 124*c*2 to a third via 302*c*2. Third connecting arm 128*c*2 connects third x-arm 130*c*2 and third y-arm 132*c*2 to third switch connector 126*c*2. Third connecting arm 128*c*2 extends parallel to the diagonal between center 3208 of second conducting pattern layer 3204 and lower right corner 140. Third x-arm 130*c*2 extends parallel to the x-axis. Third y-arm 132*c*2 extends parallel to the y-axis.

Fourth corner conductor 124*d*2 of second conducting pattern layer 3204 includes a fourth switch connector 126*d*2, a fourth connecting arm 128*d*2, a fourth x-arm 130*d*2, and a fourth y-arm 132*d*2. Fourth x-arm 130*d*2 and fourth y-arm 132*d*2 are perpendicular to each other, and fourth connecting arm 128*d*2 bisects the corner in which fourth x-arm 130*d*2 and fourth y-arm 132*d*2 join each other. As a result, fourth connecting arm 128*d*2 is aligned with and extends from the tip formed at the intersection of fourth x-arm 130*d*2 and fourth y-arm 132*d*2. Fourth switch connector 126*d*2, fourth connecting arm 128*d*2, fourth x-arm 130*d*2, and fourth y-arm 132*d*2 are used to describe a shape of fourth corner conductor 124*d*2 and typically are not distinct elements but form a single conductive structure. Fourth switch connector 126*d*2 connects fourth corner conductor 124*d*2 to a fourth via 302*d*2. Fourth connecting arm 128*d*2 connects fourth x-arm 130*d*2 and fourth y-arm 132*d*2 to fourth switch connector 126*d*2. Fourth connecting arm 128*d*2 extends perpendicular to the diagonal between center 3208 of second conducting pattern layer 3204 and lower right corner 140. Fourth x-arm 130*d*2 extends parallel to the x-axis. Fourth y-arm 132*d*2 extends parallel to the y-axis.

First conducting pattern layer 3202 and second conducting pattern layer 3204 may be positioned at different locations relative to each other and/or may be rotated about center 3206 of first conducting pattern layer 3202 or about center 3208 of second conducting pattern layer 3204. In the illustrative embodiment, first conducting pattern layer 3202 is positioned adjacent upper left corner 136 and second conducting pattern layer 3204 is positioned adjacent lower right corner 140. First conducting pattern layer 3202 and second conducting pattern layer 3204 are separated by a minimum distance 3210 to minimize inter-band interference between first conducting pattern layer 3202 and second conducting pattern layer 3204 when they are radiating. Minimum distance 3210 greater than zero as in first conducting pattern layer 3202 and second conducting pattern layer 3204 not touching is a sufficient distance. First conducting pattern layer 3202 and second conducting pattern layer 3204 could be arranged above and below each other a sufficient distance to avoid an amount of inter-band interference that could impact performance. In an alternative embodiment, one or more additional conducting pattern layers may be positioned adjacent first conducting pattern layer 3202 and second conducting pattern layer 3204 and configured to radiate successively higher frequencies so that the dimensions are smaller and fit in empty space on top surface 115. For example, a third conducting pattern layer could be positioned adjacent upper right corner 138 and/or a fourth conducting pattern layer could be positioned adjacent lower left corner 142 to radiate at a third frequency and a fourth frequency that are higher than the first frequency and the second frequency.

Figure 34:
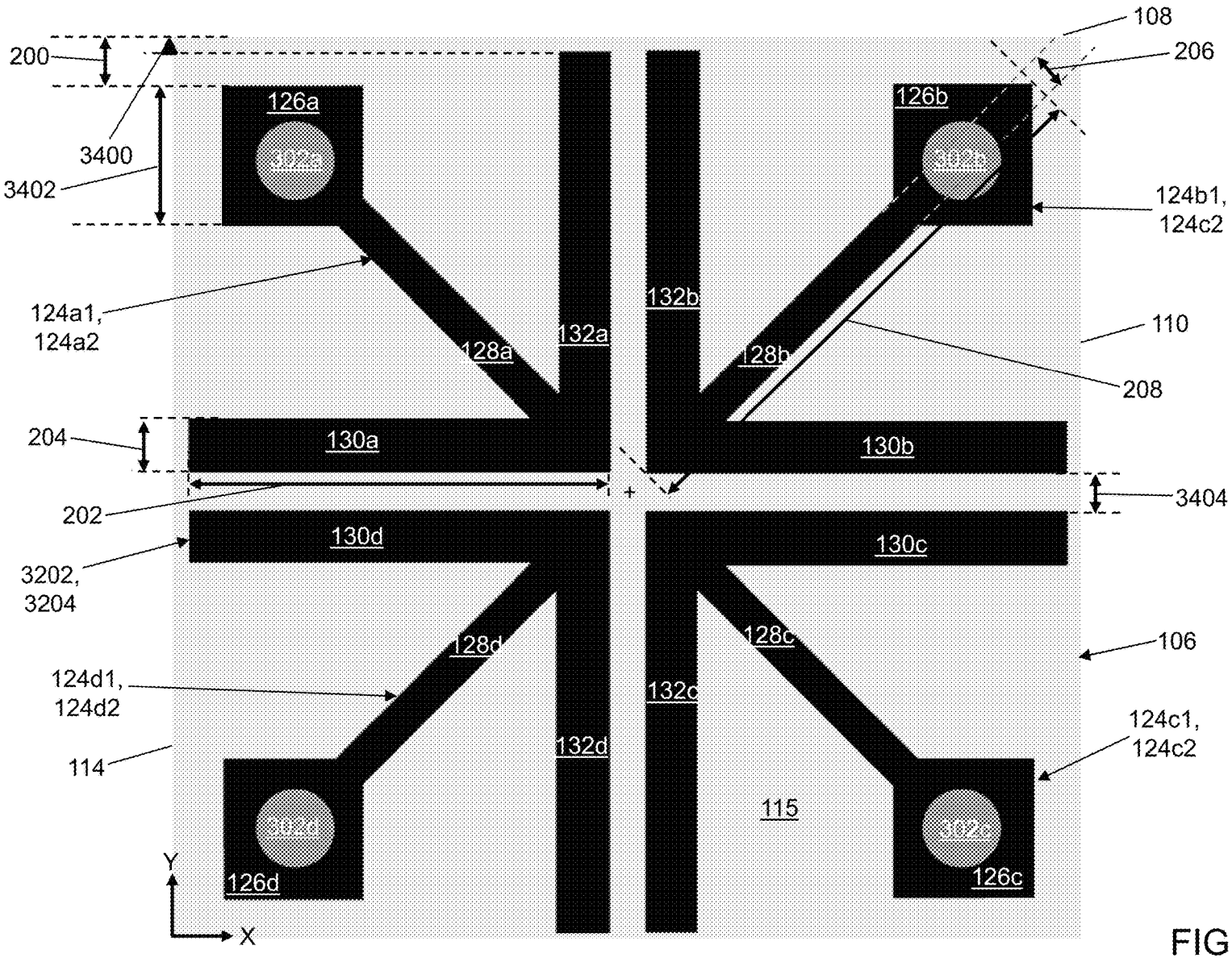
FIG. 34 depicts a top view of a single band phase shifting element of the dual band phase shifting element of FIG. 32 in accordance with an illustrative embodiment.

Referring to FIG. 34, a top view of a single band phase shifting element 3202, 3204 is shown in accordance with an illustrative embodiment. First switch connector 126*a* is first distance 200 from back wall 108 and from left-side wall 114.

First switch connector 126*a* has a width 3402. First y-arm 132*a* is a second distance 3400 from back wall 108, and first x-arm 130*a* is second distance 3400 from left-side wall 114. First x-arm 130*a* has corner arm length 202 and corner arm width 204. First y-arm 132*a* has corner arm length 202 and corner arm width 204. First connecting arm 128*a* has arm length 208 and arm width 206. For simplicity of description, first x-arm 130*a*, first y-arm 132*a*, and first connecting arm 128*a* have been described to overlap at the arrow point though again first switch connector 126*a*, first connecting arm 128*a*, first x-arm 130*a*, and first y-arm 132*a* typically are not distinct elements, but form a single conductive structure. A conductor separation distance 3404 separates first x-arm 130*a* and second x-arm 130*b* from third x-arm 130*c* and fourth x-arm 130*d*, respectively. Conductor separation distance 3404 also separates first y-arm 132*a* and fourth y-arm 132*d* from second y-arm 132*b* and third y-arm 132*c*, respectively.

First switch connector 126*a* is illustrated as having a square shape though it may have other shapes including circular, oval, triangular, curved, etc. First x-arm 130*a*, first y-arm 132*a*, and first connecting arm 128*a* are illustrated as having rectangular shapes though they may have other shapes including circular, oval, triangular, etc. First conducting pattern layer 3202 and second conducting pattern layer 3204 can be implemented using any crossed-dipole shaped conductive pattern layer. For example, referring to FIG. 35, a top view of second dual band phase shifting element 3200*a* is shown in accordance with an illustrative embodiment. Second dual band phase shifting element 3200*a* may include first dielectric layer 102, conducting layer 104, second dielectric layer 106, a first conducting pattern layer 3202*a*, and a second conducting pattern layer 3204*a*. Again, first conducting pattern layer 3202*a* and second conducting pattern layer 3204*a* have a similar shape with one pattern layer smaller than the other.

First conducting pattern layer 3202*a* and second conducting pattern layer 3204*a* are formed on top surface 115 of second dielectric layer 106 opposite conducting layer 104. First conducting pattern layer 3202*a* includes a first corner conductor 124*a*3, a second corner conductor 124*b*3, a third corner conductor 124*c*3, and a fourth corner conductor 124*d*3. In the illustrative embodiment, first corner conductor 124*a*3, second corner conductor 124*b*3, third corner conductor 124*c*3, and fourth corner conductor 124*d*3 each form a quadrilateral shape with quadrilateral tip arms separated by 90 degrees and pointed toward center 3206 of first conducting pattern layer 3202*a* at 135°, 45°, 315°, and 225°, respectively, in the x-y plane and relative to the +x-direction. Thus, the quadrilateral tip of each quadrilateral shape is pointed in a direction that is rotated 90° relative to each adjacent tip.

Each of first corner conductor 124*a*3, second corner conductor 124*b*3, third corner conductor 124*c*3, and fourth corner conductor 124*d*3 of first conducting pattern layer 3202*a* includes a first switch connector portion, a first connecting arm portion, a first x-arm portion, and a first y-arm portion, where the first x-arm portion and the first y-arm portion form a 90 degree corner, and the first connecting arm portion bisects the 90 degree corner where the first x-arm portion and the first y-arm portion join each other. The first connecting arm portion joins the first x-arm portion and the first y-arm portion to the first switch connector portion. The first switch connector portion of each of first corner conductor 124*a*3, second corner conductor 124*b*3, third corner conductor 124*c*3, and fourth corner conductor 124*d*3 of first conducting pattern layer 3202*a* surrounds and connects each corner conductor to first via 302*a*1, second 302*b*1, third 302*c*1, and fourth 302*d*1, respectively. The first x-arm portion extends parallel to the x-axis, and the y-arm portion extends parallel to the first y-axis.

Second conducting pattern layer 3204*a* includes a first corner conductor 124*a*4, a second corner conductor 124*b*4, a third corner conductor 124*c*4, and a fourth corner conductor 124*d*4. In the illustrative embodiment, first corner conductor 124*a*4, second corner conductor 124*b*4, third corner conductor 124*c*4, and fourth corner conductor 124*d*4 also each form a quadrilateral shape with quadrilateral tip arms separated by 90 degrees and pointed toward center 3208 of second conducting pattern layer 3204*a* at 135°, 45°, 315°, and 225°, respectively, in the x-y plane and relative to the +x-direction. Thus, the quadrilateral tip of each quadrilateral shape is pointed in a direction that is rotated 90° relative to each adjacent tip.

Each of first corner conductor 124*a*4, second corner conductor 124*b*4, third corner conductor 124*c*4, and fourth corner conductor 124*d*4 of second conducting pattern layer 3204*a* includes the first switch connector portion, the first connecting arm portion, the first x-arm portion, and the first y-arm portion, where the first x-arm portion and the first y-arm portion form a 90 degree corner, and the first connecting arm portion bisects the 90 degree corner where the first x-arm portion and the first y-arm portion join each other. The first connecting arm portion joins the first x-arm portion and the first y-arm portion to the first switch connector portion. The first switch connector portion of each of first corner conductor 124*a*4, second corner conductor 124*b*4, third corner conductor 124*c*4, and fourth corner conductor 124*d*4 of second conducting pattern layer 3204*a* surrounds and connects each corner conductor to first via 302*a*2, second 302*b*2, third 302*c*2, and fourth 302*d*2, respectively. The first x-arm portion extends parallel to the x-axis, and the y-arm portion extends parallel to the first y-axis. Again, second conducting pattern layer 3204*a* is designed to maximally radiate at a higher frequency than first conducting pattern layer 3202*a*, and is thus smaller than first conducting pattern layer 3202*a*.

Figure 36:
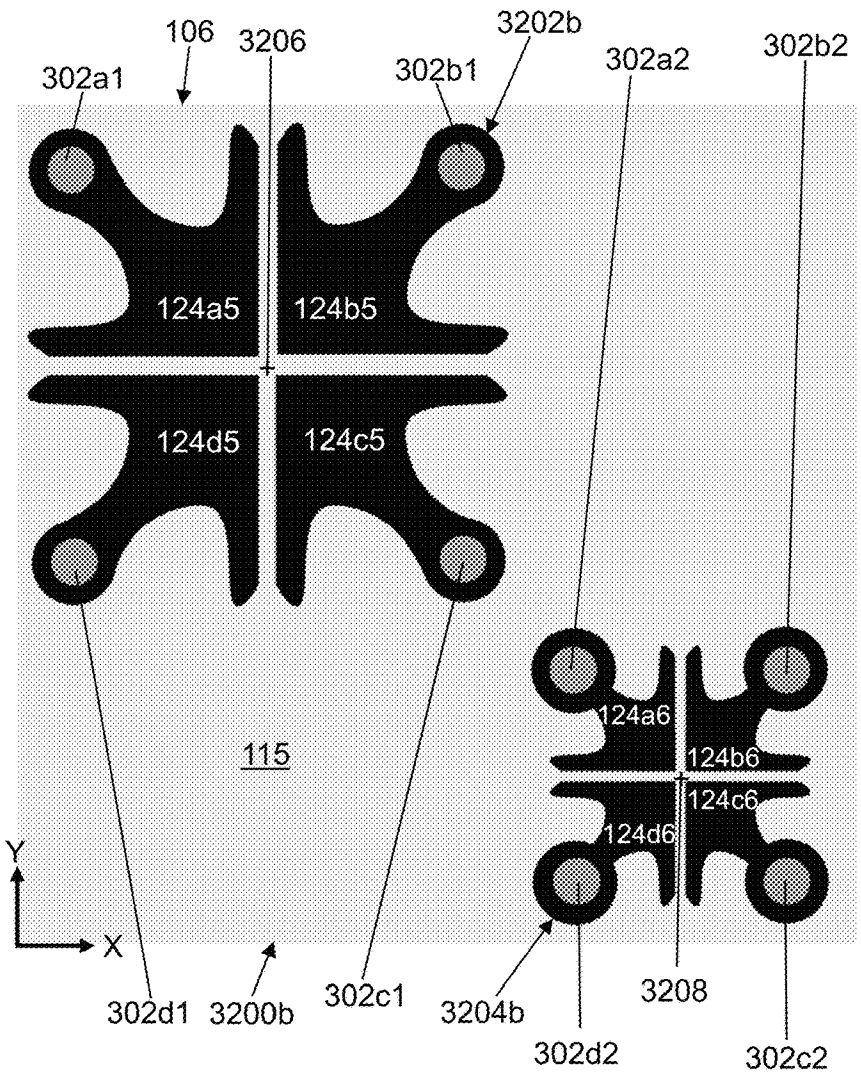
FIG. 36 depicts a top view of a third dual band phase shifting element in accordance with an illustrative embodiment.

As another example, referring to FIG. 36, a top view of third dual band phase shifting element 3200*b* is shown in accordance with an illustrative embodiment. Third dual band phase shifting element 3200*b* may include first dielectric layer 102, conducting layer 104, second dielectric layer 106, a first conducting pattern layer 3202*b*, and a second conducting pattern layer 3204*b*. Again, first conducting pattern layer 3202*b* and second conducting pattern layer 3204*b* have a similar shape with one pattern layer smaller than the other.

First conducting pattern layer 3202*b* and second conducting pattern layer 3204*b* are formed on top surface 115 of second dielectric layer 106 opposite conducting layer 104. First conducting pattern layer 3202*b* includes a first corner conductor 124*a*5, a second corner conductor 124*b*5, a third corner conductor 124*c*5, and a fourth corner conductor 124*d*5. In the illustrative embodiment, first corner conductor 124*a*5, second corner conductor 124*b*5, third corner conductor 124*c*5, and fourth corner conductor 124*d*5 each form a curved arrow shape with arrow tip arms separated by 90 degrees and with each arrow tip pointed toward center 3206 of first conducting pattern layer 3202*b* at 135°, 45°, 315°, and 225°, respectively, in the x-y plane and relative to the +x-direction. Thus, a tip of each curved arrow shape is pointed in a direction that is rotated 90° relative to each adjacent tip.

Each of first corner conductor 124*a*5, second corner conductor 124*b*5, third corner conductor 124*c*5, and fourth corner conductor 124*d*5 of first conducting pattern layer 3202*b* includes a second switch connector portion, a second connecting arm portion, a second x-arm portion, and a second y-arm portion, where the second x-arm portion and the second y-arm portion form a 90 degree corner, and the second connecting arm portion bisects the 90 degree corner where the second x-arm portion and the second y-arm portion join each other. The second connecting arm portion joins the second x-arm portion and the second y-arm portion to the second switch connector portion. The second switch connector portion of each of first corner conductor 124*a*5, second corner conductor 124*b*5, third corner conductor 124*c*5, and fourth corner conductor 124*d*5 of first conducting pattern layer 3202*b* surrounds and connects each corner conductor to first via 302*a*1, second 302*b*1, third 302*c*1, and fourth 302*d*1, respectively. The second x-arm portion extends parallel to the x-axis, and the y-arm portion extends parallel to the second y-axis.

Second conducting pattern layer 3204*b* includes a first corner conductor 124*a*6, a second corner conductor 124*b*6, a third corner conductor 124*c*6, and a fourth corner conductor 124*d*6. In the illustrative embodiment, first corner conductor 124*a*6, second corner conductor 124*b*6, third corner conductor 124*c*6, and fourth corner conductor 124*d*6 also each form a curved arrow shape with arrow tip arms separated by 90 degrees and with each arrow tip pointed toward center 3208 of second conducting pattern layer 3204*b* at 135°, 45°, 315°, and 225°, respectively, in the x-y plane and relative to the +x-direction. Thus, a tip of each curved arrow shape is pointed in a direction that is rotated 90° relative to each adjacent tip.

Each of first corner conductor 124*a*6, second corner conductor 124*b*6, third corner conductor 124*c*6, and fourth corner conductor 124*d*6 of second conducting pattern layer 3204*b* includes the second switch connector portion, the second connecting arm portion, the second x-arm portion, and the second y-arm portion, where the second x-arm portion and the second y-arm portion form a 90 degree corner, and the second connecting arm portion bisects the 90 degree corner where the second x-arm portion and the second y-arm portion join each other. The second connecting arm portion joins the second x-arm portion and the second y-arm portion to the second switch connector portion. The second switch connector portion of each of first corner conductor 124*a*6, second corner conductor 124*b*6, third corner conductor 124*c*6, and fourth corner conductor 124*d*6 of second conducting pattern layer 3204*b* surrounds and connects each corner conductor to first via 302*a*2, second 302*b*2, third 302*c*2, and fourth 302*d*2, respectively. The second x-arm portion extends parallel to the x-axis, and the y-arm portion extends parallel to the second y-axis. Again, second conducting pattern layer 3204*b* is designed to maximally radiate at a higher frequency than first conducting pattern layer 3202*b*, and is thus smaller than first conducting pattern layer 3202*b*.

Though each pair of first conducting pattern layer 3202, 3202*a*, 3202*b* and second conducting pattern layer 3204, 3204*a*, 3204*b*, respectively, have a similar shape, in alternative embodiments, first conducting pattern layer 3202, 3202*a*, 3202*b* need not have a same shape as second conducting pattern layer 3204, 3204*a*, 3204*b*, respectively. For example, a fourth dual band phase shifting element may include first conducting pattern layer 3202 and second conducting pattern layer 3204*a*.

Figure 37:
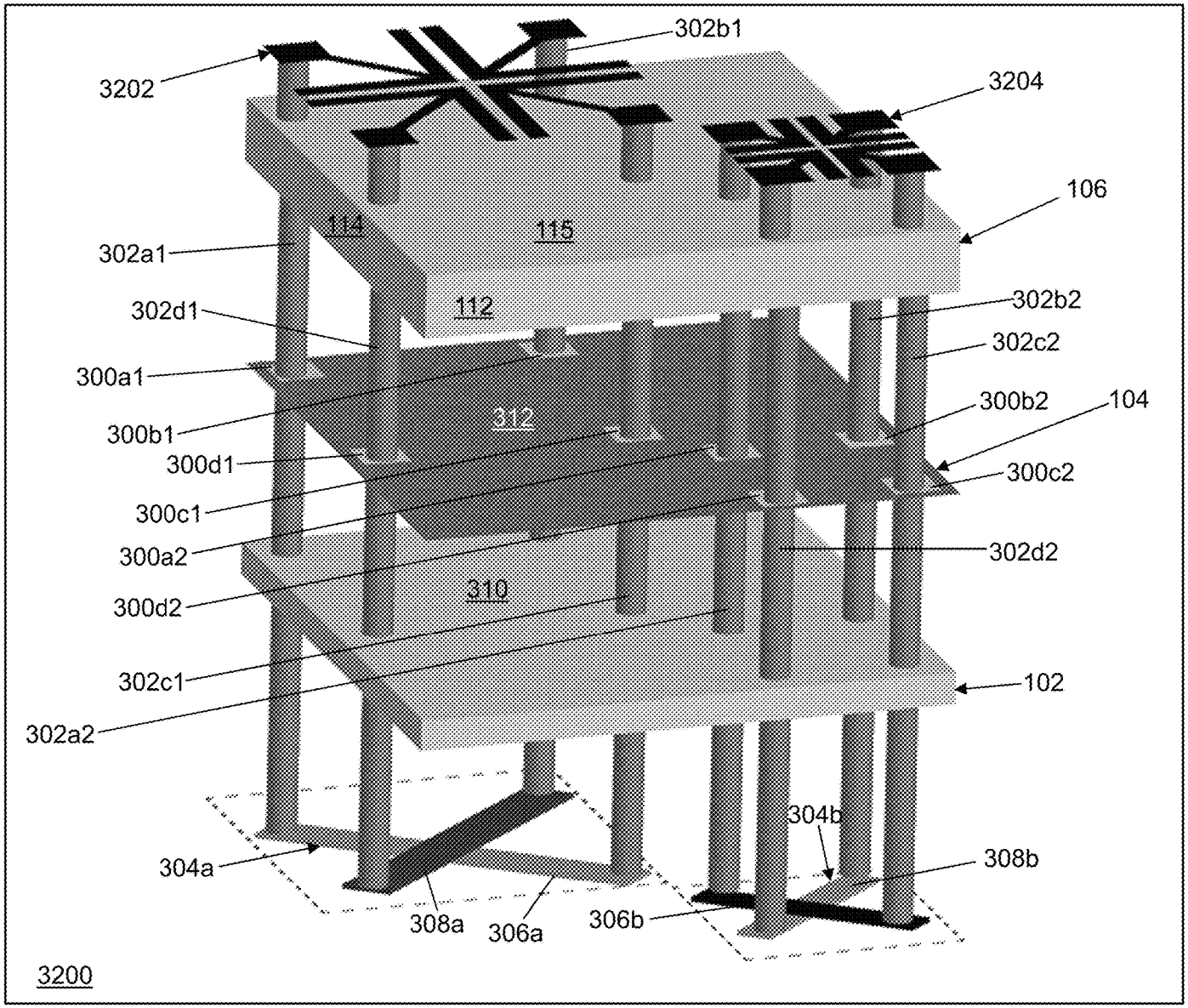
FIG. 37 depicts an exploded, perspective side view of the dual band phase shifting element of FIG. 32 in accordance with an illustrative embodiment.

Referring to FIG. 37, an exploded, perspective side view of phase shifting element 100 is shown in accordance with an illustrative embodiment. First via 302*a*1 and first via 302*a*2 are each an example of first via 302*a*. Second via 302*b*1 and second via 302*b*2 are each an example of second via 302*b*. Third via 302*c*1 and third via 302*c*2 are each an example of third via 302*c*. Fourth via 302*d*1 and fourth via 302*d*2 are each an example of fourth via 302*d*. First switch 304*a* and second switch 304*b* are each an example of switch 304.

In a first position, first throw arm 306*a* of first switch 304*a* is closed to electrically connect first via 302*a*1 and third via 302*c*1. In a second position, second throw arm 308*a* of first switch 304*a* is closed to electrically connect second via 302*b*1 and fourth via 302*d*1. First switch 304*a* is mounted to bottom surface 400 of first dielectric layer 102.

First via 302*a*1 forms an electrical connection between first throw arm 306*a* of first switch 304*a* through first dielectric layer 102, conducting layer 104, and second dielectric layer 106 to form an electronic circuit. First via 302*a*1 is formed of a conductive material. A first dielectric patch 300*a*1 is formed through conducting layer 104 of a dielectric material. First via 302*a*1 extends generally parallel to the z-axis through first dielectric patch 300*a*1.

Second via 302*b*1 forms an electrical connection between second throw arm 308*a* of first switch 304*a* through first dielectric layer 102, conducting layer 104, and second dielectric layer 106 to form an electronic circuit. Second via 302*b*1 is formed of a conductive material. A second dielectric patch 300*b*1 is formed through conducting layer 104 of a dielectric material. Second via 302*b*1 extends generally parallel to the z-axis through second dielectric patch 300*b*1.

Third via 302*c*1 forms an electrical connection between first throw arm 306*a* of first switch 304*a* through first dielectric layer 102, conducting layer 104, and second dielectric layer 106 to form an electronic circuit. Third via 302*c*1 is formed of a conductive material. A third dielectric patch 300*c*1 is formed through conducting layer 104 of a dielectric material. Third via 302*c*1 extends generally parallel to the z-axis through third dielectric patch 300*c*1.

Fourth via 302*d*1 forms an electrical connection between second throw arm 308*a* of first switch 304*a* through first dielectric layer 102, conducting layer 104, and second dielectric layer 106 to form an electronic circuit. Fourth via 302*d*1 is formed of a conductive material. A fourth dielectric patch 300*d*1 is formed through conducting layer 104 of a dielectric material. Fourth via 302*d*1 extends generally parallel to the z-axis through fourth dielectric patch 300*d*1.

Similarly, in a first position, first throw arm 306*b* of second switch 304*b* is closed to electrically connect first via 302*a*2 and third via 302*c*2. In a second position, second throw arm 308*b* of second switch 304*b* is closed to electrically connect second via 302*b*2 and fourth via 302*d*2. Second switch 304*b* is mounted to bottom surface 400 of first dielectric layer 102.

First via 302*a*2 forms an electrical connection between first throw arm 306*b* of second switch 304*b* through first dielectric layer 102, conducting layer 104, and second dielectric layer 106 to form an electronic circuit. First via 302*a*2 is formed of a conductive material. A first dielectric patch 300*a*2 is formed through conducting layer 104 of a dielectric material. First via 302*a*2 extends generally parallel to the z-axis through first dielectric patch 300*a*2.

Second via 302*b*2 forms an electrical connection between second throw arm 308*b* of second switch 304*b* through first dielectric layer 102, conducting layer 104, and second dielectric layer 106 to form an electronic circuit. Second via

302*b*2 is formed of a conductive material. A second dielectric patch 300*b*2 is formed through conducting layer 104 of a dielectric material. Second via 302*b*2 extends generally parallel to the z-axis through second dielectric patch 300*b*2.

Third via 302*c*2 forms an electrical connection between first throw arm 306*b* of second switch 304*b* through first dielectric layer 102, conducting layer 104, and second dielectric layer 106 to form an electronic circuit. Third via 302*c*2 is formed of a conductive material. A third dielectric patch 300*c*2 is formed through conducting layer 104 of a dielectric material. Third via 302*c*2 extends generally parallel to the z-axis through third dielectric patch 300*c*2.

Fourth via 302*d*2 forms an electrical connection between second throw arm 308*b* of second switch 304*b* through first dielectric layer 102, conducting layer 104, and second dielectric layer 106 to form an electronic circuit. Fourth via 302*d*2 is formed of a conductive material. A fourth dielectric patch 300*d*2 is formed through conducting layer 104 of a dielectric material. Fourth via 302*d*2 extends generally parallel to the z-axis through fourth dielectric patch 300*d*2.

Again, a combined electrical path length of first connecting arm 128*a*1 and first via 302*a*1 is approximately $\lambda_1/4$ and includes arm length 208 that defines a length of first connecting arm 128*a*1 and third thickness 118, third thickness 117, and third thickness 116 that define a length of first via 302*a*1. Similarly, a combined electrical path length of second connecting arm 128*b*1 and second via 302*b*1 is approximately $\lambda_1/4$. Similarly, a combined electrical path length of third connecting arm 128*c*1 and third via 302*c*1 is approximately $\lambda_1/4$. Similarly, a combined electrical path length of fourth connecting arm 128*d*1 and fourth via 302*d*1 is approximately $\lambda_1/4$. $\lambda_1$ is the wavelength in free space at the first frequency of operation.

Similarly, a combined electrical path length of first connecting arm 128*a*2 and first via 302*a*2 is approximately $\lambda_2/4$ and includes arm length 208 that defines a length of first connecting arm 128*a*2 and third thickness 118, third thickness 117, and third thickness 116 that define a length of first via 302*a*2. Similarly, a combined electrical path length of second connecting arm 128*b*2 and second via 302*b*2 is approximately $\lambda_2/4$. Similarly, a combined electrical path length of third connecting arm 128*c*2 and third via 302*c*2 is approximately $\lambda_2/4$. Similarly, a combined electrical path length of fourth connecting arm 128*d*2 and fourth via 302*d*2 is approximately $\lambda_2/4$. $\lambda_2$ is the wavelength in free space at the second frequency of operation.

Again, an electrical path length of first throw arm 306*a* of first switch 304*a*, of second throw arm 308*a* of first switch 304*a*, of first throw arm 306*b* second switch 304*b*, and of second throw arm 308*b* of second switch 304*b* can be set in the range from $\lambda_1/100$ to $\lambda_1/5$ or $\lambda_2/100$ to $\lambda_2/5$ (e.g. based on a range of physical dimensions of several commercial electronic switches and PIN diodes). The electrical path length for the currents of first switch 304*a* and of second switch 304*b* is included in a total electrical path length for each connected pair of arms (e.g., first connecting arm 128*a*1 and first via 302*a*1 connected to third connecting arm 128*c*1 and third via 302*c*1) when connected by first throw arm 306*a* or second throw arm 308*a* of first switch 304*a* or connected by first throw arm 306*b* or second throw arm 308*b* of second switch 304*b*. The total electrical path length of each connected pair of arms is approximately half a wavelength.

Figure 38B:
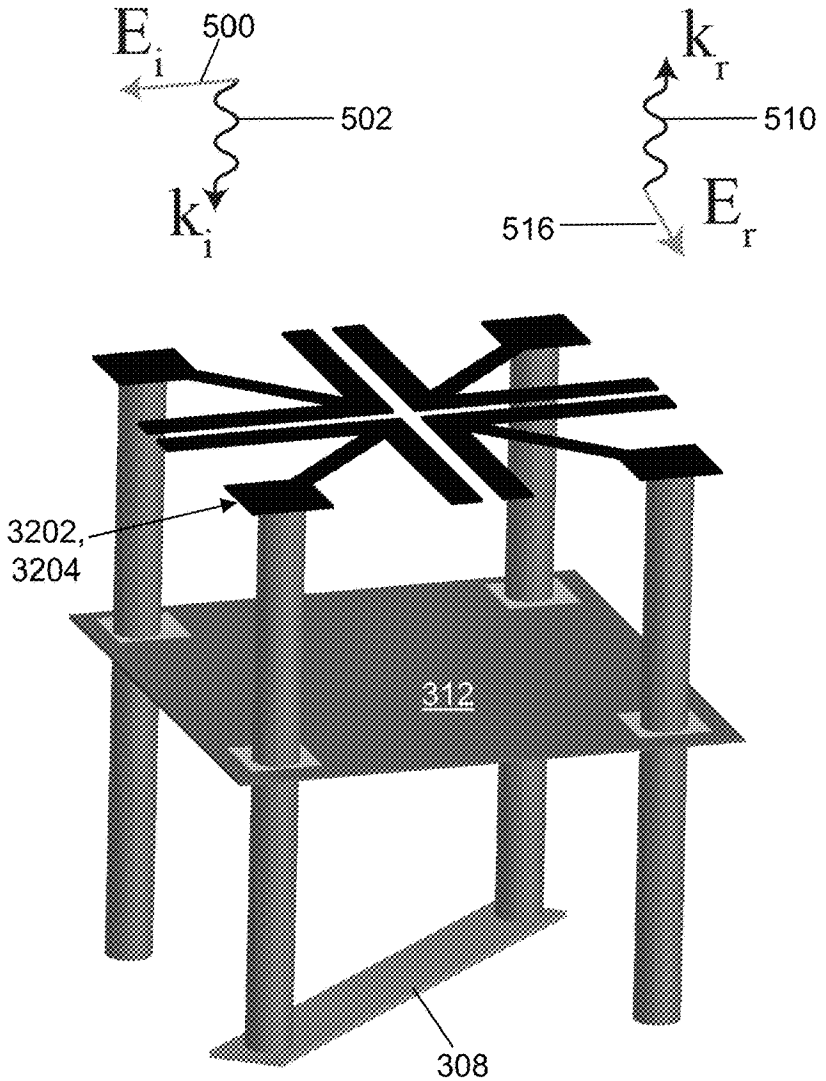
FIG. 38B depicts a perspective side view of the single band phase shifting element of FIG. 34 with dielectric material removed and with electric field directions shown based on the second switch position in accordance with an illustrative embodiment.
Figure 38A:
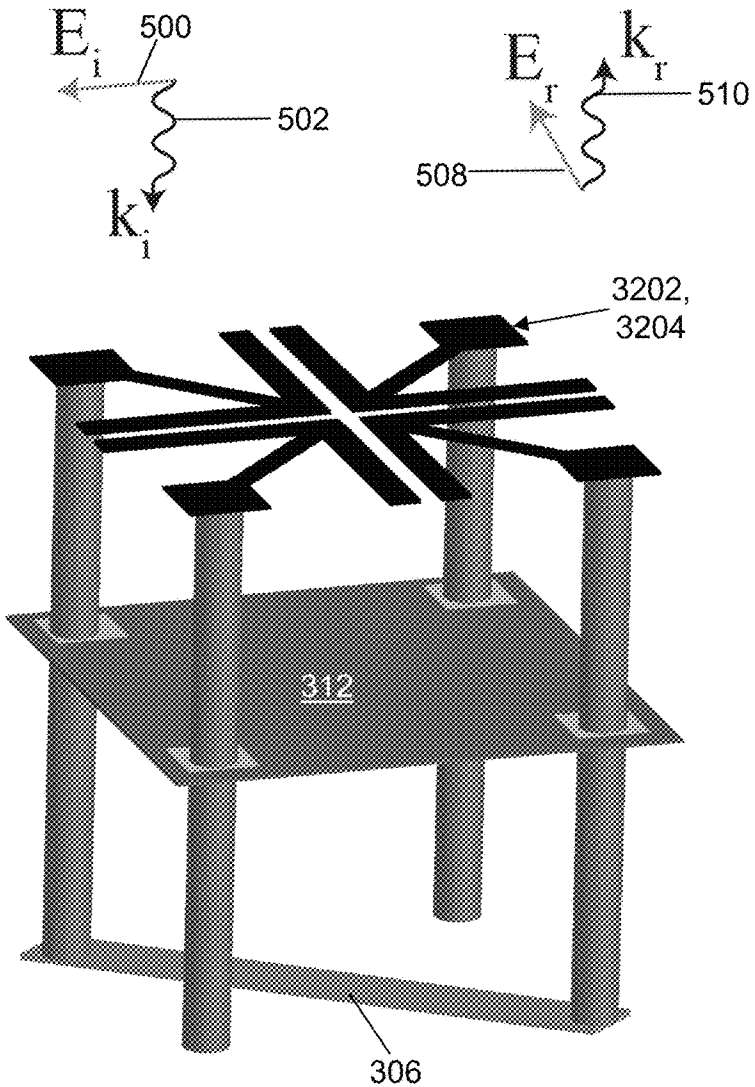
FIG. 38A depicts a perspective side view of the single band phase shifting element of FIG. 34 with dielectric material removed and with electric field directions shown based on the first switch position in accordance with an illustrative embodiment.

Referring to FIG. 38A, the first position that defines the bit zero configuration is shown in accordance with an illustrative embodiment. In the first position, first throw arm 306*a* of first switch 304*a* or first throw arm 306*b* of second switch 304*b* is closed to electrically connect first via 302*a*1 and third via 302*c*1 and first via 302*a*2 and third via 302*c*2, respectively, thereby electrically connecting first corner conductor 124*a*1 to third corner conductor 124*c*1 or electrically connecting first corner conductor 124*a*2 to third corner conductor 124*c*2, respectively. When first connecting arm 128*a*1 and third connecting arm 128*c*1 are electrically connected via first throw arm 306*a* of first switch 304*a* and/or when first connecting arm 128*a*2 and third connecting arm 128*c*2 are electrically connected via first throw arm 306*b* of second switch 304*b*, a total electrical length of an extended electrical pathway is approximately half a wavelength resulting in very small currents flowing on first connecting arm 128*a*2 and third connecting arm 128*c*2 and/or on first connecting arm 128*a*2 and third connecting arm 128*c*2 and large currents flowing on first throw arm 306*a* and first via 302*a*1 and third via 302*c*1 and/or on first throw arm 306*b* and first via 302*a*2 and third via 302*c*2, thus deactivating the polarization rotating effect of these pairs of arms.

On the other hand, second connecting arm 128*b*1 and fourth connecting arm 128*d*1 and/or second connecting arm 128*b*2 and fourth connecting arm 128*d*2 are electrically isolated, and the electrical length of each electrical pathway of second corner conductor 124*b*1 and fourth corner conductor 124*d*1 and/or of second corner conductor 124*b*2 and of fourth corner conductor 124*d*2 are approximately a quarter wavelength, which results in large currents flowing on second connecting arm 128*b*1 and fourth connecting arm 128*d*1 and/or on second connecting arm 128*b*2 and fourth connecting arm 128*d*2 as indicated in FIG. 38A. For an incident wave with incident electric field $E_i$ 500 in the −x direction parallel to the x-axis, a periodic structure consisting of dual band phase shifting elements 3200, 3200*a*, 3200*b* in the bit zero configuration rotates the polarization of the reflected wave by 90° resulting in a reflected wave with reflected electric field $E_r$ 508 in the −y direction parallel to the y-axis. Again, first incident wave vector $k_i$ 502 points in the direction of incident wave propagation, and first reflected wave vector $k_r$ 510 points in the direction of reflected wave propagation. The magnitude of first incident wave vector $k_i$ 502 and of first reflected wave vector $k_r$ 510 are $2\pi/\lambda_1$ or $2\pi/\lambda_2$.

Referring to FIG. 38B, the second position that defines the bit one configuration is shown in accordance with an illustrative embodiment. In the second position, second throw arm 308*a* of first switch 304*a* and/or second throw arm 308*b* of second switch 304*b* is closed to electrically connect second via 302*b*1 and fourth via 302*d*1 and/or second via 302*b*2 and fourth via 302*d*2 thereby electrically connecting second corner conductor 124*b*1 to fourth corner conductor 124*d*1 and/or second corner conductor 124*b*2 to fourth corner conductor 124*d*2, respectively. When second connecting arm 128*b*1 and fourth connecting arm 128*d*1 and/or when second connecting arm 128*b*2 and fourth connecting arm 128*d*2 are electrically connected via second throw arm 308*a* of first switch 304*a* and/or via second throw arm 308*b* of second switch 304*b*, respectively, a total electrical length of an extended electrical pathway is approximately half a wavelength. This results in very small currents flowing on second connecting arm 128*b*1 and fourth connecting arm 128*d*1 and/or on second connecting arm 128*b*2 and fourth connecting arm 128*d*2 and large currents flowing on second throw arm 308*a* and second via 302*b*1 and fourth via 302*d*1 and/or on second throw arm 308*b* and second via 302*b*2 and fourth via 302*d*2 thus deactivating the polarization rotating effect of these pairs of arms.

On the other hand, first connecting arm 128*a*1 and third connecting arm 128*c*1 and/or first connecting arm 128*a*2 and third connecting arm 128*c*2 are electrically isolated, and the electrical length of each electrical pathway of first corner conductor 124*a*1 and third corner conductor 124*c*1 and/or of first corner conductor 124*a*2 and third corner conductor 124*c*2 is approximately a quarter wavelength, which results in large currents flowing on first connecting arm 128*a*1 and third connecting arm 128*c*1 and/or first connecting arm 128*a*2 and third connecting arm 128*c*2, respectively, as indicated in FIG. 38B. For the incident wave with the incident electric field $E_i$ 500 in the −x direction parallel to the x-axis, a periodic structure consisting of dual band phase shifting elements 3200, 3200*a*, 3200*b* in the bit one configuration rotates the polarization of the reflected wave by −90° resulting in a reflected wave with reflected electric field $E_r$ 516 in the +y direction parallel to the y-axis.

As a result, depending on whether each single band phase shifting element of dual band phase shifting elements 3200, 3200*a*, 3200*b* is in the bit zero configuration or in the bit one configuration based on the position of the throw arms of first switch 304*a* and of second switch 304*b*, each single band phase shifting element of dual band phase shifting elements 3200, 3200*a*, 3200*b* rotates the polarization of the reflected electric field by +90° or by −90° with respect to the polarization of the incident electric field. As a result, the two different modes supported by each single band phase shifting element of dual band phase shifting elements 3200, 3200*a*, 3200*b* provides reflected electric field $E_r$ 508 and reflected electric field $E_r$ 516 that are in opposite directions as shown in FIGS. 38A and 38B creating a phase difference of 180° between the reflected waves in these modes.

Figure 39A:
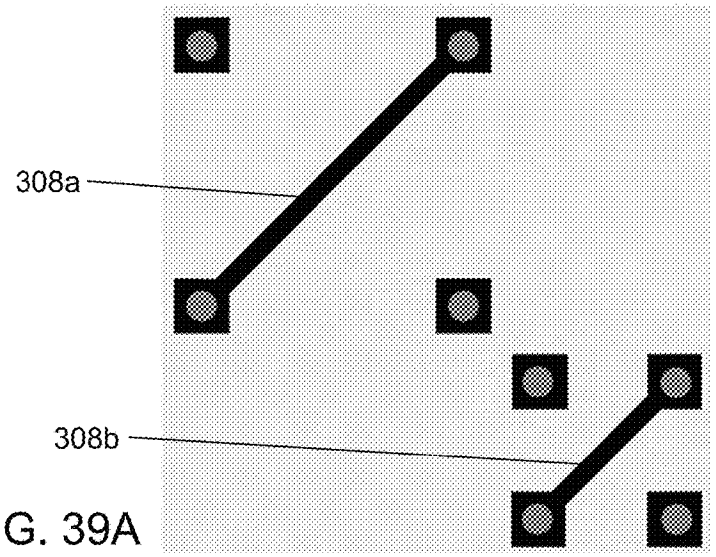
FIG. 39A depicts a bottom view of the dual band phase shifting element of FIG. 32, 35 or 36 showing the switch of both single band phase shifting elements in the first switch position in accordance with an illustrative embodiment.

Referring to FIG. 39A, a bottom view of dual band phase shifting element 3200, second dual band phase shifting element 3200*a*, and third dual band phase shifting element 3200*b* is shown with second throw arm 308*a* of first switch 304*a* and second throw arm 308*b* of second switch 304*b* in the closed position in accordance with an illustrative embodiment.

Figure 39B:
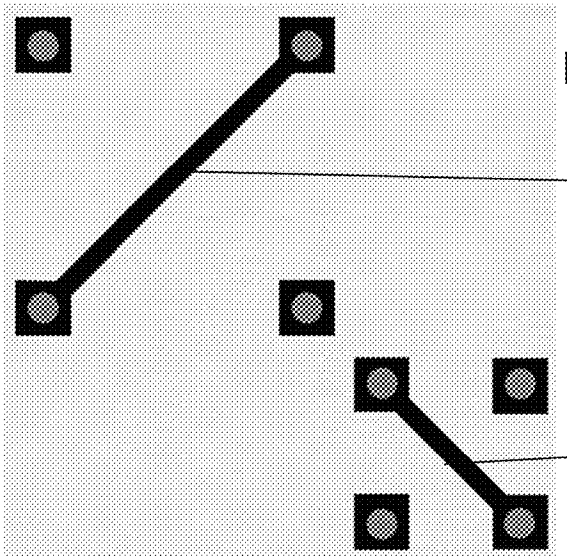
FIG. 39B depicts a bottom view of the dual band phase shifting element of FIG. 32, 35 or 36 showing the switch of a lower frequency band phase shifting element in the first switch position and the switch of a higher frequency band phase shifting element in the second switch position in accordance with an illustrative embodiment.

Referring to FIG. 39B, a bottom view of dual band phase shifting element 3200, second dual band phase shifting element 3200*a*, and third dual band phase shifting element 3200*b* is shown with second throw arm 308*a* of first switch 304*a* in the closed position and with first throw arm 306*b* of second switch 304*b* in the closed position in accordance with an illustrative embodiment.

Figure 39C:
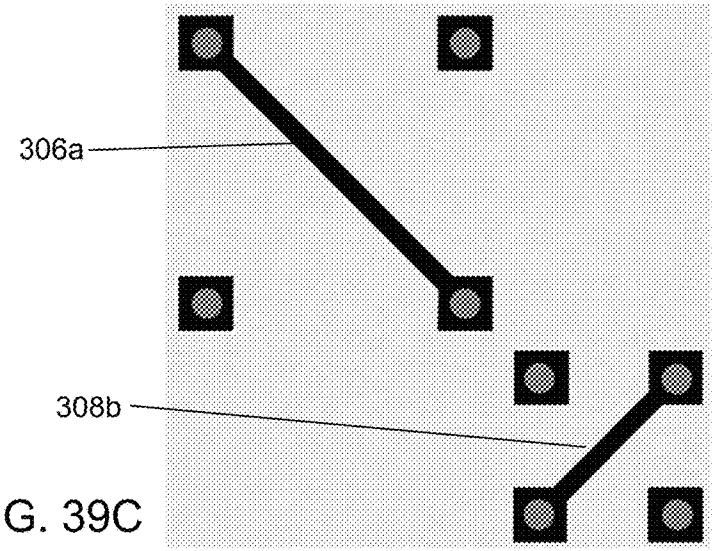
FIG. 39C depicts a bottom view of the dual band phase shifting element of FIG. 32, 35 or 36 showing the switch of the lower frequency band phase shifting element in the second switch position and the switch of the higher frequency band phase shifting element in the first switch position in accordance with an illustrative embodiment.

Referring to FIG. 39C, a bottom view of dual band phase shifting element 3200, second dual band phase shifting element 3200*a*, and third dual band phase shifting element 3200*b* is shown with first throw arm 306*a* of first switch 304*a* in the closed position and with second throw arm 308*b* of second switch 304*b* in the closed position in accordance with an illustrative embodiment.

Figure 39D:
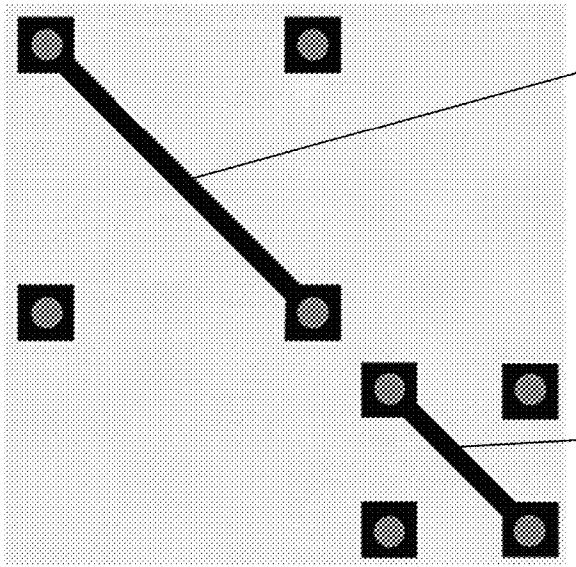
FIG. 39D depicts a bottom view of the dual band phase shifting element of FIG. 32, 35 or 36 showing the switch of both single band phase shifting elements in the second switch position in accordance with an illustrative embodiment.

Referring to FIG. 39D, a bottom view of dual band phase shifting element 3200, second dual band phase shifting element 3200*a*, and third dual band phase shifting element 3200*b* is shown with first throw arm 306*a* of first switch 304*a* and first throw arm 306*b* of second switch 304*b* in the closed position in accordance with an illustrative embodiment.

Figure 40A:
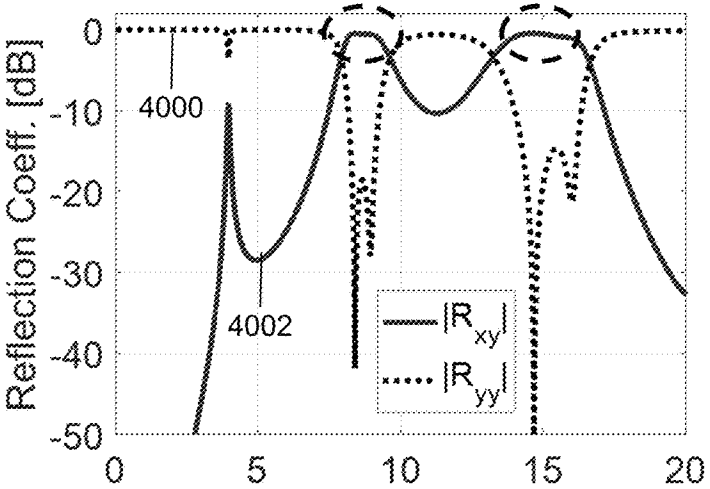
FIG. 40A depicts an X-Y reflection coefficient and a Y-Y reflection coefficient as a function of frequency of the dual band phase shifting element of FIG. 32 with the switch of both single band phase shifting elements in the first switch position in accordance with an illustrative embodiment.

Referring to FIG. 40A, an X-Y reflection coefficient curve 4000 and a Y-Y reflection coefficient curve 4002 show an X-Y reflection coefficient and a Y-Y reflection coefficient, respectively, as a function of frequency that result for dual band phase shifting element 3200 with second throw arm 308*a* of first switch 304*a* and second throw arm 308*b* of second switch 304*b* in the closed position in accordance with an illustrative embodiment. Incident electric field plane 1200 was polarized parallel to the y-axis.

Figure 40B:
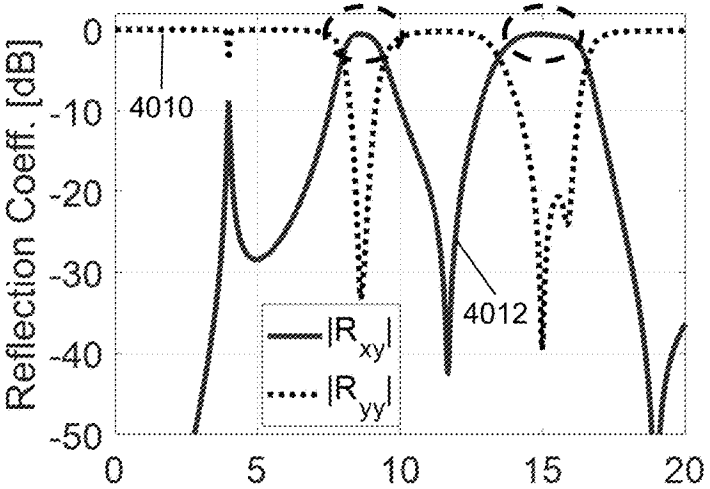
FIG. 40B depicts an X-Y reflection coefficient and a Y-Y reflection coefficient as a function of frequency of the dual band phase shifting element of FIG. 32 with the switch of the lower frequency band phase shifting element in the first switch position and the switch of the higher frequency band phase shifting element in the second switch position in accordance with an illustrative embodiment.

Referring to FIG. 40B, an X-Y reflection coefficient curve 4010 and a Y-Y reflection coefficient curve 4012 show an X-Y reflection coefficient and a Y-Y reflection coefficient, respectively, as a function of frequency that result for dual band phase shifting element 3200 with second throw arm 308*a* of first switch 304*a* in the closed position and with first throw arm 306*b* of second switch 304*b* in the closed position in accordance with an illustrative embodiment. Incident electric field plane 1200 was polarized parallel to the y-axis.

Figure 40C:
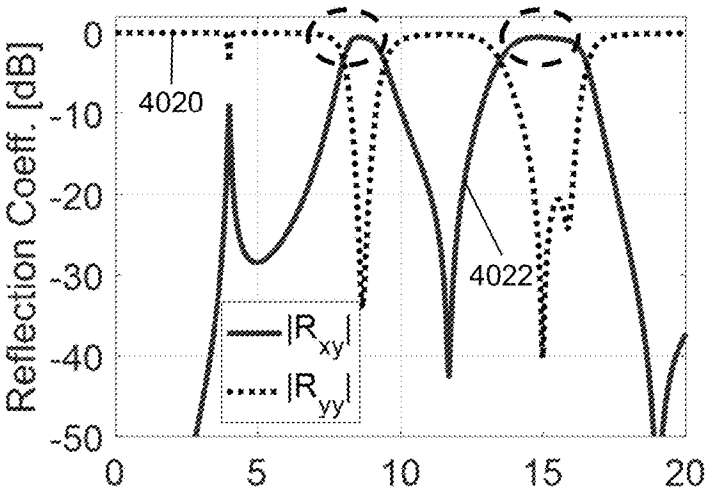
FIG. 40C depicts an X-Y reflection coefficient and a Y-Y reflection coefficient as a function of frequency of the dual band phase shifting element of FIG. 32 with the switch of the lower frequency band phase shifting element in the second switch position and the switch of the higher frequency band phase shifting element in the first switch position in accordance with an illustrative embodiment.

Referring to FIG. 40C, an X-Y reflection coefficient curve 4020 and a Y-Y reflection coefficient curve 4022 show an X-Y reflection coefficient and a Y-Y reflection coefficient, respectively, as a function of frequency that result for dual band phase shifting element 3200 with first throw arm 306*a* of first switch 304*a* in the closed position and with second throw arm 308*b* of second switch 304*b* in the closed position in accordance with an illustrative embodiment. Incident electric field plane 1200 was polarized parallel to the y-axis.

Figure 40D:
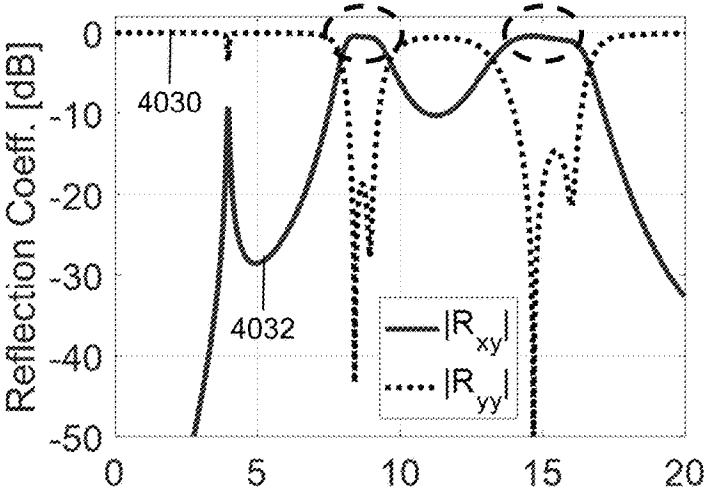
FIG. 40D depicts an X-Y reflection coefficient and a Y-Y reflection coefficient as a function of frequency of the dual band phase shifting element of FIG. 32 with the switch of both single band phase shifting elements in the second switch position in accordance with an illustrative embodiment.

Referring to FIG. 40D, an X-Y reflection coefficient curve 4030 and a Y-Y reflection coefficient curve 4032 show an X-Y reflection coefficient and a Y-Y reflection coefficient, respectively, as a function of frequency that result for dual band phase shifting element 3200 with first throw arm 306*a* of first switch 304*a* and first throw arm 306*b* of second switch 304*b* in the closed position in accordance with an illustrative embodiment. Incident electric field plane 1200 was polarized parallel to the y-axis. The dashed ovals in FIGS. 40A to 40D indicate the target first frequency and the target second frequency ranges.

Figure 41A:
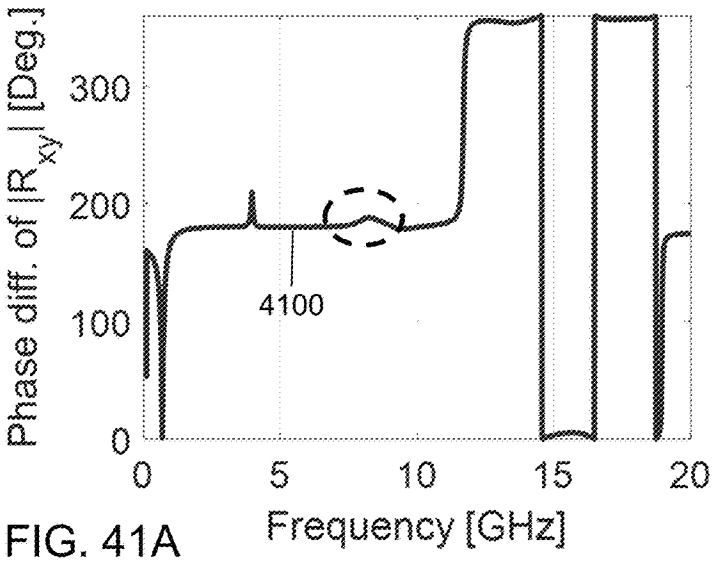
FIG. 41A depicts a phase difference between the dual band phase shifting element of FIG. 32 radiating (0,0) and (1,0) as a function of frequency in accordance with an illustrative embodiment.

Referring to FIG. 41A, a phase difference curve 4100 shows a phase difference as a function of frequency measured relative to dual band phase shifting element 3200 with second throw arm 308*a* of first switch 304*a* and second throw arm 308*b* of second switch 304*b* in the closed position and first throw arm 306*a* of first switch 304*a* and second throw arm 308*b* of second switch 304*b* in the closed position in accordance with an illustrative embodiment. A difference of 180° between a phase of IRA is achieved when switched between bit 0 and bit 1 at the first frequency band.

Figure 41B:
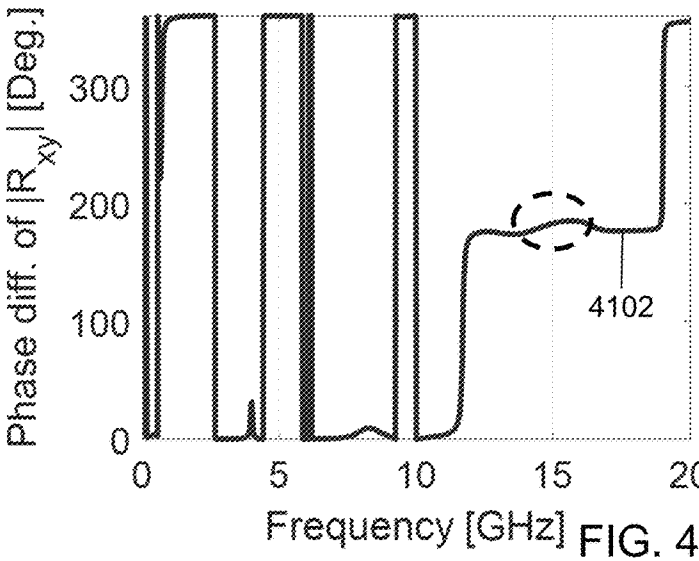
FIG. 41B depicts a phase difference between the dual band phase shifting element of FIG. 32 radiating (0,0) and (0,1) as a function of frequency in accordance with an illustrative embodiment.

Referring to FIG. 41B, a phase difference curve 4102 shows a phase difference as a function of frequency measured relative to dual band phase shifting element 3200 with second throw arm 308*a* of first switch 304*a* and second throw arm 308*b* of second switch 304*b* in the closed position and second throw arm 308*a* of first switch 304*a* and first throw arm 306*b* of second switch 304*b* in the closed position in accordance with an illustrative embodiment. A difference of 180° between a phase of $|R_{xy}|$ is achieved when switched between bit 0 and bit 1 at the second frequency band.

Figure 41C:
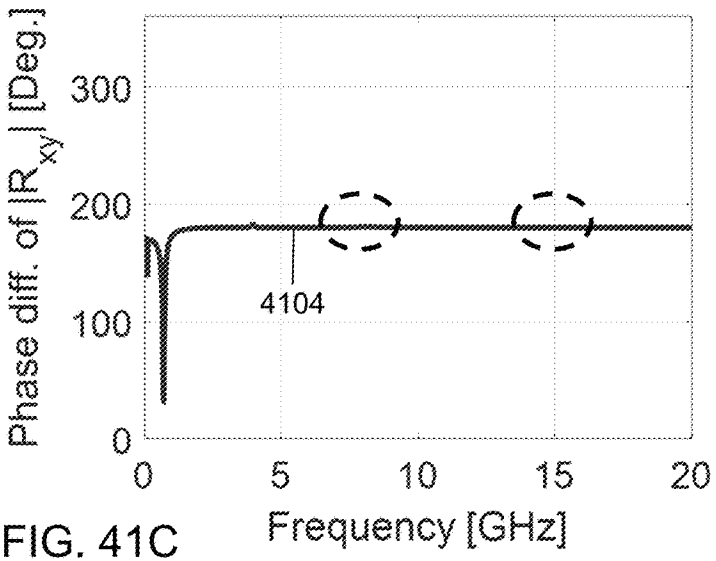
FIG. 41C depicts a phase difference between the dual band phase shifting element of FIG. 32 radiating (0,0) and (1,1) as a function of frequency in accordance with an illustrative embodiment.

Referring to FIG. 41C, a phase difference curve 4104 shows a phase difference as a function of frequency measured relative to dual band phase shifting element 3200 with second throw arm 308*a* of first switch 304*a* and second throw arm 308*b* of second switch 304*b* in the closed position and first throw arm 306*a* of first switch 304*a* and first throw arm 306*b* of second switch 304*b* in the closed position in accordance with an illustrative embodiment. A difference of 180° between a phase of $|R_{xy}|$ is achieved when switched between bit 0 and bit 1 at both the first frequency and the second frequency band.

Figure 41D:
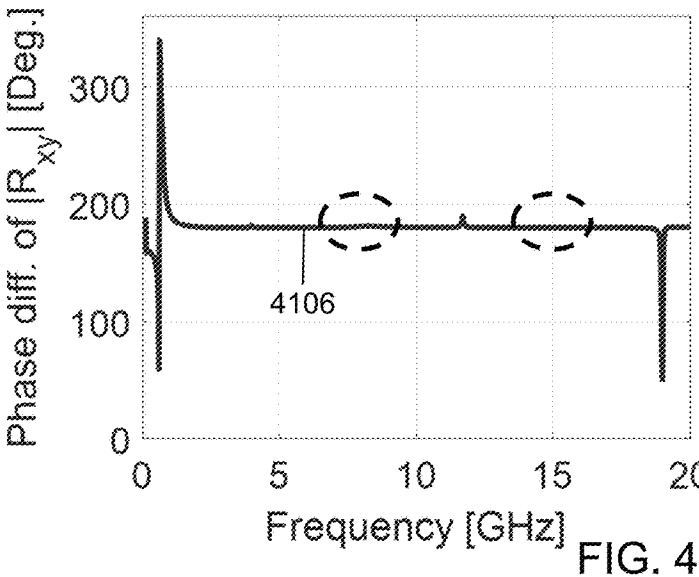
FIG. 41D depicts a phase difference between the dual band phase shifting element of FIG. 32 radiating (0,1) and (1,0) as a function of frequency in accordance with an illustrative embodiment.

Referring to FIG. 41D, a phase difference curve 4106 shows a phase difference as a function of frequency measured relative to dual band phase shifting element 3200 with second throw arm 308*a* of first switch 304*a* and first throw arm 306*b* of second switch 304*b* in the closed position and first throw arm 306*a* of first switch 304*a* and second throw arm 308*b* of second switch 304*b* in the closed position in accordance with an illustrative embodiment. A difference of 180° between a phase of $|R_{xy}|$ is achieved when switched between bit 0 and bit 1 at both the first frequency and the second frequency band.

Figure 42A:
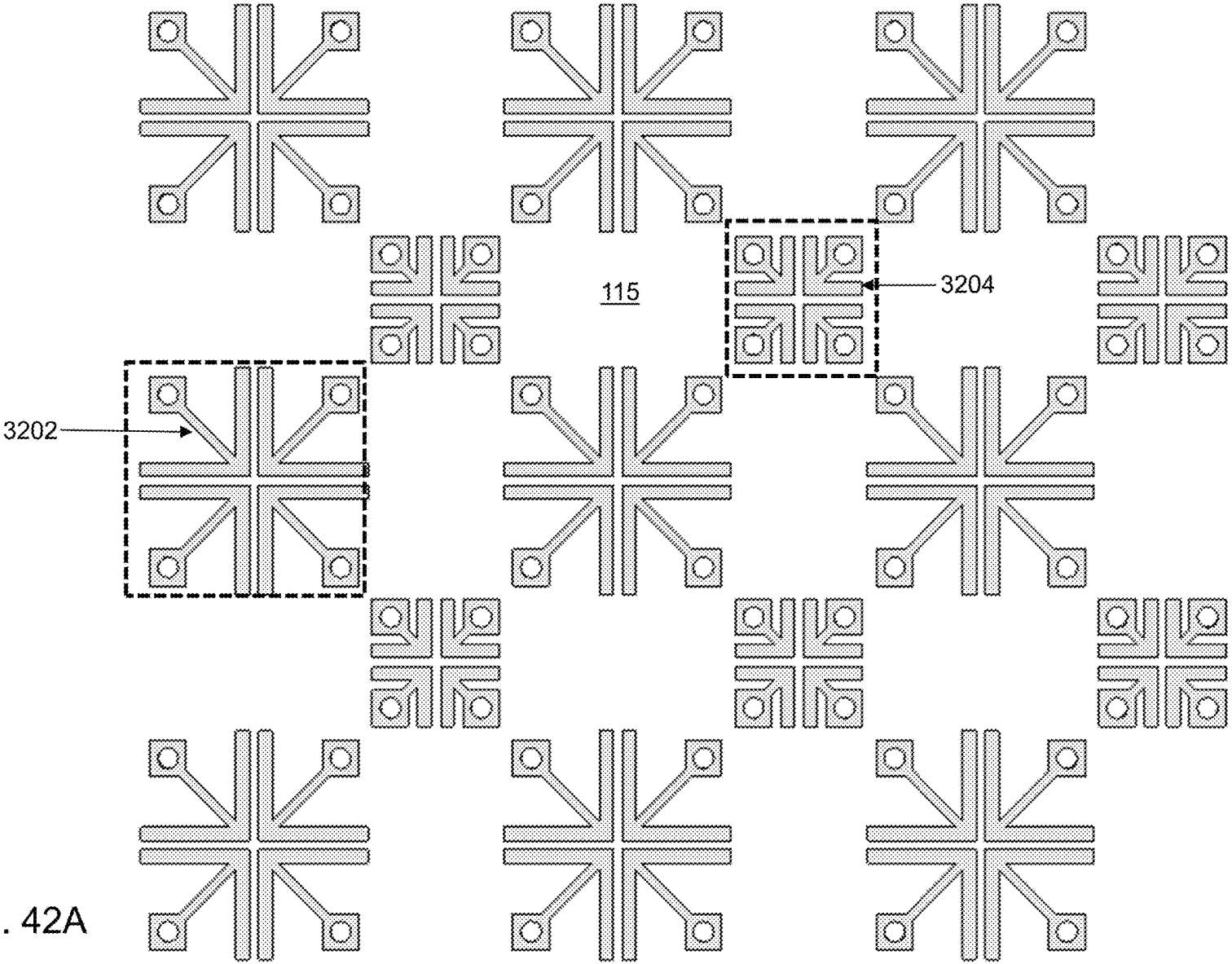
FIG. 42A depicts a top view of a plurality of dual band phase shifting elements of FIG. 32 arranged in an interleaved grid pattern in accordance with an illustrative embodiment.
Figure 42B:
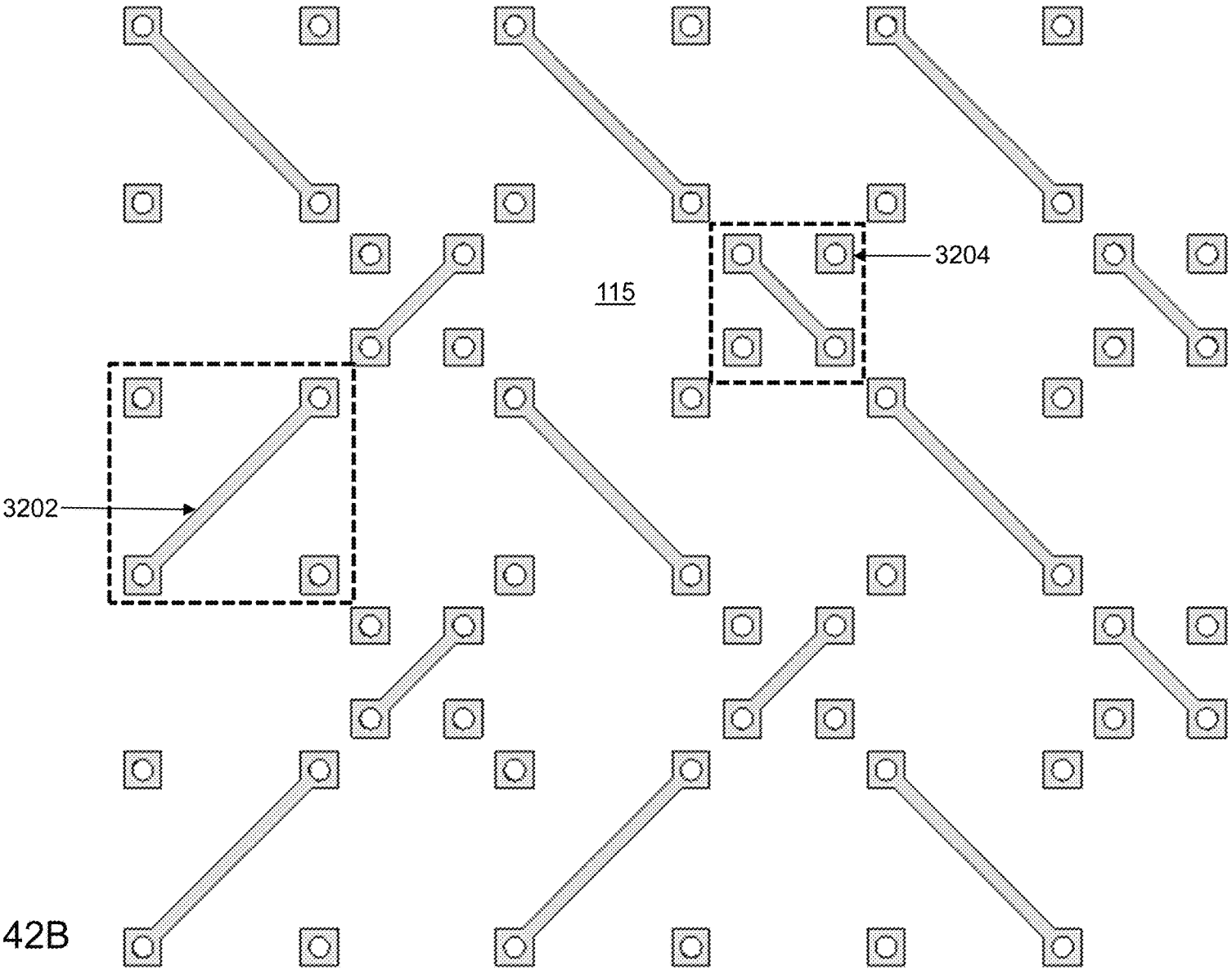
FIG. 42B depicts a bottom view of the plurality of dual band phase shifting elements of FIG. 42A arranged in an interleaved grid pattern in accordance with an illustrative embodiment.

Referring to FIG. 42A, a sample pattern of a plurality of first conducting pattern layers 3202 and a plurality of second conducting pattern layer 3204 on top surface 115 of second dielectric layer 106 is shown in accordance with an illustrative embodiment. Referring to FIG. 42B, a sample pattern of a plurality of first conducting pattern layers 3202 and a plurality of second conducting pattern layer 3204 on top surface 115 of second dielectric layer 106 is shown in accordance with an illustrative embodiment. The plurality of first conducting pattern layers 3202 and the plurality of second conducting pattern layer 3204 responsible for polarization rotation operation in the two frequency bands are interleaved in an array and designed to have minimum inter-band interference.

Dimensions for first conducting pattern layer 3202 and for second conducting pattern layer 3204 may be selected in a manner similar to that described above for phase shifting element 100 with $\lambda_1$ ($\lambda_1=c/f_1$) used for first conducting pattern layer 3202 operating at the first frequency $f_1$ and with $\lambda_2$ ($\lambda_2=c/f_2$) used for second conducting pattern layer 3204 operating at the second frequency $f_2$ instead of $\lambda_0$.

The plurality of first conducting pattern layers 3202 and the plurality of second conducting pattern layer 3204 were constructed in two embodiments to correspond with the first position and with the second position of first switch 304*a* and of second switch 304*b*. For simplicity of construction, each embodiment had a fixed position as the first position or the second position instead of using first switch 304*a* and of second switch 304*b*.

Illustrative dimensions for dual band phase shifting element 3200 were P=8 mm for length 120 and width 121, $l_1$=2.4 mm for arm length 208 of first conducting pattern layer 3202, $l_2$=1.3 mm for arm length 208 of second conducting pattern layer 3204, $w_2$=0.3 mm for corner arm width 204 of first conducting pattern layer 3202 and of second conducting pattern layer 3204, $w_1$=0.8 mm for second distance 3400 of first conducting pattern layer 3202 and of second conducting pattern layer 3204, =0.2 mm for first distance 200 of first conducting pattern layer 3202 and of second conducting pattern layer 3204, $h_1$=0.81 mm for first thickness 116, $h_2$=2.33 mm for second thickness 118. For illustration, each dual band phase shifting element 3200 can be fabricated using printed circuit board technology.

Reflective array antenna 704 was fabricated with dual band phase shifting element 3200 populating each pixel position of a 38×38 circular array having a physical aperture of 30.4 cm×30.4 cm to collimate a beam in a broadside direction. A first feed horn antenna radiating the first frequency and a second feed horn antenna radiating the second frequency were placed at a center of reflective array antenna 704 and at focal distance 712, $f_d$, from front face 705 of the plurality of first conducting pattern layers 3202 and the plurality of second conducting pattern layer 3204 populating reflective array antenna 704 as shown referring to FIG. 7. The first frequency was 8.7 GHz, and the second frequency was ~15 GHz. Incident electric field plane 1200 was polarized parallel to the y-axis.

Figure 51:
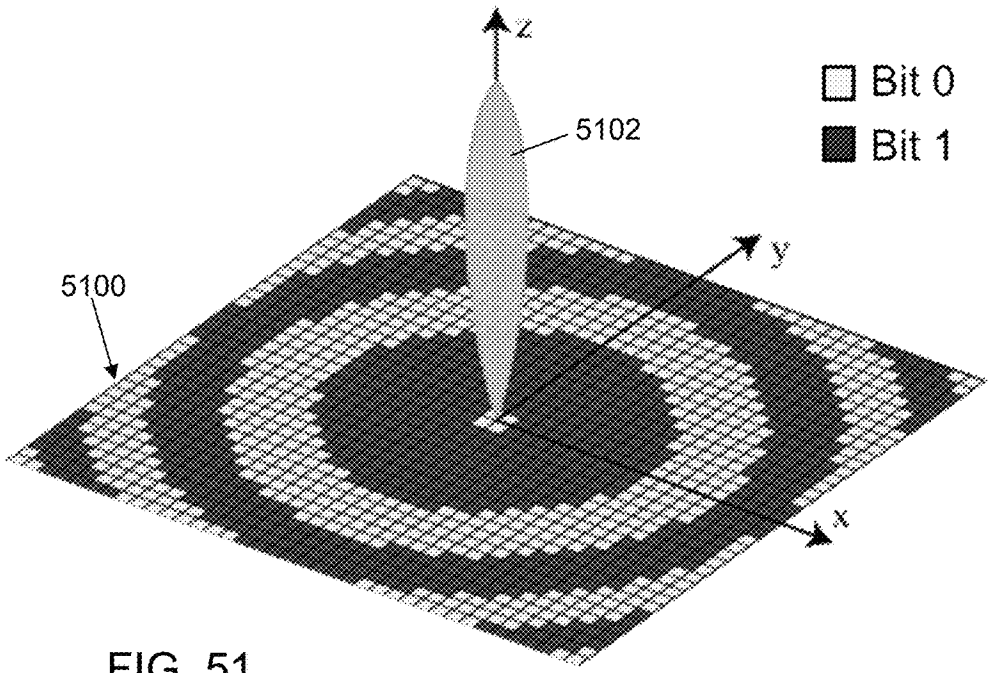
FIG. 51 depicts a main beam created using a first depicted pattern of a distribution of the switch position of the higher frequency band of the phase shifting element of FIG. 32 on the aperture of the reflective array antenna in accordance with an illustrative embodiment, where "bit 0" indicates the first switch position, and "bit 1" indicates the second switch position.

Referring to FIG. 51, a first pattern 5100 of a distribution of the switch position of the plurality of second conducting pattern layers 3204 arranged on reflective array antenna 704 is shown in accordance with an illustrative embodiment, where "bit 0" indicates the first switch position that defines the bit zero configuration and "bit 1" indicates the second switch position that defines the bit one configuration. First pattern 5100 resulted in a main beam 5102 that is broadside and was created using first pattern 5100 for the switch position of the plurality of second conducting pattern layers 3204.

Figure 52:
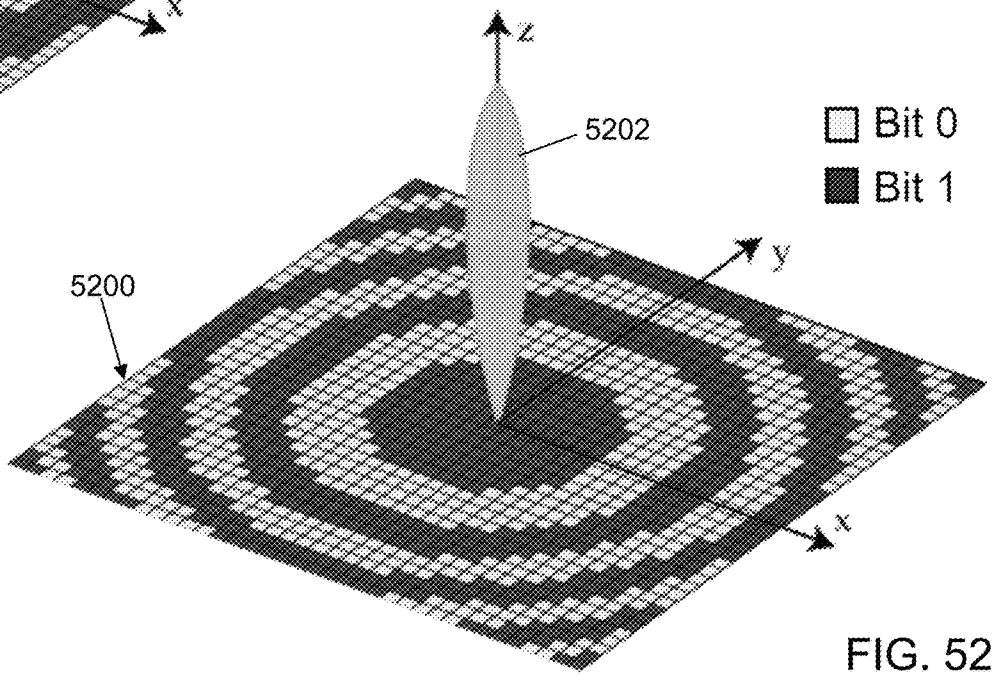
FIG. 52 depicts a main beam created using a first depicted pattern of a distribution of the switch position of the lower frequency band of the phase shifting element of FIG. 32 on the aperture of the reflective array antenna in accordance with an illustrative embodiment, where "bit 0" indicates the first switch position, and "bit 1" indicates the second switch position.

Referring to FIG. 52, a first pattern 5200 of a distribution of the switch position of the plurality of first conducting pattern layer 3202 arranged on reflective array antenna 704 is shown in accordance with an illustrative embodiment, where "bit 0" indicates the first switch position that defines the bit zero configuration and "bit 1" indicates the second switch position that defines the bit one configuration. First pattern 5200 resulted in a main beam 5202 that is broadside and was created using first pattern 5200 for the switch position of the plurality of first conducting pattern layer 3202. First pattern 5100 for the switch position of the plurality of second conducting pattern layers 3204 and first pattern 5200 for the switch position of the plurality of first conducting pattern layer 3202 is referred to herein as a first prototype.

Figure 43:
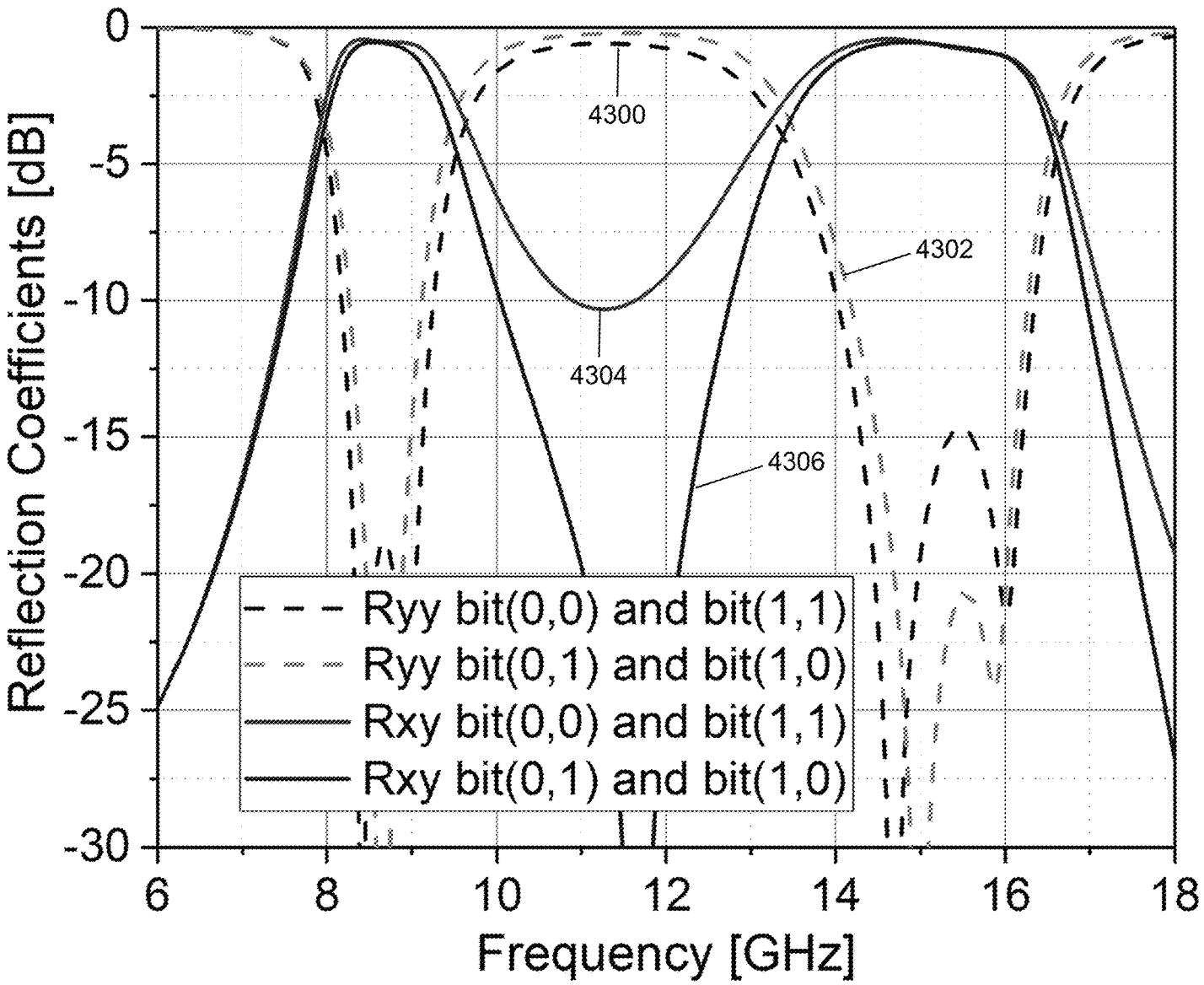
FIG. 43 depicts an X-Y reflection coefficient and a Y-Y reflection coefficient as a function of frequency of the dual band phase shifting element of FIG. 32 in accordance with an illustrative embodiment.

Referring to FIG. 43, a first simulated Y-Y reflection coefficient curve 4300 is shown as a function of frequency for dual band phase shifting element 3200 in states (0,0), and (1,1) in accordance with the illustrative design where (bite, bite) indicates the phase states for the first operating frequency associated with first conducting pattern layer 3202 and the second operating frequency associated with second conducting pattern layer 3204, respectively. A second simulated Y-Y reflection coefficient curve 4302 is shown as a function of frequency for dual band phase shifting element 3200 in states (1,0) and (0,1) in accordance with an illustrative design. A first simulated X-Y reflection coefficient curve 4304 is shown as a function of frequency for dual band phase shifting element 3200 in states (0,0), and (1,1) in accordance with an illustrative design. A second simulated X-Y reflection coefficient curve 4306 is shown as a function of frequency for dual band phase shifting element 3200 in states (1,0) and (0,1) in accordance with an illustrative fabrication. The results show little interference between first conducting pattern layer 3202 and the second conducting pattern layer 3204.

Figure 44:
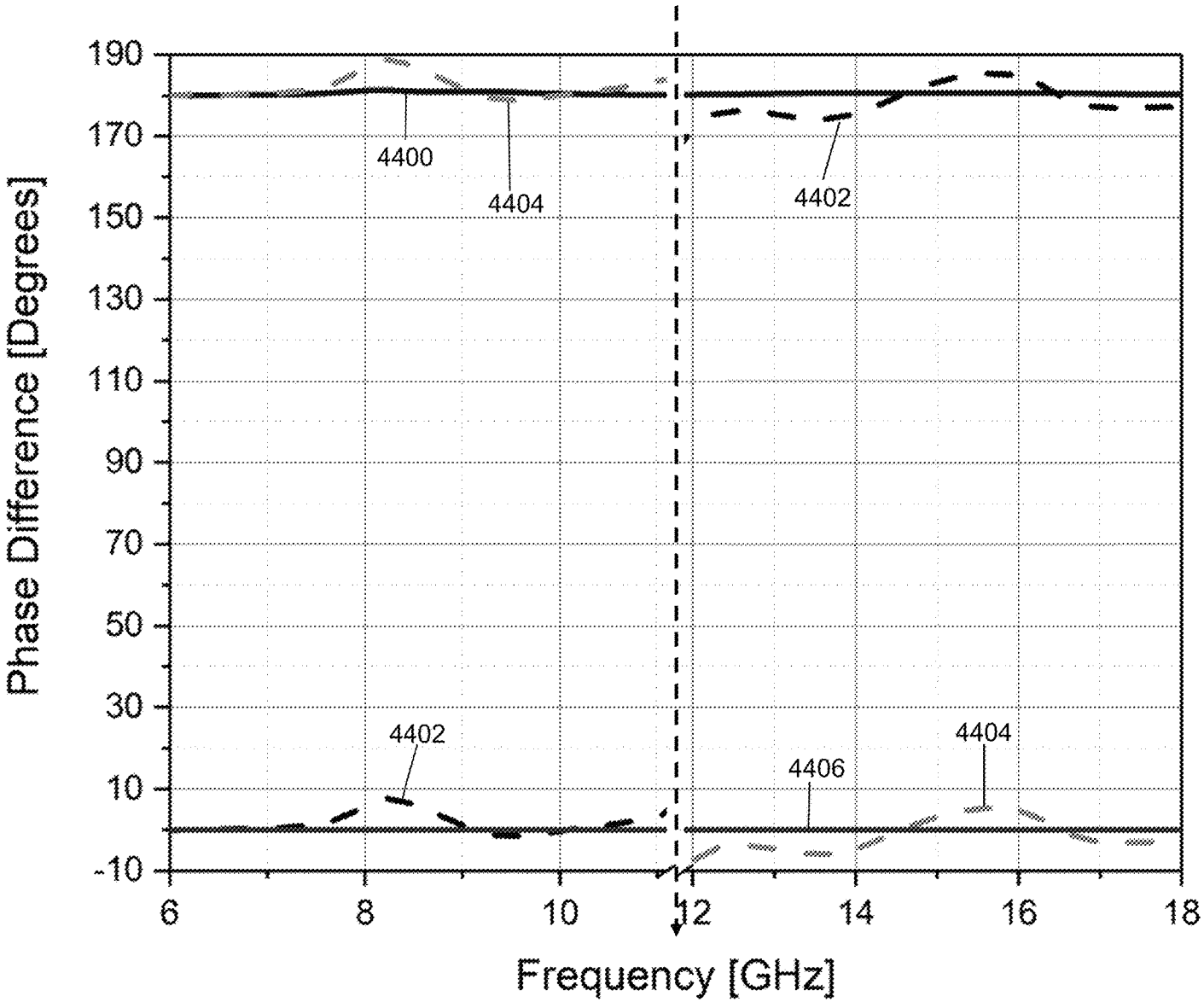
FIG. 44 depicts a phase difference between the dual band phase shifting element of FIG. 32 radiating (0,0), (1,0), (0,1), and (1,1) as a function of frequency in accordance with an illustrative embodiment.

Referring to FIG. 44, a simulated phase difference between dual band phase shifting element 3200 states (0,0), (1,0), (0,1), and (1,1) are shown as a function of frequency in accordance with the illustrative design. A first phase difference curve 4400 shows a phase difference as a function of frequency between state (0,0) and state (1,1) of dual band phase shifting element 3200. A difference of 180° is achieved between bit 0 and bit 1 in both the first and the second frequency bands.

A second phase difference curve 4402 shows a simulated phase difference as a function of frequency between state (1,0) and state (1,1) of dual band phase shifting element 3200 in accordance with an illustrative embodiment. A difference of 180° is achieved between bit 0 and bit 1 in the second frequency band. A difference of ~0° is achieved between bit 1 and bit 1 in the first frequency band.

A third phase difference curve 4404 shows a simulated phase difference as a function of frequency between state (0,1) and state (1,1) of dual band phase shifting element 3200 in accordance with an illustrative embodiment. A difference of 180° is achieved between bit 0 and bit 1 in the first frequency band. A difference of ~0° is achieved between bit 1 and bit 1 in the second frequency band.

A fourth phase difference curve 4406 shows a simulated phase difference as a function of frequency between state (1,1) and state (1,1) of dual band phase shifting element 3200 in accordance with an illustrative embodiment. A difference of 0° is achieved in both the first frequency and the second frequency bands.

Figure 45:
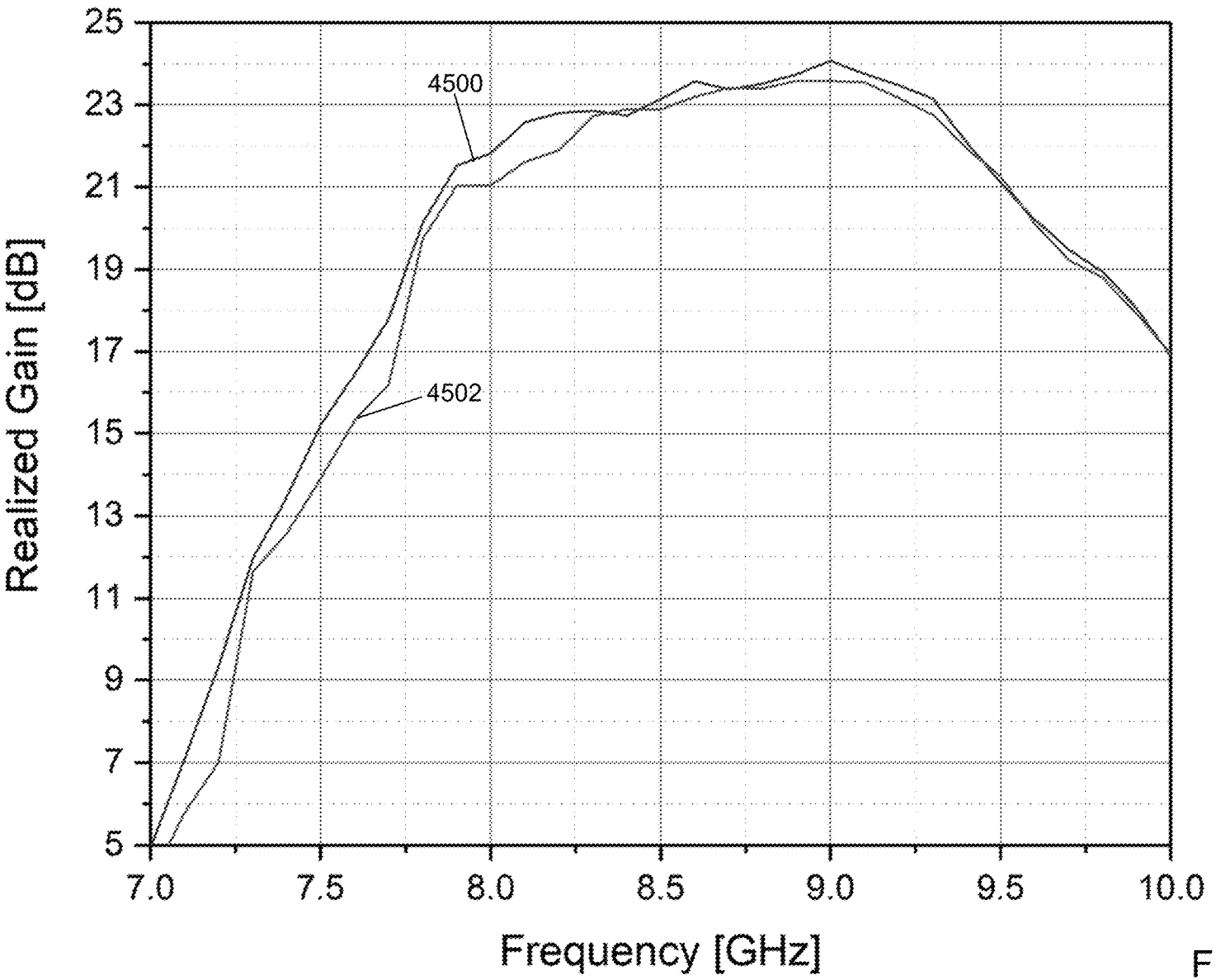
FIG. 45 depicts a comparison between a simulated and a measured realized gain as a function of frequency of the lower frequency band of the phase shifting element of FIG. 32 in accordance with an illustrative embodiment.
Figure 46:
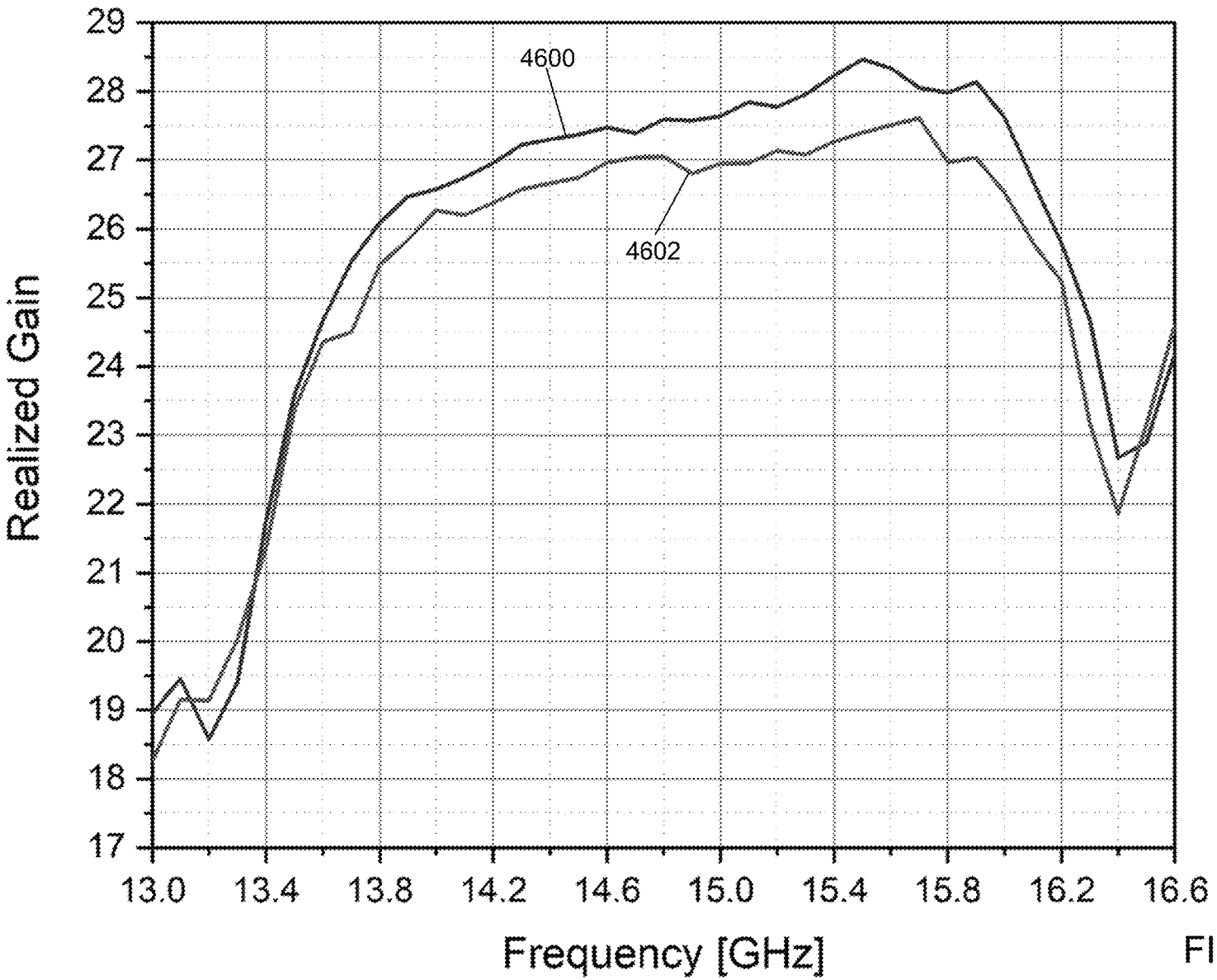
FIG. 46 depicts a comparison between a simulated and a measured realized gain as a function of frequency of the higher frequency band of the phase shifting element of FIG. 32 in accordance with an illustrative embodiment.

Referring to FIG. 45, a comparison between a simulated realized gain curve 4500 and a measured realized gain curve 4502 using the first prototype over the first frequency band. Referring to FIG. 46, a comparison between a simulated realized gain curve 4600 and a measured realized gain curve 4602 using the first prototype over the second frequency band. The results show good agreement between the simulation results and the measurement results for the first prototype.

Figure 47:
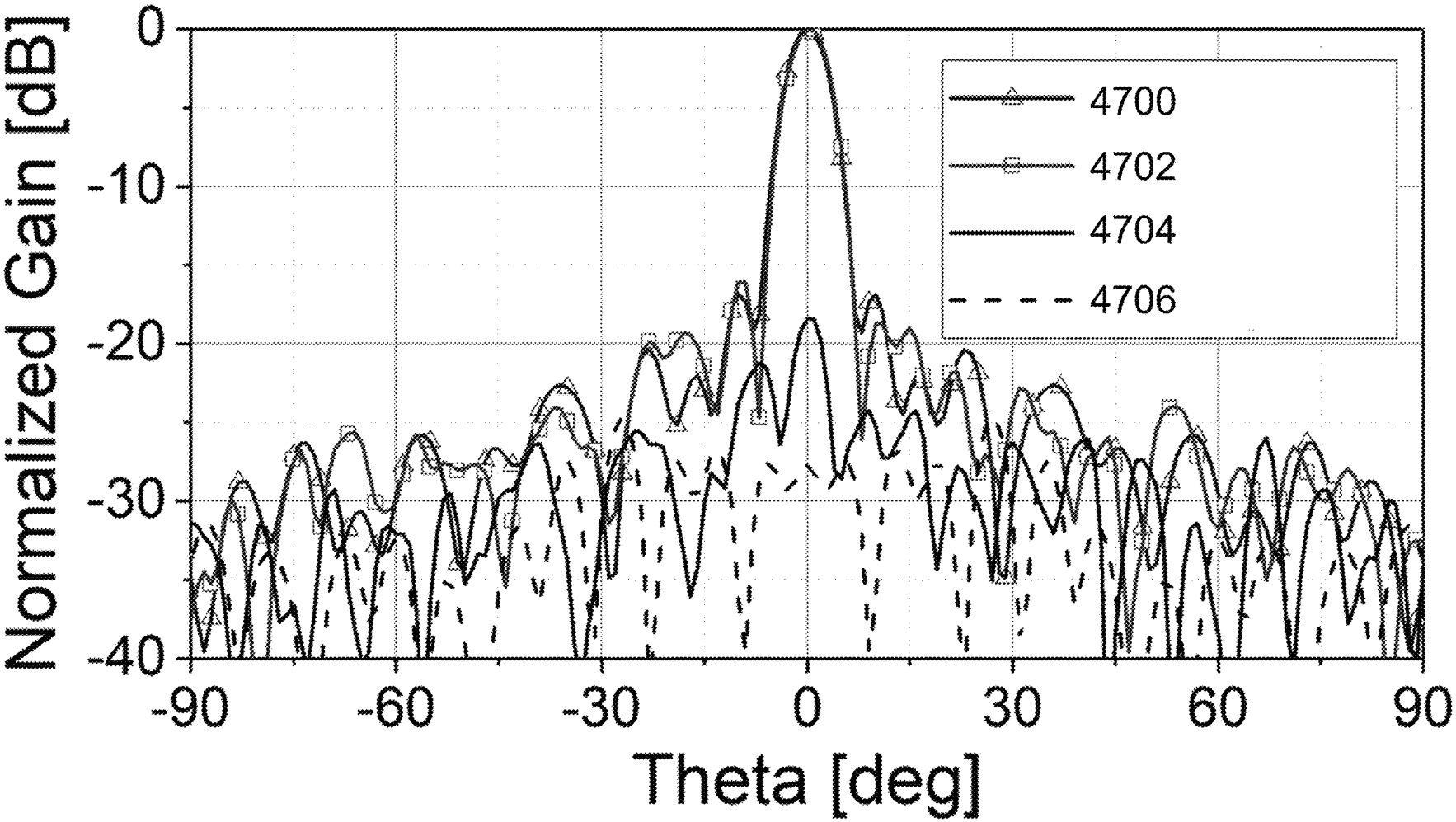
FIG. 47 depicts a comparison between a simulated and a measured normalized gain as a function of angle of the lower frequency band of the phase shifting element of FIG. 32 in accordance with an illustrative embodiment.

Referring to FIG. 47, a comparison between a simulated, normalized co-polarization gain curve 4700 and a measured, normalized co-polarization gain curve 4702 using the first prototype and between a simulated, normalized cross-polarization gain curve 4706 and a measured, normalized cross-polarization gain curve 4704 using the first prototype is shown as a function of zenith angle for the first prototype.

Figure 48:
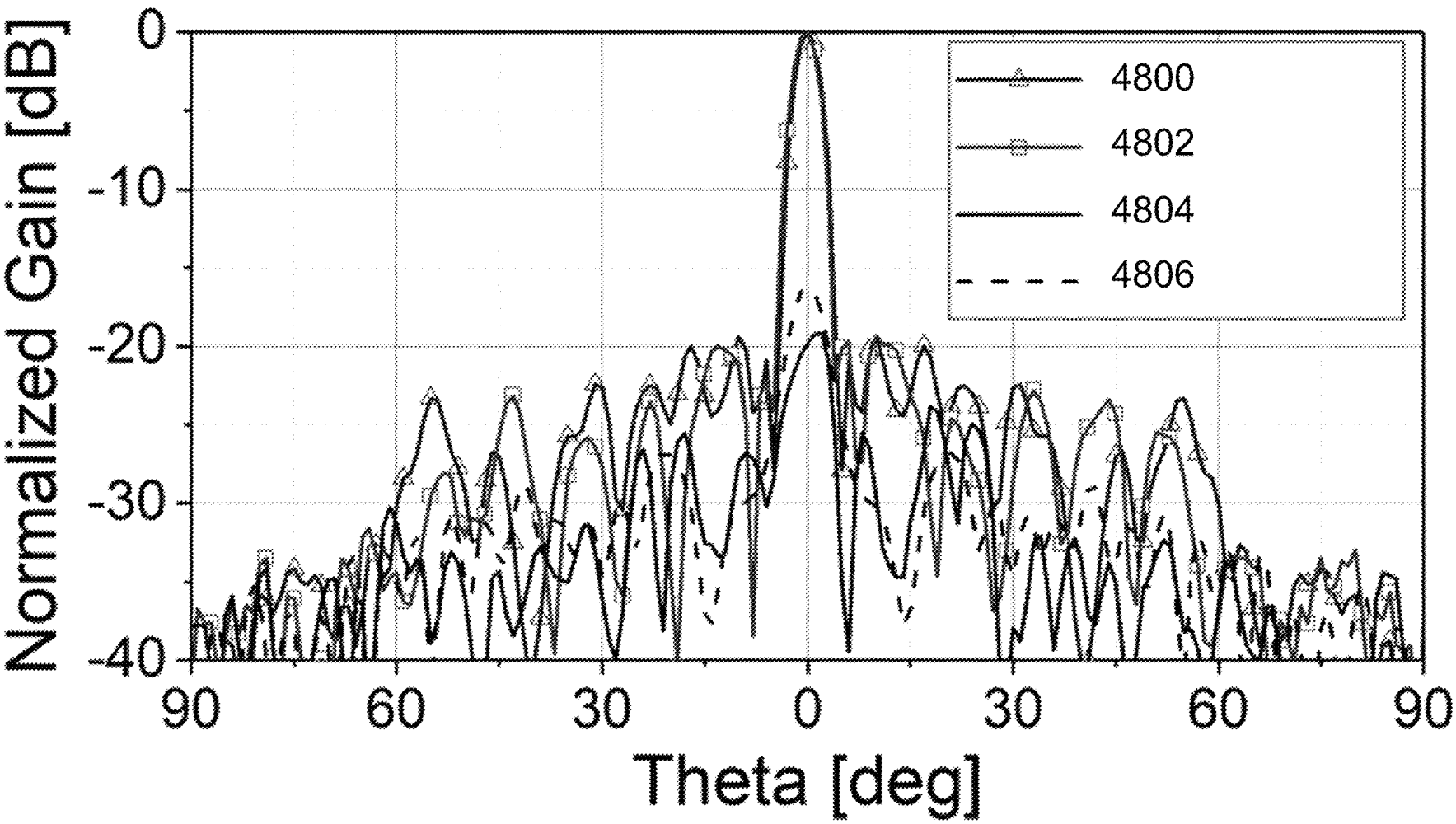
FIG. 48 depicts a comparison between a simulated and a measured normalized gain as a function of angle of the higher frequency band of the phase shifting element of FIG. 32 in accordance with an illustrative embodiment.

Referring to FIG. 48, a comparison between a simulated, normalized co-polarization gain curve 4800 and a measured, normalized co-polarization gain curve 4802 using the first prototype and between a simulated, normalized cross-polarization gain curve 4806 and, a measured normalized cross-polarization gain curve 4804 using the first prototype is shown as a function of the zenith angle for the first prototype.

Figure 53:
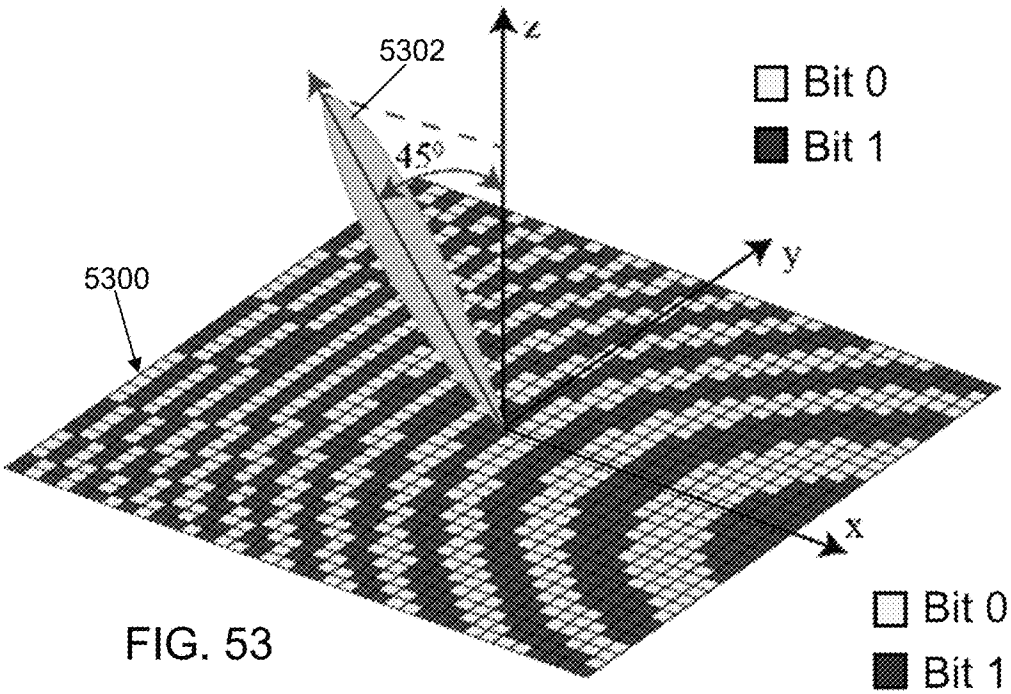
FIG. 53 depicts a main beam created using a second depicted pattern of a distribution of the switch position of the higher frequency band of the phase shifting element of FIG. 32 on the aperture of the reflective array antenna in accordance with an illustrative embodiment, where "bit 0" indicates the first switch position, and "bit 1" indicates the second switch position.

Referring to FIG. 53, a second pattern 5300 of a distribution of the switch position of the plurality of first conducting pattern layers 3202 arranged on reflective array antenna 704 is shown in accordance with an illustrative embodiment, where "bit 0" indicates the first switch position that defines the bit zero configuration and "bit 1" indicates the second switch position that defines the bit one configuration. Second pattern 5300 resulted in a main beam 5302 that is at 45 degrees relative to the z-axis and 180 degrees relative to the x-axis and was created using second pattern 5300 for the switch position of the plurality of first conducting pattern layers 3202.

Figure 54:
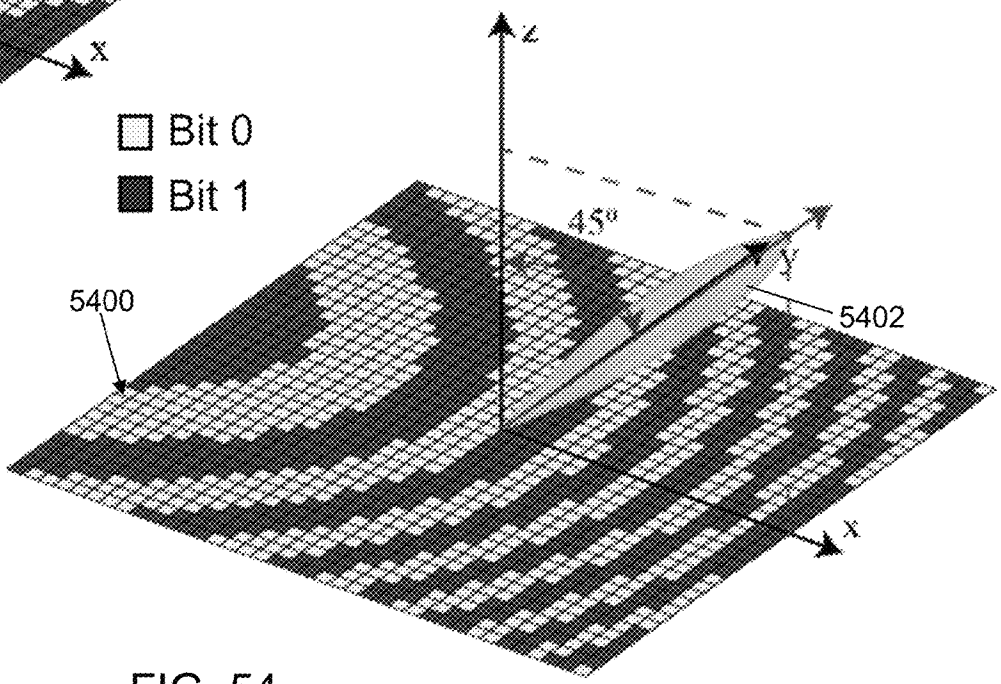
FIG. 54 depicts a main beam created using a second depicted pattern of a distribution of the switch position of the lower frequency band of the phase shifting element of FIG. 32 on the aperture of the reflective array antenna in accordance with an illustrative embodiment, where "bit 0" indicates the first switch position, and "bit 1" indicates the second switch position.

Referring to FIG. 54, a second pattern 5400 of a distribution of the switch position of the plurality of second conducting pattern layer 3204 arranged on reflective array antenna 704 is shown in accordance with an illustrative embodiment, where "bit 0" indicates the first switch position that defines the bit zero configuration and "bit 1" indicates the second switch position that defines the bit one configuration. Second pattern 5400 resulted in a main beam 5402 that is at 45 degrees relative to the z-axis and 0 degrees relative to the x-axis and was created using second pattern 5400 for the switch position of the plurality of second conducting pattern layer 3204. Second pattern 5300 for the switch position of the plurality of first conducting pattern layers 3202 and second pattern 5400 for the switch position of the plurality of second conducting pattern layer 3204 is referred to herein as a second prototype.

Figure 49:
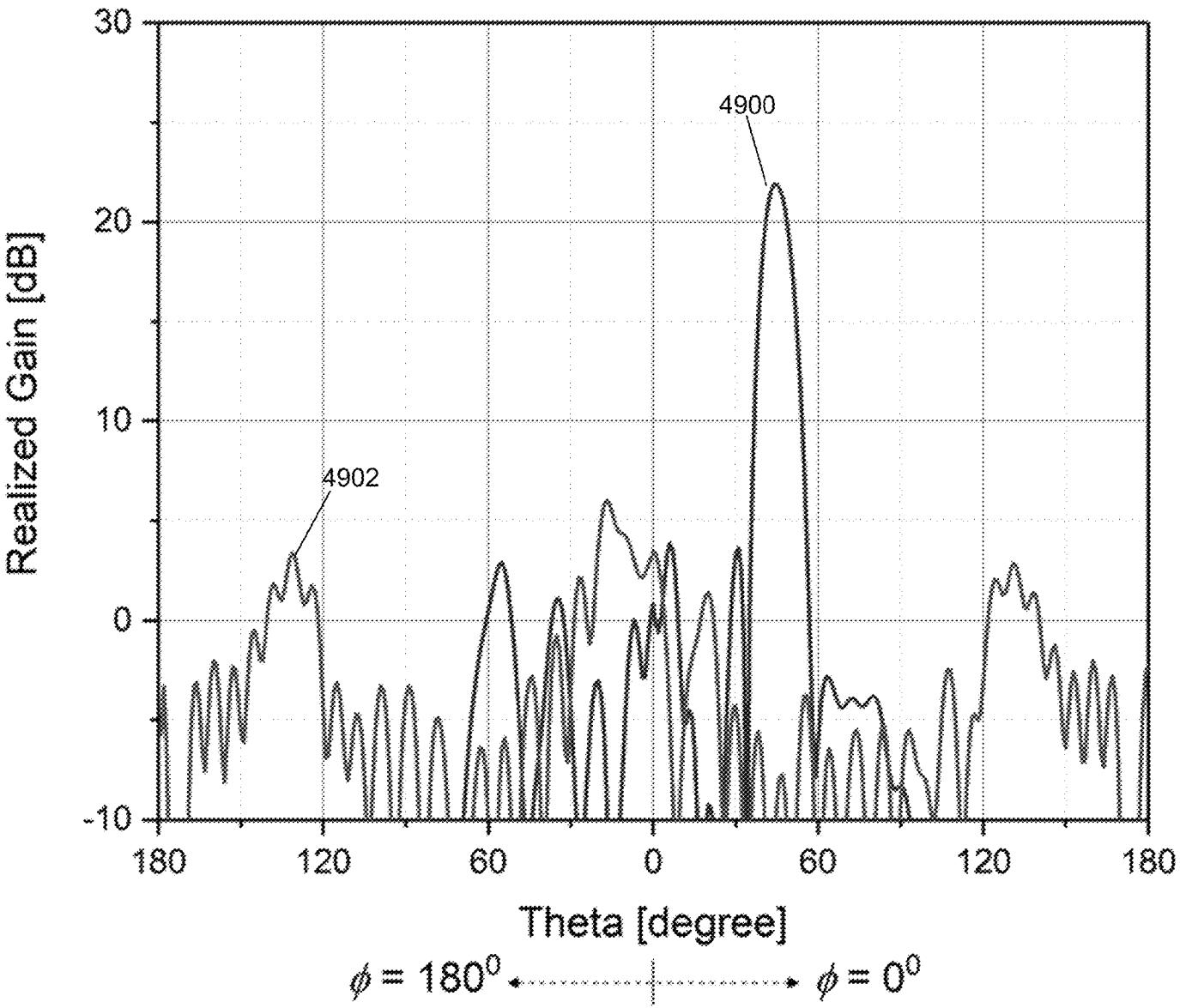
FIG. 49 depicts a measured co-polarization and cross-polarization of a realized gain as a function of angle of the lower frequency band of the phase shifting element of FIG. 32 in accordance with an illustrative embodiment.
Figure 50:
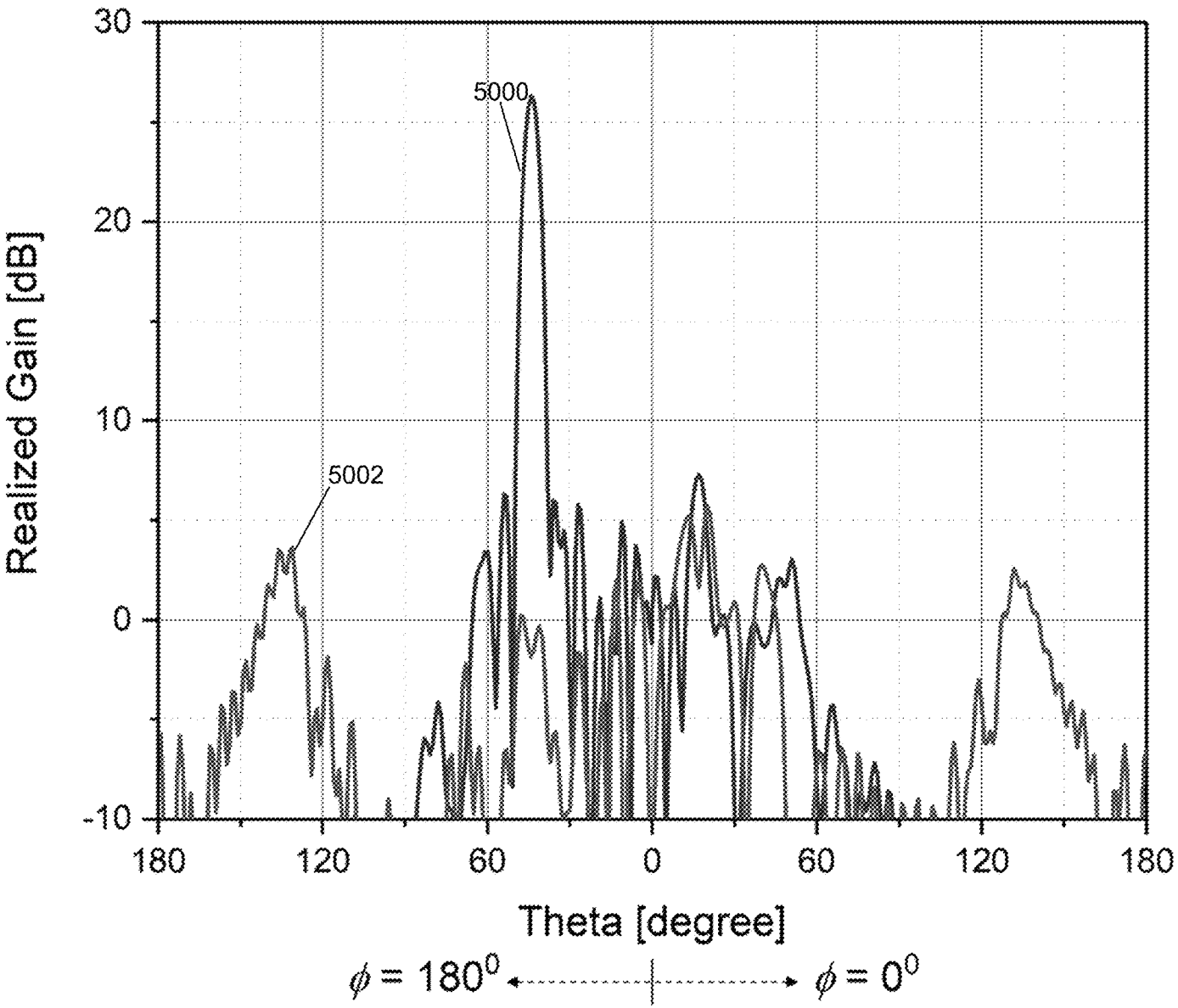
FIG. 50 depicts a measured co-polarization and cross-polarization of a realized gain as a function of angle of the higher frequency band of the phase shifting element of FIG. 32 in accordance with an illustrative embodiment.

Referring to FIG. 49, a simulated co-polarization realized gain curve 4900 and a simulated cross-polarization realized gain curve 4902 is shown as a function of the zenith angle for the second prototype. Referring to FIG. 50, a simulated co-polarization realized gain curve 5000 and a simulated cross-polarization realized gain curve 5002 is shown as a function of the zenith angle for the second prototype. The side lobe levels and cross-polarization levels are low for both frequency bands.

The switching elements (first switch 304*a* and second switch 304*b*) for reconfiguring the phase states of the phase shifters in the two frequency bands are separated and independently operated, enabling independent beam-steering operation for a reflective array in these frequency bands. In each operating frequency band, the single band phase-shifting elements rotate the polarization of a reflected wave by either +90° or −90° with respect to that of a linearly-polarized incident wave, resulting in two phase shift values with a difference of 180° for the reflected wave. The dual-band operation provides new possibilities in beam-steerable reflective array designs. For example, a single reflective array can be implemented for different transmit/receive antenna modules operating in two separate frequency bands to reduce cost, save space and increase portability for a wireless communication or radar system.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, etch, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or a thermoforming process as understood by a person of skill in the art. As a result, elements described herein as being mounted to each other need not be discrete structural elements. The elements may be mounted permanently, removably, or releasably unless specified otherwise.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

Any directional references used herein, such as left-side, right-side, top, bottom, back, front, up, down, above, below, etc., are for illustration only based on the orientation in the drawings selected to describe the illustrative embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A multiple frequency band phase shifter comprising:

a first dielectric layer including a top, first dielectric surface and a bottom, first dielectric surface, wherein the top, first dielectric surface is on an opposite side of the first dielectric layer relative to the bottom, first dielectric surface, wherein the first dielectric layer is formed of a dielectric material;

a conductive layer including a top conductive surface and a bottom conductive surface, wherein the top conductive surface is on an opposite side of the conductive layer relative to the bottom conductive surface, wherein the bottom conductive surface is mounted to the top, first dielectric surface, wherein the conductive layer is formed of a first conductive material;

a second dielectric layer including a top, second dielectric surface and a bottom, second dielectric surface, wherein the top, second dielectric surface is on an opposite side of the second dielectric layer relative to the bottom, second dielectric surface, wherein the bottom, second dielectric surface is mounted to the top conductive surface, wherein the second dielectric layer is formed of a second dielectric material; and for each central operating frequency of a plurality of central operating frequencies, a switch mounted to the bottom, first dielectric surface, the switch configured to be switchable between a first conducting position defined by a first throw arm and a second conducting position defined by a second throw arm;

a plurality of vertical interconnect accesses (vias), wherein each vertical interconnect access (via) of the plurality of vias is formed of a second conductive material that extends through the first dielectric layer, through a third dielectric material formed in and through the conductive layer, and through the second dielectric layer, wherein each via of the plurality of vias is connected to one of the first throw arm or the second throw arm of the switch; and a conducting pattern layer comprising a plurality of conductors, wherein the plurality of conductors is mounted to the top, second dielectric surface, wherein the conducting pattern layer is formed of a third conductive material, wherein each conductor of the plurality of conductors is electrically connected to a distinct via of the plurality of vias;

wherein the first conductive material is configured to reflect an electromagnetic wave incident on the conducting pattern layer and on the second dielectric layer, wherein, when the incident electromagnetic wave is reflected, an electric polarization of the reflected electromagnetic wave is rotated by 90 degrees compared to an electric polarization of the incident electromagnetic wave when the switch is positioned in the first conducting position and the electric polarization of the reflected electromagnetic wave is rotated by −90 degrees compared to the electric polarization of the incident electromagnetic wave when the switch is positioned in the second conducting position.

2. The multiple frequency band phase shifter of claim 1, wherein at least one of the first conductive material, the second conductive material, and the third conductive material is a different conductive material.

3. The multiple frequency band phase shifter of claim 1, wherein at least one of the first dielectric material, the second dielectric material, and the third dielectric material is a different dielectric material.

4. The multiple frequency band phase shifter of claim 1, wherein the first dielectric layer is formed of a plurality of layers of different dielectric materials.

5. The multiple frequency band phase shifter of claim 1, wherein the second dielectric layer is formed of a plurality of layers of different dielectric materials.

6. The multiple frequency band phase shifter of claim 1, wherein the dielectric material is air.

7. The multiple frequency band phase shifter of claim 1, wherein a number of the plurality of conductors for each central operating frequency of the plurality of central operating frequencies is four.

8. The multiple frequency band phase shifter of claim 7, wherein the conducting pattern layer of each central operating frequency of the plurality of central operating frequencies has a crossed-dipole shape.

9. The multiple frequency band phase shifter of claim 7, wherein each conductor of the plurality of conductors has an arrow shape with a first arrow tip arm and a second arrow tip arm separated by 90 degrees.

10. The multiple frequency band phase shifter of claim 9, wherein a tip of each arrow shape is pointed toward a center of the plurality of conductors for each central operating frequency of the plurality of central operating frequencies.

11. The multiple frequency band phase shifter of claim 7, wherein each conductor of the plurality of conductors has a quadrilateral shape with a first arm and a second arm separated by 90 degrees.

12. The multiple frequency band phase shifter of claim 7, wherein the plurality of conductors for a respective central operating frequency of the plurality of central operating frequencies form a mirror image relative to a first plane perpendicular to the top, second dielectric surface and through the center and relative to a second plane perpendicular to the top, second dielectric surface and through the center, wherein the first plane is perpendicular to the second plane.

13. The multiple frequency band phase shifter of claim 7, wherein the first throw arm of the switch for each central operating frequency of the plurality of central operating frequencies connects a first via of the plurality of vias of a respective central operating frequency to a second via of the plurality of vias of the respective central operating frequency, wherein a first conductor of the plurality of conductors of the respective central operating frequency is connected to the first via, wherein a second conductor of the plurality of conductors of the respective central operating frequency is connected to the second via.

14. The multiple frequency band phase shifter of claim 13, wherein the second throw arm of the switch for each central operating frequency of the plurality of central operating frequencies connects a third via of the plurality of vias of the respective central operating frequency to a fourth via of the plurality of vias of the respective central operating frequency, wherein a third conductor of the plurality of conductors of the respective central operating frequency is connected to the third via, wherein a fourth conductor of the plurality of conductors of the respective central operating frequency is connected to the fourth via.

15. The multiple frequency band phase shifter of claim 14, wherein a first electrical path length of the first conductor in combination with the first via of the respective central operating frequency is approximately a quarter of a wavelength $\lambda_0/4$, where $\lambda_0=c/f_0$, where c is a speed of light and $f_0$ is the respective central operating frequency of the incident electromagnetic wave.

16. The multiple frequency band phase shifter of claim 15, wherein a second electrical path length of the first conductor in combination with the first via, the first throw arm, the third via, and the third conductor of the respective central operating frequency is approximately a half of a wavelength $\lambda_0/2$.

17. The multiple frequency band phase shifter of claim 14, wherein the first via of the plurality of vias of a first central operating frequency is positioned adjacent the third via of the plurality of vias of a second central operating frequency.

18. The multiple frequency band phase shifter of claim 17, wherein the first via of the plurality of vias of the first central operating frequency is positioned a first distance from the third via of the plurality of vias of the second central operating frequency to reduce interference between the plurality of conductors of the first central operating frequency and the plurality of conductors of the second central operating frequency.

19. The multiple frequency band phase shifter of claim 1, wherein the switch for each central operating frequency of the plurality of central operating frequencies is a double pole, double throw switch.

20. A phased array antenna comprising:

a first dielectric layer including a top, first dielectric surface and a bottom, first dielectric surface, wherein the top, first dielectric surface is on an opposite side of the first dielectric layer relative to the bottom, first dielectric surface, wherein the first dielectric layer is formed of a dielectric material;

a conductive layer including a top conductive surface and a bottom conductive surface, wherein the top conductive surface is on an opposite side of the conductive layer relative to the bottom conductive surface, wherein the bottom conductive surface is mounted to the top, first dielectric surface, wherein the conductive layer is formed of a first conductive material;

a second dielectric layer including a top, second dielectric surface and a bottom, second dielectric surface, wherein the top, second dielectric surface is on an opposite side of the second dielectric layer relative to the bottom, second dielectric surface, wherein the bottom, second dielectric surface is mounted to the top conductive surface, wherein the second dielectric layer is formed of a second dielectric material; and a plurality of multiple frequency band phase shift elements distributed linearly in a direction, wherein each multiple frequency band phase shift element of the plurality of multiple frequency band phase shift elements comprises for each central operating frequency of a plurality of central operating frequencies, a switch mounted to the bottom, first dielectric surface, the switch configured to be switchable between a first conducting position defined by a first throw arm and a second conducting position defined by a second throw arm;

a plurality of vias, wherein each via of the plurality of vias is formed of a second conductive material that extends through the first dielectric layer, through a third dielectric material formed in and through the conductive layer, and through the second dielectric layer, wherein each via of the plurality of vias is connected to one of the first throw arm or the second throw arm of the switch; and a conducting pattern layer comprising a plurality of conductors, wherein the plurality of conductors is mounted to the top, second dielectric surface, wherein the conducting pattern layer is formed of a third conductive material, wherein each conductor of the plurality of conductors is electrically connected to a distinct via of the plurality of vias;

wherein the first conductive material is configured to reflect an electromagnetic wave incident on the conducting pattern layer and on the second dielectric layer, wherein, when the incident electromagnetic wave is reflected, an electric polarization of the reflected electromagnetic wave is rotated by 90 degrees compared to an electric polarization of the incident electromagnetic wave when the switch is positioned in the first conducting position and the electric polarization of the reflected electromagnetic wave is rotated by −90 degrees compared to the electric polarization of the incident electromagnetic wave when the switch is positioned in the second conducting position.

* * * * *